US012790838B2

(12) United States Patent
Rashid et al.

(10) Patent No.: US 12,790,838 B2
(45) Date of Patent: Nov. 10, 2026

(54) ROOFING SUPPORT SYSTEM WITH SELECTIVELY REMOVEABLE AND REPLACEABLE BASE MEMBERS

(71) Applicant: Phil Squared Roof Jack Systems LLC, Highland, MI (US)

(72) Inventors: Philip F Rashid, Brighton, MI (US); Phillip A Tesolin, Hartland, MI (US)

(73) Assignee: Phil Squared Roof Jack Systems LLC, Brighton, MI (US)

( * ) Notice: Subject to any disclaimer, the term of this patent is extended or adjusted under 35 U.S.C. 154(b) by 0 days.

(21) Appl. No.: 18/752,678

(22) Filed: Jun. 24, 2024

(65) Prior Publication Data

US 2024/0344337 A1 Oct. 17, 2024

Related U.S. Application Data

(63) Continuation of application No. 17/191,448, filed on Mar. 3, 2021, now Pat. No. 12,018,500.

(51) Int. Cl.
*E04D 15/00* (2006.01)
*E04G 3/26* (2006.01)

(52) U.S. Cl.
CPC ..... *E04G 3/265* (2013.01); *E04D 15/00* (2013.01)

(58) Field of Classification Search
CPC ..... E04G 3/265; E04G 3/26; E04D 15/00; E04D 13/12; E04D 11/005
See application file for complete search history.

(56) References Cited

U.S. PATENT DOCUMENTS

| | | | | |
|---|---|---|---|---|
| 9,145,687 | B1 * | 9/2015 | Bancroft | E04D 15/00 |
| 12,018,500 | B2 * | 6/2024 | Rashid | E04D 15/00 |
| 12,286,806 | B2 * | 4/2025 | Rashid | E04D 13/12 |
| 2018/0334814 | A1 * | 11/2018 | Rashid | E04D 13/12 |

* cited by examiner

*Primary Examiner* — Bradley Duckworth
(74) *Attorney, Agent, or Firm* — North Star IP Law PLLC; Edmund P. Anderson

(57) ABSTRACT

A lightweight composite roofing support system comprises a longitudinally-extending core member comprising a longitudinally-extending first roof contact side comprising a first core edge and opposed second core edge, a longitudinally-extending second side comprising a second side working surface, the second side tapering toward the first core edge at a first acute angle, and a longitudinally-extending third side comprising a third side working surface, the third side tapering toward the second core edge at a second acute angle that is different than the first acute angle, a laterally-extending first core end comprising an integral first recess defining a first handle/grip, and an opposed laterally-extending second core end comprising an integral second recess defining a second handle/grip, the core member comprising a core material and a wedge-shaped lateral cross-section, the first roof contact side comprising a base attachment structure configured for selective attachment to/detachment from a mating base member core attachment structure.

27 Claims, 52 Drawing Sheets

| PHYSICAL PROPERTY | TEST METHOD | UNITS | TEST RESULTS | | | | | | |
|---|---|---|---|---|---|---|---|---|---|
| Density | ASTM-D3575 | grams/liter | 20 | 30 | 45 | 60 | 67 | 82 | 90 |
| Compressive Strength | ASTM-D3575 | MPa | | | | | | | |
| @25% Strain | | | 0.10 | 0.16 | 0.28 | 0.39 | 0.44 | 0.60 | 0.69 |
| @50% Strain | | | 0.16 | 0.23 | 0.37 | 0.53 | 0.58 | 0.80 | 0.93 |
| @75% Strain | | | 0.31 | 0.44 | 0.77 | 1.07 | 1.26 | 1.80 | 2.08 |
| Compression Set | ASTM-D3575 | % | 14 | 12 | 12 | 11 | 11 | 10 | 10 |
| Tensile Strength | ASTM-D3575 | MPa | 0.26 | 0.38 | 0.46 | 0.62 | 0.71 | 0.87 | 0.97 |
| Tensile Elongation | ASTM-D3575 | % | 15 | 15 | 14 | 14 | 13 | 13 | 12 |
| Tear Strength | ASTM-D3575 | KN/m | 1.74 | 2.13 | 2.73 | 3.25 | 3.51 | 4.07 | 4.35 |
| Flexural Strength | ASTM-D790 | MPa | .21 | .38 | .54 | .72 | .86 | 1.08 | 1.16 |
| Flexural Modulus | | MPa | 9.8 | 11.6 | 14.5 | 19.0 | 22.2 | 28.9 | 31.1 |
| Coefficient of Linear Thermal Expansion | ASTM-D696 | mm/mm/°C x $10^{-5}$ | | | | | | | |
| 20°C to -40°C | | | 6.8 | 5.9 | 5.5 | 4.3 | 4.1 | 3.9 | 3.7 |
| 20°C to 80°C | | | 10.8 | 10.2 | 9.8 | 8.7 | 7.9 | 7.5 | 6.8 |
| Water Absorption | ASTM-C272 | gms/cc x $10^{-3}$ | 10.4 | 8.1 | 6.2 | 5.1 | 4.5 | 4.2 | 3.5 |
| Flammability | FMVSS 302 | < 100 mm/min. | Pass | Pass | Pass | Pass | Pass | Pass | Pass |
| Chemical Resistance (Auto fuels, fluids, solvents) | Various | 1 hr exposure | Pass | Pass | Pass | Pass | Pass | Pass | Pass |

FIG. 64

| EMR1 POLYETHER POLYURETHANE FOAM | | | | |
|---|---|---|---|---|
| PHYSICAL PROPERTIES* | TEST VALUES* | | | |
| | U.S. STANDARD | | METRIC | |
| | MINIMUM | AVERAGE | MINIMUM | AVERAGE |
| Density | 1.50 ± 10% lbs./ft.$^3$ | | 24.0 ± 10% kg/M$^3$ | |
| Tensile Strength | 15.0 psi | 20.0 psi | 103 kPa | 138 kPa |
| Elongation | 150% | 250% | 150% | 250% |
| Tear Resistance | 1.30pli | 2.00pli | 228 N/M | 350 N/M |
| Indentation Force Deflection | | | | |
| 25% Deflection | 35 lbs./50 in.$^2$ | 45 lbs./50 in.$^2$ | 156 N/323 cm$^2$ | 200 N/323 cm$^2$ |
| 65% Deflection | 70 lbs./50 in.$^2$ | 90 lbs./50 in.$^2$ | 311 N/323 cm$^2$ | 400 N/323 cm$^2$ |
| Retention of Tensile Strength after 5 hours, 120°C, steam autoclave | Min. 70% | | | |

Flammability Characteristics:

- Meets the requirements of S4.3 of Federal Motor Vehicle Safety Standard No. 302 ‡

Features:

- This product contains additives to retard microbial growth and degradation.
- Restriction of Hazardous Substances European Union Directive [ROHS3] - (2015/863/EU) Meets the Requirements of SVHC through today's date.
- Compliant with European union REACH (Registration, Evaluation and Authorization of Chemical Substances - EC1907/2006
- Minimum IFD at 20mm (0.79 in) thickness 23 lbs./50 sq. in.

* Test Methods: ASTM-D3574-[latest version]. Standard Methods of Testing Flexible Cellular Materials - Slab, Bonded, and Molded Urethane Foam.

FIG. 65

ROOFING SUPPORT SYSTEM WITH SELECTIVELY REMOVEABLE AND REPLACEABLE BASE MEMBERS

REFERENCE TO RELATED APPLICATIONS

This application is related to U.S. Non-Provisional Design patent application Ser. No. 29/741,734 filed on Jul. 15, 2020 and US Non-Provisional Utility patent application Ser. No. 17/163,200 filed on Jan. 29, 2021, and is a continuation of and claims priority to US Non-Provisional Utility patent application Ser. No. 17/191,448 filed on Mar. 3, 2021, the contents of which applications are incorporated herein by reference in their entirety.

FIELD OF THE INVENTION

The subject invention relates generally to a lightweight roofing support system comprising a selectively removeable and replaceable base member and roof attachment member. More particularly, it relates to a lightweight composite roofing support system comprising a core member and a selectively removeable and replaceable base member and roof attachment member that is configured to provide a level, stable, self-supporting platform for roofing workers, roofing tools, roofing materials, or a combination thereof, on a pitched or sloped roof.

BACKGROUND

The removal and/or application of roofing systems and roofing materials on sloped or pitched roofs presents long-standing problems, particularly on relatively steeply pitched roofs, such as those having a pitch above 8/12 (i.e., 8 feet of vertical rise for every 12 feet of horizontal run), problems that are particularly acute on steeply pitched roofs with pitches ranging from 10/12 to 16/12. Steeply pitched roofs are exceedingly difficult for roofing workers to work on, particularly to move, walk, stand, crouch, kneel, sit, or lie on, or otherwise, whether working to remove an old roof or to construct a new roof, and including to distribute or store roofing tools or equipment or roofing materials for these purposes.

Various support systems and structures have been proposed to provide a platform for roofing workers, roofing tools, roofing materials, or a combination thereof, on pitched or sloped roofs. One common support structure comprises a plurality of spaced apart roof jacks that are used to support a jack board between them. The jack board generally provides a substantially horizontal surface on which roofing workers can move horizontally across the roof surface, and on which they may store roofing tools and roofing materials. A problem associated with this system is that the jack stands and jack boards are heavy and require a substantial expenditure of time and effort in order to locate, and in order to reposition as the deconstruction and/or construction of the roof systems proceed. In addition, attachment of the jack stands and the jack boards generally disadvantageously require anchoring to the roof deck by the insertion of nails or screws, or the resulting perforation of the upper portion of the shingles, underlayment material, or wooden roof deck, which are all known leakage paths for water from condensation, rain, and/or ice, for example.

Polymer based roof blocks have been proposed but have generally been unsuitable. In some cases, polymer roof blocks have been too rigid, such that the blocks are not non-skid and unstable and thus tend to slide downwardly in the downslope direction over the surface of the pitched roof, particularly if the roof is steeply pitched.

Therefore, it would be very desirable provide a lightweight composite roofing support system that avoids the limitations described above, and a provides a level, stable, self-supporting platform for roofing workers, roofing tools, roofing materials, or a combination thereof, on pitched or sloped roofs, and particularly steeply pitched or sloped roofs.

SUMMARY OF THE INVENTION

In one embodiment, a lightweight composite roofing support system is disclosed. The lightweight composite roofing support system comprises a longitudinally-extending core member comprising a longitudinally-extending first roof contact side comprising a longitudinally-extending first core edge and an opposed longitudinally-extending second core edge, a longitudinally-extending second side comprising a second side working surface having a second width and a second length that is greater than the second width, the second side tapering toward the first core edge at a first acute angle ($\alpha$) from the first roof contact side, and a longitudinally-extending third side comprising a third side working surface having a third width and a third length that is greater than the third width, the third side tapering toward the second core edge at a second acute angle ($\beta$) from the first contact side that is different than the first acute angle ($\alpha$), a laterally-extending first core end comprising an integral first recess defining a first handle or grip, and an opposed laterally-extending second core end comprising an integral second recess defining a second handle or grip, the core member comprising a core material and a wedge-shaped lateral cross-section, the first roof contact side comprising a base attachment structure configured for selective attachment to and detachment from a mating core attachment structure of a base member.

In another embodiment, a lightweight composite roofing support system is disclosed. The lightweight composite roofing support system comprises a longitudinally-extending base member comprising a base material and comprising a longitudinally-extending first core contact side and an opposed longitudinally-extending bottom side comprising a longitudinally-extending first base edge and an opposed longitudinally-extending second base edge, the first core contact side comprising a core attachment structure that is configured for selective attachment to and detachment from a mating base attachment structure of a core member, the bottom side comprising a roof attachment member disposed thereon that is configured for contact with and adhesion to a sloped roof surface.

In yet another embodiment, a lightweight composite roofing support system is disclosed. The a lightweight composite roofing support system comprises a longitudinally-extending core member comprising a longitudinally-extending first roof contact side comprising a longitudinally-extending first core edge and an opposed longitudinally-extending second core edge, a longitudinally-extending second side comprising a second side working surface having a second width and a second length that is greater than the second width, the second side tapering toward the first core edge at a first acute angle ($\alpha$) from the first roof contact side, and a longitudinally-extending third side comprising a third side working surface having a third width and a third length that is greater than the third width, the third side tapering toward the second core edge at a second acute angle ($\beta$) from the first contact side that is different than the first acute angle (α), a laterally-extending first core end comprising an integral first recess defining a first handle or grip, and an opposed laterally-extending second core end comprising an integral second recess defining a second handle or grip, the core member comprising a core material and a wedge-shaped lateral cross-section, the first roof contact side comprising a base attachment structure configured for selective attachment to and detachment from a mating core attachment structure of a base member. The lightweight composite roofing support system also comprises a longitudinally-extending base member comprising a base material and comprising a longitudinally-extending first core contact side and an opposed longitudinally-extending bottom side comprising a longitudinally-extending first base edge and an opposed longitudinally-extending second base edge, the first core contact side comprising a core attachment structure that is configured for selective attachment to and detachment from a mating base attachment structure of a core member, the bottom side comprising a roof attachment member disposed thereon that is configured for contact with and adhesion to a sloped roof surface.

The above features and advantages and other features and advantages of the invention are readily apparent from the following detailed description of the invention when taken in connection with the accompanying drawings.

BRIEF DESCRIPTION OF THE DRAWINGS

Other features, advantages and details appear, by way of example only, in the following detailed description of embodiments, the detailed description referring to the drawings in which:

FIG. 64 is a table illustrating representative properties of a core material and/or base material and/or rail material comprising expanded polypropylene (EPP); and FIG. 65 is a table illustrating representative properties of a cover material and/or base cover material comprising a flexible polyurethane foam (FPF).

DESCRIPTION OF THE EMBODIMENTS

Figure 1:
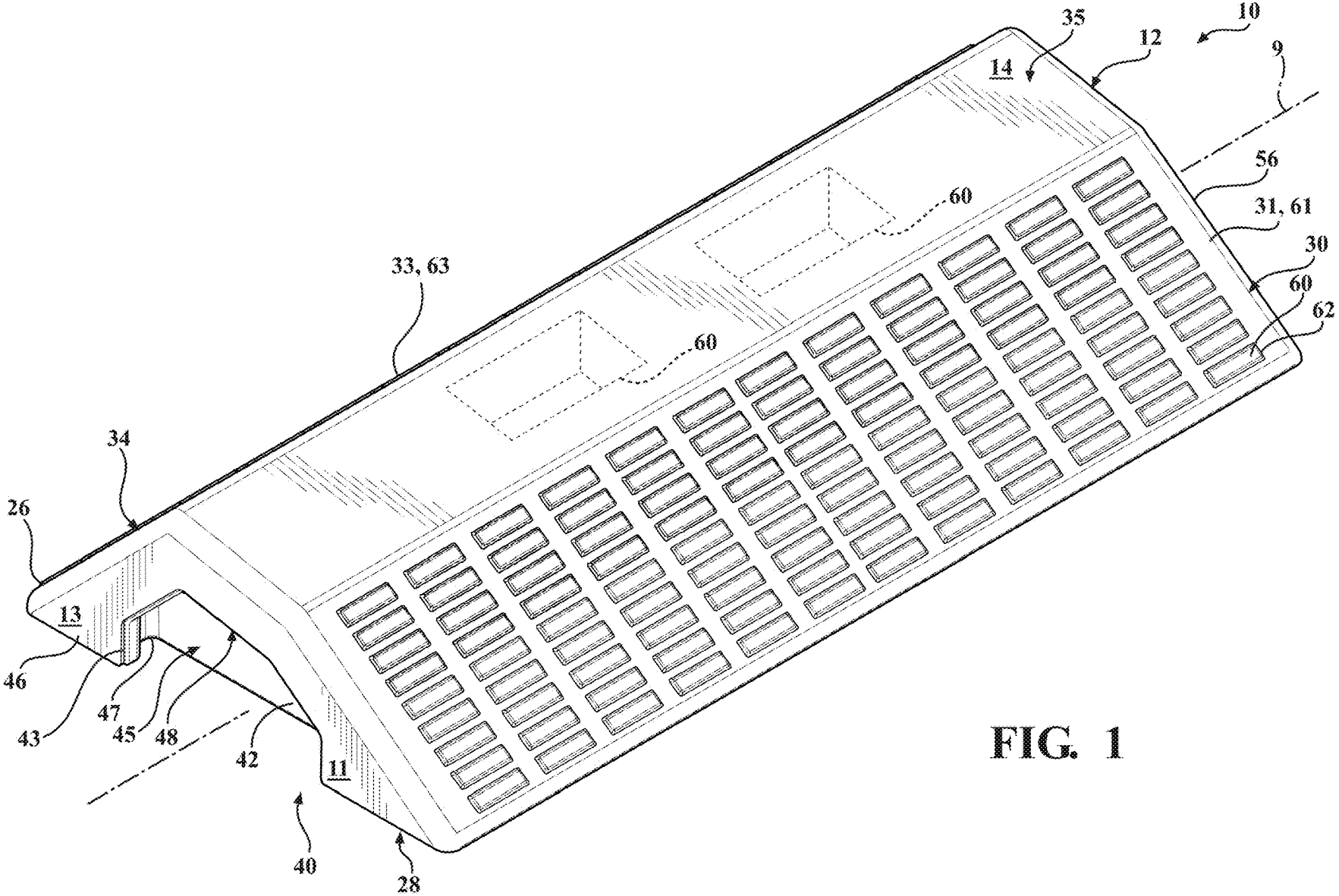
FIG. 1 is a top perspective view of an embodiment of a roofing support system and roof support as disclosed herein illustrating an embodiment of a core member, as described herein.
Figure 2:
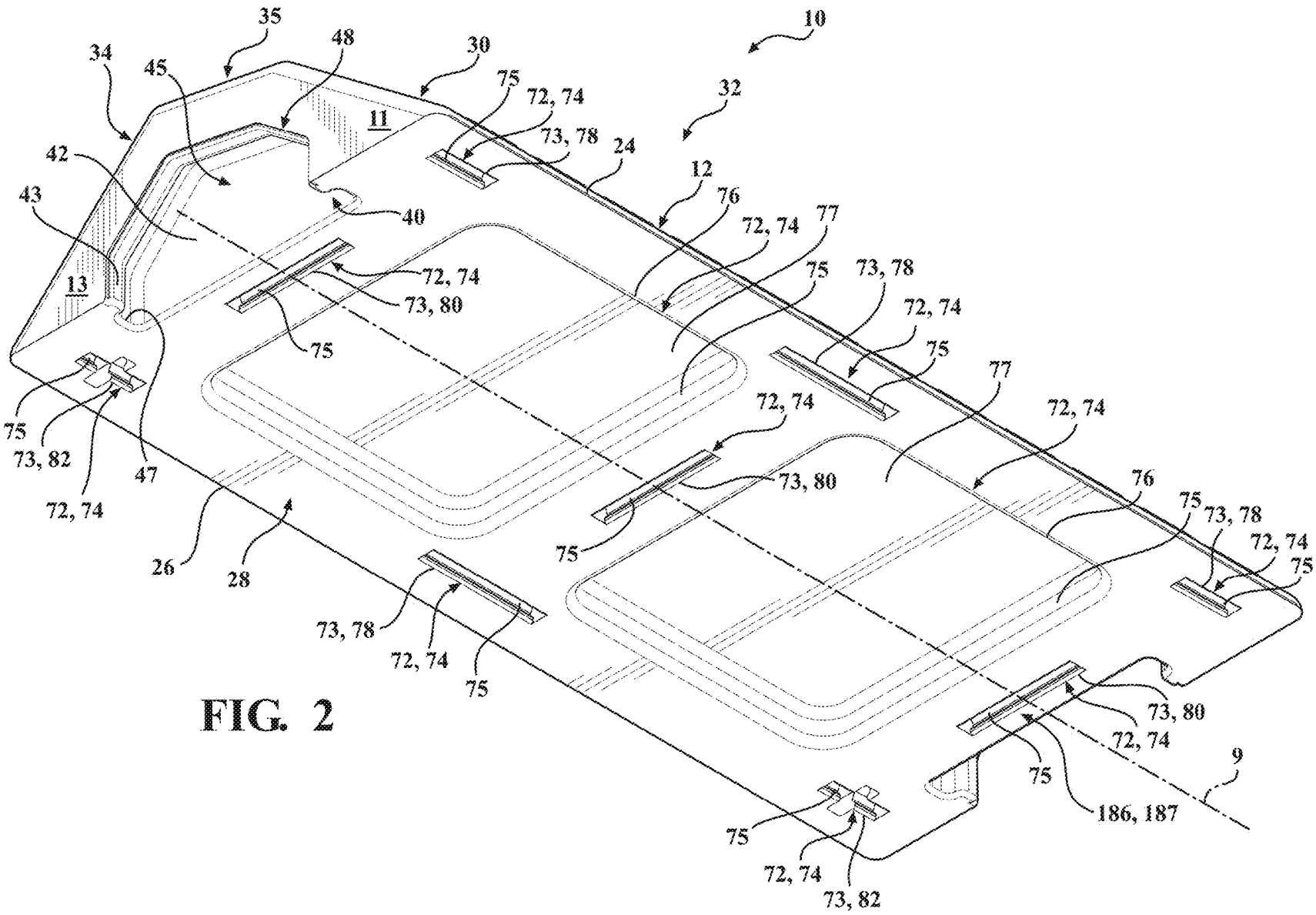
FIG. 2 is a bottom perspective view of the roofing support system and roof support of FIG. 1.
Figure 3:
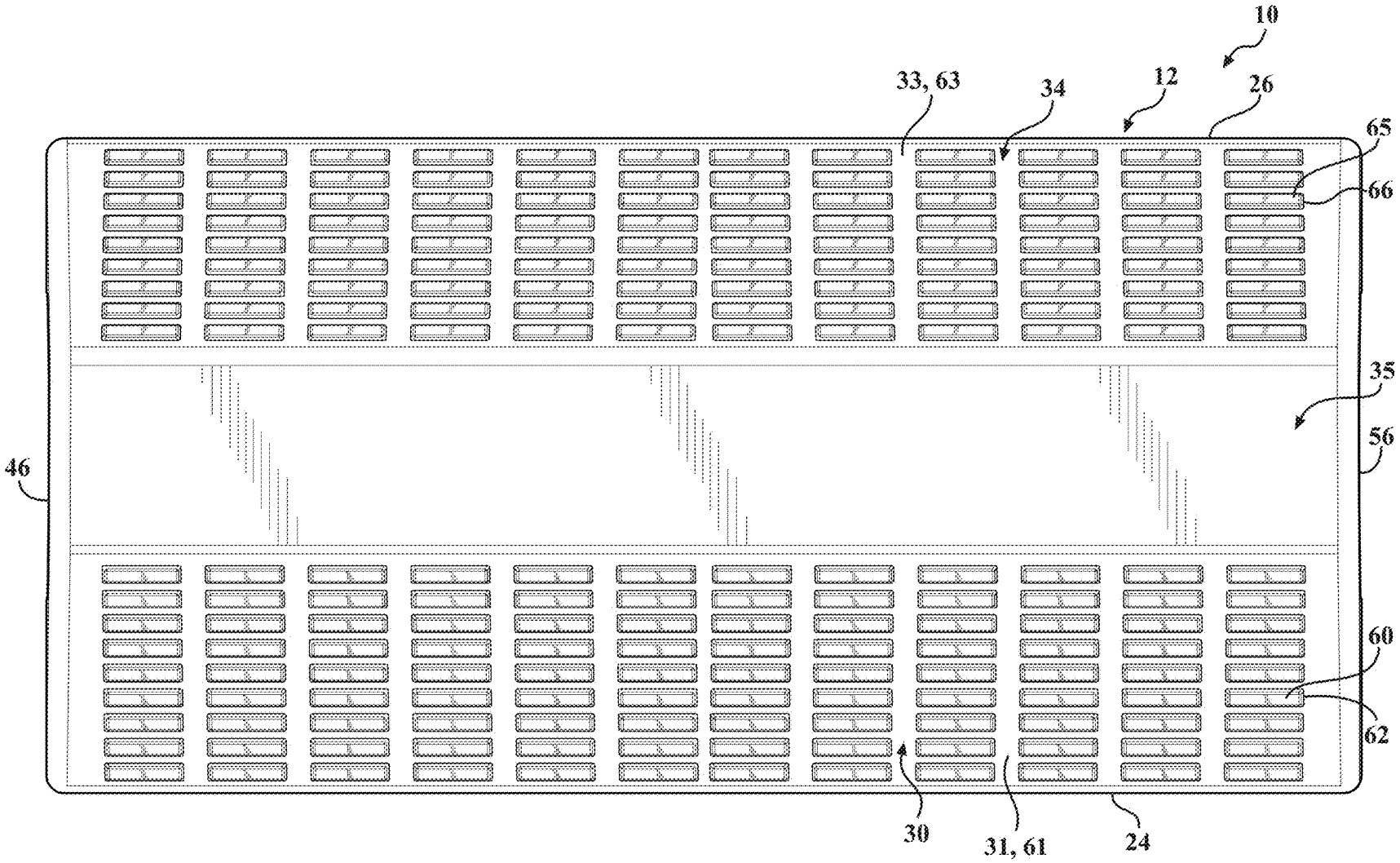
FIG. 3 is a top view of the roofing support system and roof support of FIG. 1.
Figure 4:
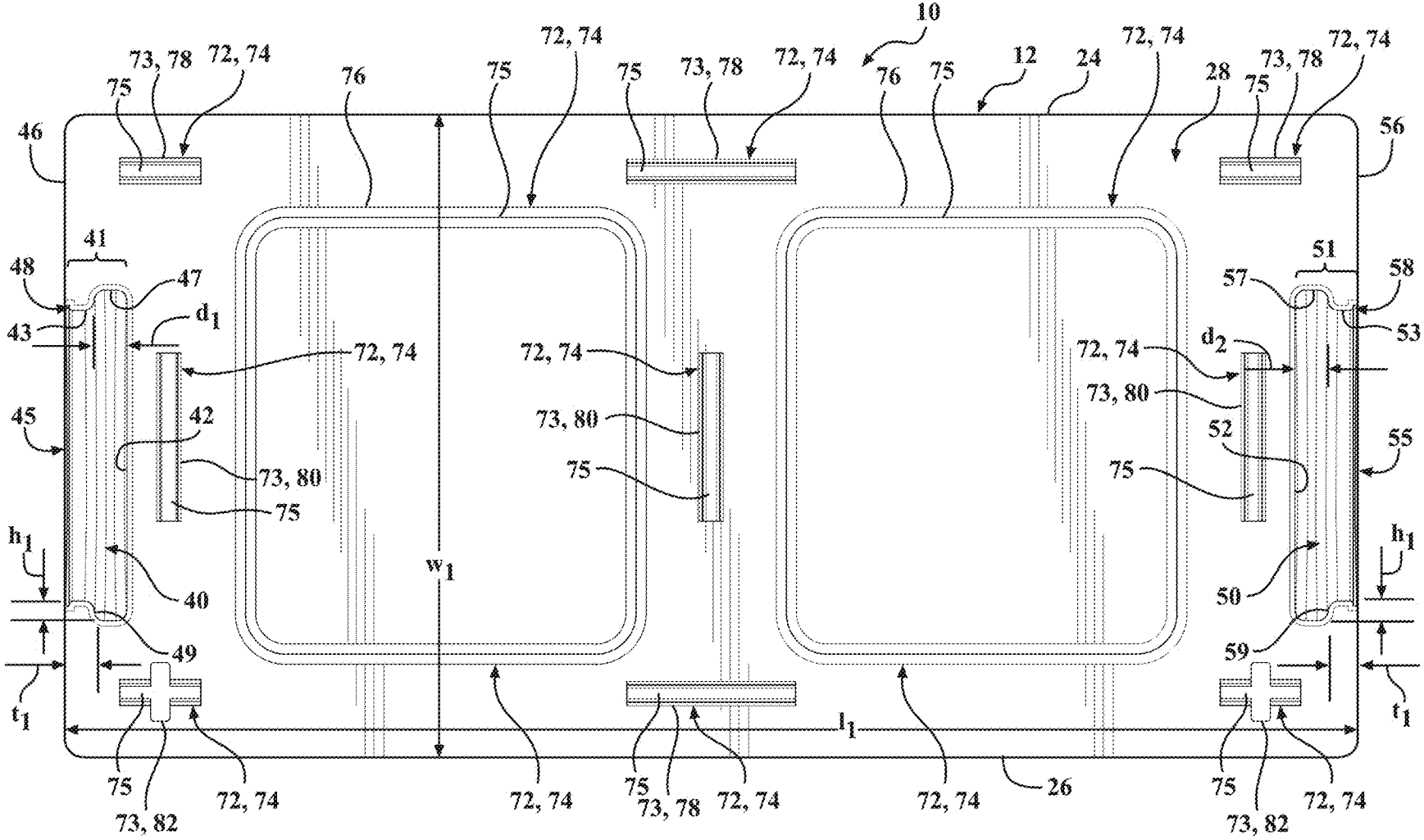
FIG. 4 is a bottom view of the roofing support system and roof support of FIG. 1.

This invention comprises a lightweight composite roofing support system comprising a reversible dual or double-wedge that supports, or acts as a portable support or platform for, a roofing load placed on a sloped or pitched roof. The roofing load may include a roofing worker (person), or workers, or various roofing materials or equipment, or a combination thereof. The lightweight composite roofing support system may be used without the requirement of fasteners to hold it in place. Thus, it advantageously avoids the need to penetrate the roof decking or roofing materials to secure the support or platform to the sloped roof surface. As used herein, roofing workers includes any person performing work on the roof of a house or other building for any purpose, including those that repair, remove, or install roofing materials, as well as painters, carpenters, siding installers, seasonal light installers, satellite installers, HVAC equipment installers, homeowners, and any other person that has occasion to perform work upon a sloped or pitched roof, particularly a steeply sloped or pitched roof, as described herein. As used herein, roofing material may include any material or equipment or tool placed on the roof of a house or other building either temporarily or permanently, including roofing construction or repair materials, such as asphalt or fiberglass shingles, metal panels, boards, wooden or composite sheet or board underlayment, rolled roofing products, solar panels, solar shingles, vents, nails, staples, or screws, or materials or equipment that are placed on or in or protrude from a roof, such as various antennas, satellite dishes, dormer materials, chimney materials, skylights, windows, air conditioning components, and the like. The lightweight composite roofing support system represents an improvement over existing roofing support systems, sloped roof article holders and roof leveling platforms. The lightweight composite roofing support system can be used by roofing workers as a stable, non-skid platform to walk, stand, crouch, kneel, sit, or lie on, or stack, place or otherwise stage or store roofing materials or equipment on. The design allows the dual or double-wedge to be manufactured at different lengths and for roofing workers as users to move freely along the length of the wedge analogous to the manner in which roofing workers would move along a traditional jack board that is used in combination with a plurality of roof jacks that are anchored to the roof with attachments such as nails or screws. The lightweight composite roofing support system advantageously does not require that it be anchored to the roof deck by the insertion of nails or screws with the resultant perforation of the upper portion of the shingles, underlayment, or wooden roof deck, which are all known leakage paths for water that occurs on the roof as a result of condensation, rain, hail, snow, or ice, for example. In one embodiment, the lightweight composite roofing support system or dual or double-wedge comprises a molded polymer support or core member with a plurality of support sides configured to provide a level working surface for at least two different specific roof slopes or pitches, and a substantially level work surface over a range of similar roof slopes that are greater than and less than the specific roof slopes, that has an attached cover layer or roof contact layer attached to a roof contact side that is configured to contact and provide compliance and adhesion to a steeply sloped roof surface. The core member also has integral handles or grips formed on opposed ends that may be used to easily lift or carry the roofing support system onto the sloped roof (e.g., up a ladder) or while working on the sloped roof.

In one embodiment, the lightweight composite roofing support system or wedge comprises a molded plastic support or core member with a plurality of support sides and integral handles or grips formed on opposed ends and a selectively attachable/detachable base member and roof attachment member. In one embodiment, the roof attachment member comprises a resiliently compressible cover layer or roof contact layer. In another embodiment, the roof attachment member comprises a plurality of laterally extending rails, each rail comprising a recess formed in a bottom surface thereof, a permanent magnet disposed in the recesses, and a rail cover layer comprising a rail cover material disposed on the rail bottom surface and covering the magnets. The plurality of permanent magnets provides a magnet attraction force that further enhances adhesion to magnetic metal roof surfaces (e.g., steel roof surfaces).

The cross-sectional shape of the molded plastic support or core member may be configured with a triangular (e.g., scalene triangular), truncated triangular, scalene trapezoid, or irregular quadrilateral shape, for example, to provide a level working surface to move, walk, stand, crouch, kneel, sit, or lie on, or stack, place or otherwise store roofing materials or equipment on for two different specific roof slopes (e.g. 10/12 and 12/12), and a substantially level work surface over a range of roof slopes that are slightly less than or greater than the specific roof slopes, by merely rotating the base or roof contact surface of the wedge 180°. The cover layer or roof contact layer or rail cover layer includes a cover or roof contact or rail cover material, such as various open-cell or closed-cell foams, including polyurethane foam, and natural or synthetic sponge rubber, and the like that advantageously provide a non-skid attachment or adhesion to most roof surfaces, particularly asphalt or fiberglass shingle roof surfaces, and including common roofing underlayment materials (e.g. asphalt felt, rubberized felt, and polymer or synthetic underlayment) or roof deck materials (e.g. dimensional lumber, plywood, and oriented strand board (OSB)). The cover or roof contact or rail cover material may be configured to provide a coefficient of sliding friction, particularly when loaded, that in some embodiments prevents sliding movement down the roof, and other embodiments substantially prevents or resists sliding movement down the roof. Cost and weight are kept at a minimum while maintaining robustness by eliminating moving parts and the need for fasteners, such as nails and screws, found in related art devices.

In one embodiment, a triangular, truncated triangular, scalene trapezoidal, or irregular quadrilateral cross-sectional shape may be configured to provide dual or double-wedge lateral cross-sectional shape and a level working surface for two different roof slopes by merely rotating the wedge 180°. In one embodiment, the level working surfaces of the support sides comprise a non-slip material, or include a surface roughness, texture, or pattern of protruding traction elements (e.g., raised rectangular, chevron, or wavy bars, or circular buttons) that provide a non-slip surface. The lightweight composite roofing support system or dual or double-wedge may include integral handles or grips, including integrally molded handles or grips, for easy transportation, including lifting or carrying the system onto a roof, and repositioning of the system or wedge on the roof while working.

As used herein, longitudinal or along the length refers to a direction that extends along an article centerline or axis and may also be used in reference to a direction that is generally parallel to a roof peak. The term lateral or along the width or left-right refers to a direction that is orthogonal, or substantially orthogonal, to the longitudinal direction. The terms up or upward or down or downward refer to the top or bottom of the article, or to a direction substantially toward the top or bottom of the article, respectively, and may also be used in context in reference to a direction that is generally upward toward a roof peak or downward toward the ground. The terms in or inward refer to a direction toward the center of the article, and out or outward refers to the opposite direction away from the center or central portion of the article. The term upslope or up-roof refers to a direction or placement toward or closer to the peak or apex of a sloped roof and, conversely, the term downslope or down-roof refers to a direction or placement away from or farther from the peak or apex of a sloped roof and closer to the ground.

Referring to FIGS. 1-65, for example, a lightweight composite roofing support system 10 is disclosed. The lightweight composite roofing support system 10 is a roofing support 32 or platform that supports a roofing load 2. The roofing load may be any static or dynamic roofing load 2 placed on a sloped or pitched roof 36, including a load from the weight of a roofing worker 6 or workers, or a roofing material 8, such as bundles of shingles 99 (e.g. asphalt or fiberglass shingles), rolled roofing material (e.g. tar paper, adhesive polymer snow and ice shield), structural members (e.g. dimensional lumber), underlayment (e.g. sheets of oriented strand board (OSB) and/or plywood), wood or clay or ceramic roofing tiles, metal roofing panels, solar shingles (e.g. solar panels applied directly to the roof and also serving as the roof covering) or solar roof panels (e.g. solar panels disposed onto or above the roofing material) and/or fasteners, or loads associated with any other construction materials (e.g. paint containers, siding, all manner of construction tools and/or equipment, and the like) placed thereon. In certain embodiments, the lightweight composite roofing support system 10 may also be referred to as a roof step or roof platform because it provides a platform for a worker, or workers, to move, walk, stand, crouch, kneel, sit, or lie on, or otherwise use as a level work surface while working on a sloped or pitched roof 36. The lightweight composite roofing support system 10 may be used without the requirement of fasteners to hold it in place. In these embodiments, the weight of a roofing load 2 placed on the lightweight composite roofing support system 10 together with the coefficient of friction of the contact surface of the support system in contact on the surface of the sloped or pitched roof 36 provides sufficient adhesion to secure the system to the roof. In one embodiment, the lightweight composite roofing support system 10 comprises a composite because it comprises a longitudinally-extending core member 12 made from a core material 14, a selectively attachable and detachable longitudinally-extending base member 150, and a longitudinally-extending roof attachment member 15 disposed on the base member, such as cover layer 16 made from a cover material 18. The core member 12 provides the core of the lightweight composite roofing support system 10 and defines the level core member working surfaces described herein, which are very advantageous on steeply sloped roofs 36. The selectively attachable and detachable longitudinally-extending base member 150 provides a base for the core member 12 and roof attachment member 15 that is removable and replaceable as the roof attachment member becomes worn during use. The selectively attachable and detachable longitudinally-extending base member 150 also provides level base working surfaces that supplement and augment the core working surfaces of the core member 12, making them larger. The roof attachment member 15 is selectively attachable and detachable together with the longitudinally-extending base member 150 and provides the attachment to the surface of the sloped roof 36, and may be removed and replaced as it becomes worn and/or as the attachment requirements change, such as when lightweight composite roofing support system 10 is moved from one type of sloped roof 36 surface (e.g., an asphalt or fiberglass shingle roof) to another type of sloped roof 36 surface (e.g., metal or glass). Referring to the figures, and particularly FIGS. 1-17, in one embodiment, the lightweight composite roofing support system 10 described herein comprising longitudinally-extending core member 12, selectively attachable and detachable longitudinally-extending base member 150, and longitudinally-extending cover layer 16 comprises a length of 24 inches and weighs 75-216 oz., more particularly 80-110 oz., and more particularly 87-97 oz. In another embodiment, the lightweight composite roofing support system 10 described herein comprising longitudinally-extending core member 12, selectively attachable and detachable longitudinally-extending base member 150, and a longitudinally-extending cover layer 16 comprises a length of 32 inches and weighs 100-153 oz., more particularly 107-147 oz., and more particularly 116-129 oz.

Figure 5:
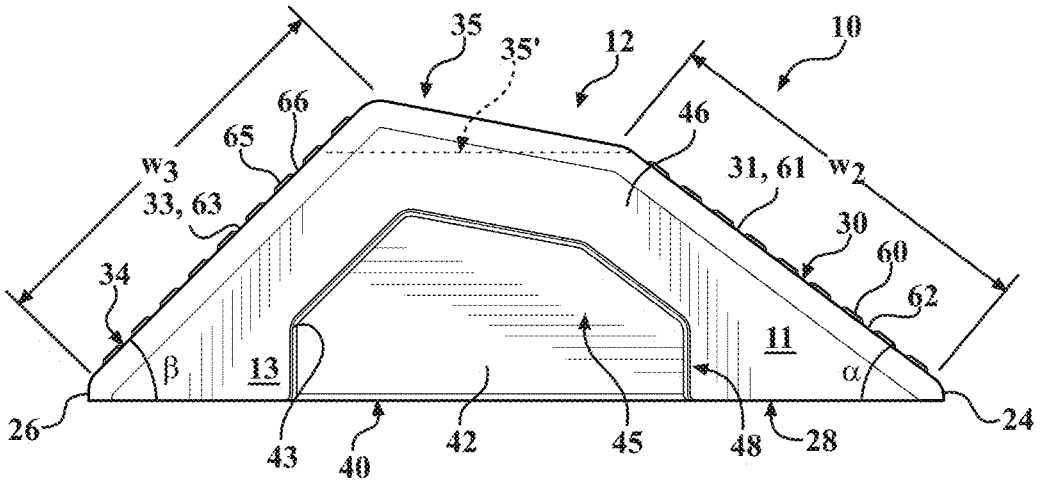
FIG. 5 is a left side view of the roofing support system and roof support of FIG. 1.
Figure 6:
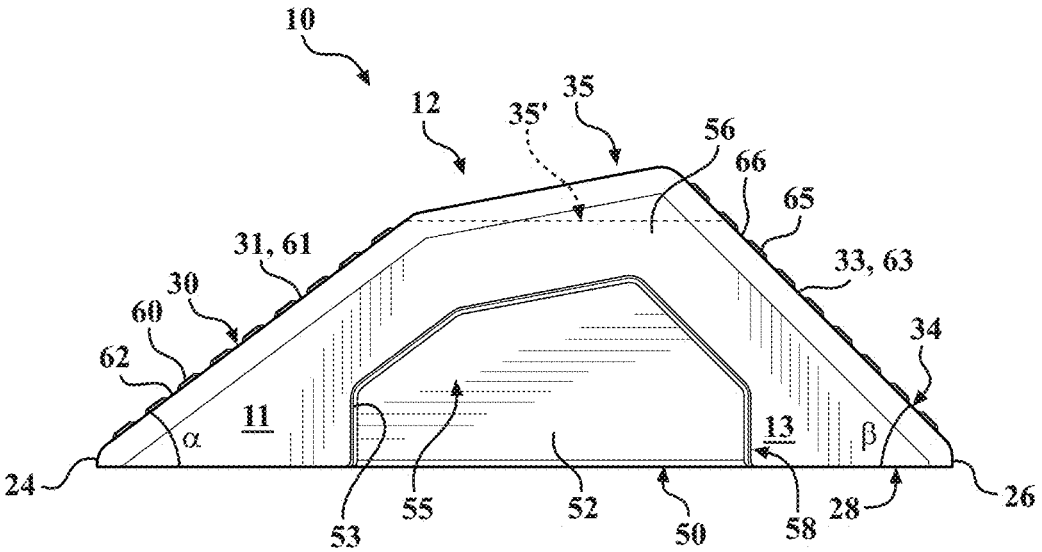
FIG. 6 is a right side view of the roofing support system and roof support of FIG. 1.
Figure 7:
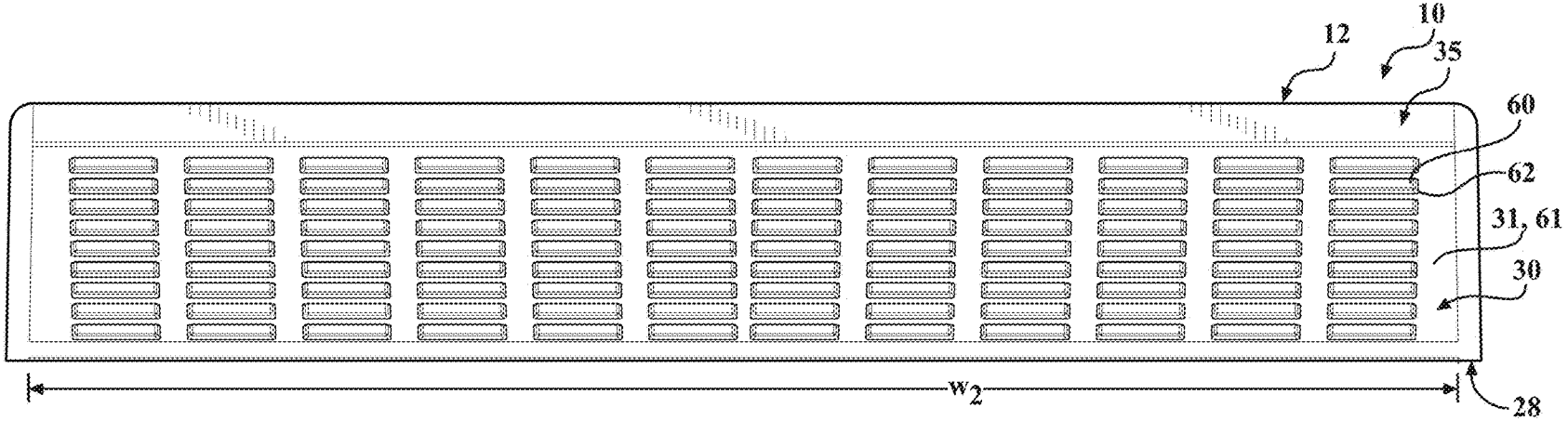
FIG. 7 is a front view of the roofing support system and roof support of FIG. 1.
Figure 8:
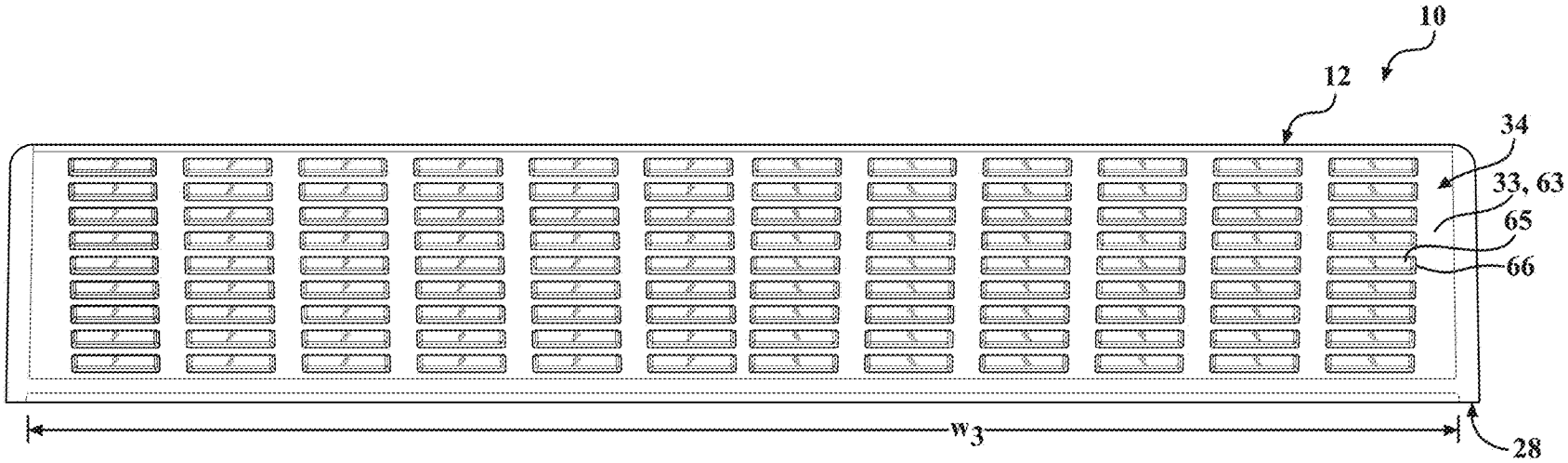
FIG. 8 is a rear view of the roofing support system and roof support of FIG. 1.
Figure 9:
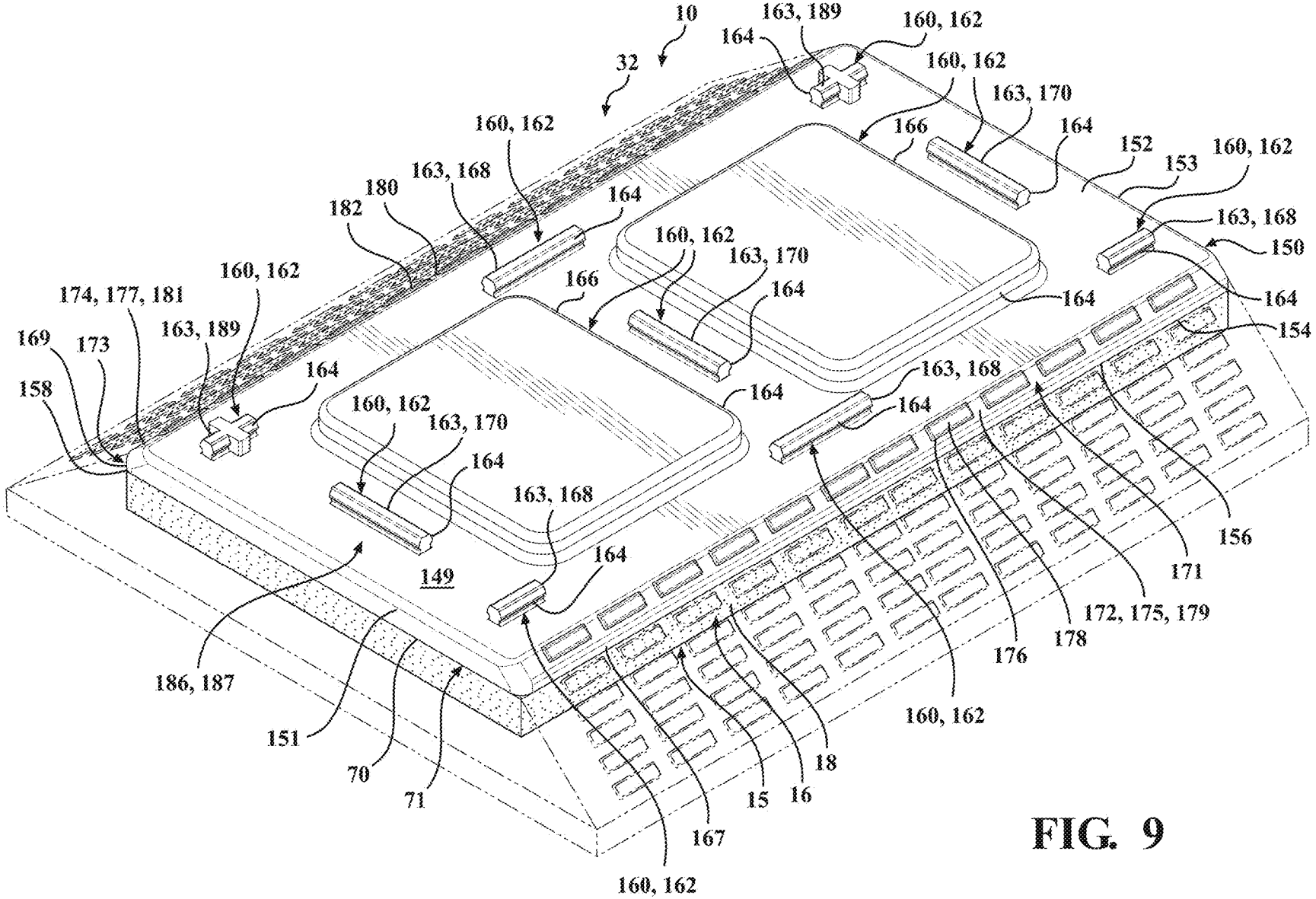
FIG. 9 is a top perspective view of an embodiment of a roofing support system and roof support as disclosed herein illustrating an embodiment of a selectively attachable and detachable base member and roof attachment member comprising a resiliently compressible cover layer, as described herein.
Figure 63A:
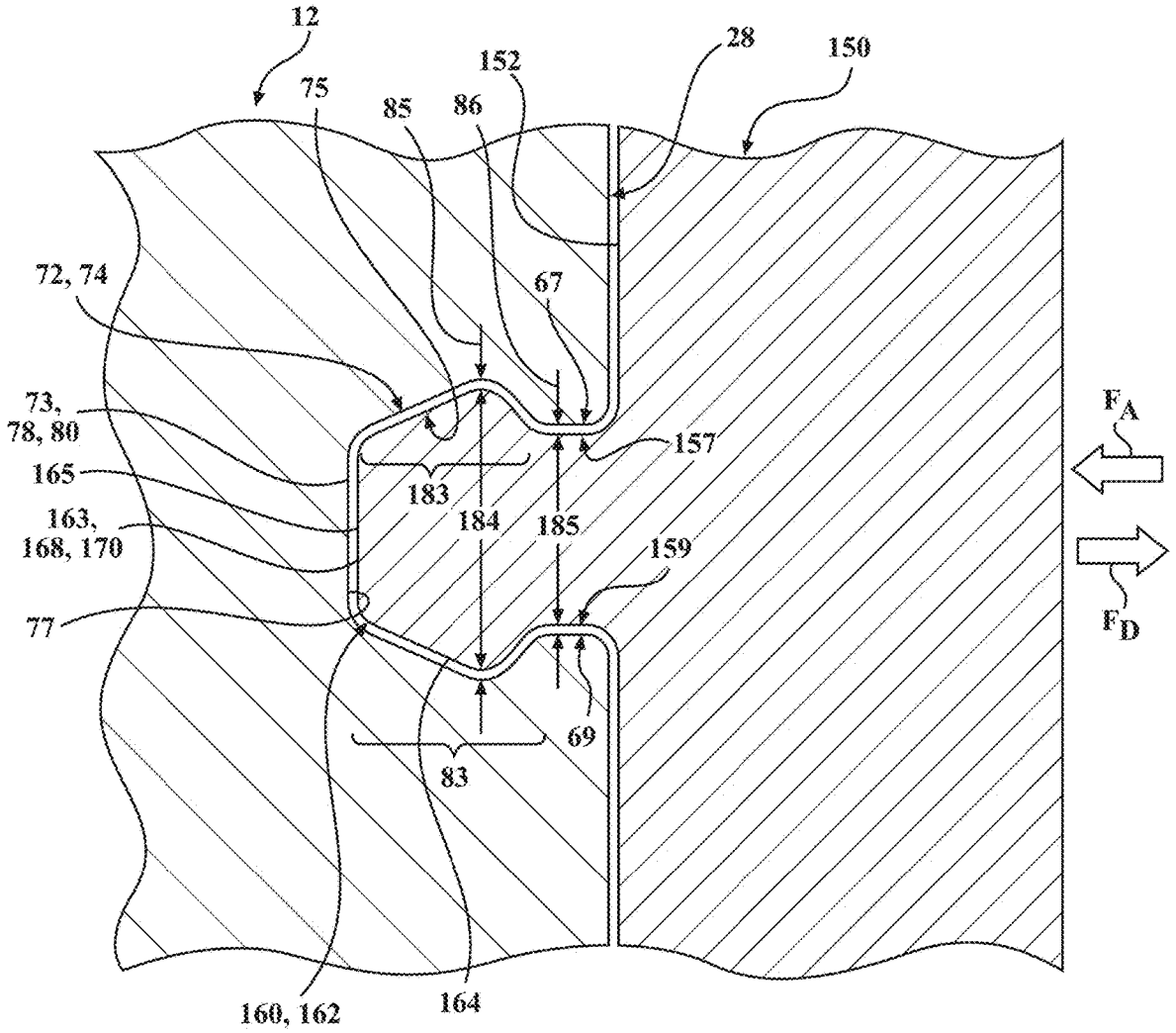
FIG. 63A is a schematic cross-section of an embodiment of a selectively attachable and detachable joint comprising a core recess and base protrusion in an attached condition and position formed by snap-lock insertion of the base protrusion into the core recess as described herein.
Figure 63B:
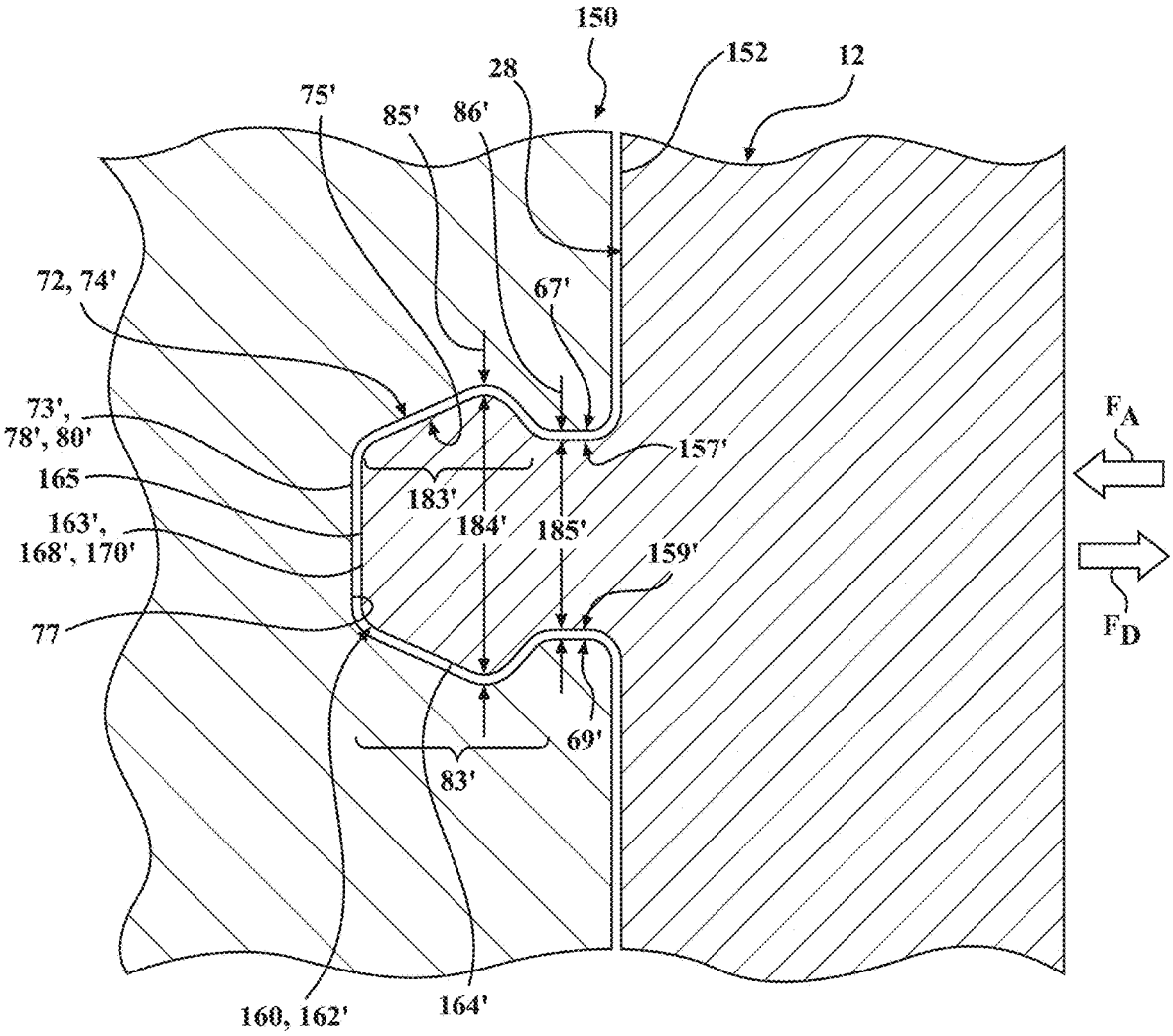
FIG. 63B is a schematic cross-section of an embodiment of a selectively attachable and detachable joint comprising a base recess and core protrusion in an attached condition and position formed by snap-lock insertion of the core protrusion into the base recess as described herein.

As illustrated, for example, in FIGS. 1-63B, in certain embodiments, the lightweight composite roofing support system 10 includes a longitudinally-extending core member 12 comprising a dual or double-wedge lateral cross-section 22 shape, more particularly a reversible, dual or double-wedge cross-section 22 shape having different acute wedge angles ($\alpha$, $\beta$) that comprises two opposed wedges 11, 13 in an opposed dual or double-wedge lateral cross-section 22 shape configuration having different acute wedge angles with the thin edges of the two opposed wedges 11, 13 facing outwardly. The dual or double-wedge lateral cross-section 22 shape may be understood from the end views as shown, for example, in FIGS. 5 and 6. The thin edges of the wedges 11, 13 need not taper to a sharp edge or line as in a traditional wedge, but rather may taper to blunted or rounded edges or shoulders, such as longitudinally-extending first core edge 24 and a longitudinally-extending second core edge 26 as shown in FIGS. 1, 5 and 6, for example. The blunted or rounded edges or shoulders are advantageous because they are damage-resistant and less susceptible to damage during use by chipping or breaking off while being used by roofing workers 6 on a sloped roof 36 in the manner described herein or when being transported or stored off-roof together with other roofing equipment and/or materials as is typical in the roofing industry.

In one embodiment, the longitudinally-extending core member 12 comprises a longitudinally-extending first roof contact side 28 or roof facing side 28. The first roof contact side 28 or roof facing side of the core member is the side of the core member that is oriented to directly or indirectly contact or face the sloped or pitched roof 36 or whatever other surface the lightweight composite roofing support system 10 is to be placed on. While the core member 12 itself is not generally placed in direct contact with the roof surface or other contact surface, although in some configurations it could be, the term first roof contact side 28 or roof facing side refers to the orientation of this side toward or closest to the sloped or pitched roof 36, or whatever other surface the lightweight composite roofing support system 10 is to be placed on. The first roof contact side 28 is configured to receive the longitudinally-extending base member 150 and roof attachment members 15 described herein, such as cover layer 16 made from a cover material 18, that also faces and is in direct contact with the sloped or pitched roof 36. The roof contact side 28 is generally rectangular or rounded rectangular and comprises a longitudinally-extending first core edge 24 and an opposed longitudinally-extending second core edge 26, and in one embodiment, has a first width (w1) and a first length (l1) that is greater than the first width. In one embodiment, the first roof contact side 28 has a generally flat planar shape. In one embodiment, the longitudinally-extending first roof contact side includes a first slot opening 40 comprising a first slot or pocket 41 that is defined by the first inner slot wall 42 and a first recess lip 43 that protrudes inwardly toward the longitudinally axis 9 and extends around the periphery of the first recess 45 that is formed in the first core end 46 of the longitudinally-extending core member 12. The first recess lip 43 may be spaced apart from the first inner slot wall 42 by any suitable spacing (d1), which in one embodiment is 0.5-2.0 inches, more particularly 0.75-1.25 inches. The first recess lip 43 protrudes inwardly from the first slot base 47 and may protrude inwardly any suitable height (h1), which in one embodiment is 0.3-1.0 inches, and more particularly 0.4-0.75 inches, and have any suitable thickness (t1) measured from the first core end 46 and the first outer slot wall 49, which in one embodiment is 0.3-1.0 inches, and more particularly 0.4-0.75 inches. The first slot base 47 also extends around the periphery of the first recess 45. The first slot or pocket 41 and first recess lip 43 define a first handle or grip 48 that may be gripped by a hand of a roofing worker 6, for example, for carrying or movement of the roof support 32. In one embodiment, the longitudinally-extending first roof contact side includes an opposed second slot opening 50 proximate the opposed second core end 56 that may comprise a mirror image of the first slot opening 40. The opposed second slot opening 50 comprising a second slot or pocket 51 that is defined by the second inner slot wall 52 and a second recess lip 53 that protrudes inwardly toward the longitudinally axis 9 and extends around the periphery of the second grip recess 55 that is formed in the second core end 56 of the longitudinally-extending core member 12. The second recess lip 53 and second outer slot wall 59 may be spaced apart from the second inner slot wall 52 by any suitable spacing (d2), which in one embodiment is 0.5-2.0 inches, more particularly 0.75-1.25 inches. The second recess lip 53 protrudes inwardly from the second slot base 57 and may protrude inwardly any suitable height (h2), which in one embodiment is 0.3-1.0 inches, and more particularly 0.4-0.75 inches, and have any suitable thickness (t2) measured from the second core end 56 and the second outer slot wall 59, which in one embodiment is 0.3-1.0 inches, and more particularly 0.4-0.75 inches. The second slot base 57 also extends around the periphery of the second handle or grip recess 55. The second slot or pocket 51 and second recess lip 53 define a second handle or grip 58 that may be gripped by the hand of a roofing worker 6, for example, for carrying or movement of the roof support 32. The first handle or grip 48 and second handle or grip 58 are very advantageous because they allow the lightweight composite roofing support system 10 and roof support 32, and particularly core member 12, when the system is resting on the roofing attachment member 15, such as cover layer 16, to be securely grasped by a roofing worker 6 with one hand. This is accomplished by placing the palm side of his/her thumb resting on one or more of the second side 30, third side 34 or fourth side 35 with the palm of the hand wrapped around the respective first or second recess lip 43, 53 and the palm side of one or more fingers, including all fingers, inserted into the respective first or second slot or pocket 41, 51. By flexion or closing of the hand, the opposite sides of the fingers and knuckles rest against the respective first or second inner slot wall 42, 52 providing a secure grip of the roofing support 32. This allows the roofing support 32 to be lifted with one hand and carried on a job site, including carrying the support up a ladder to the sloped roof 36, or across the sloped roof to a new location. It also allows the roofing support 32 to be easily manipulated with one hand to another portion of the roof or into another horizontal, vertical, or other position by movement of the wrist, forearm, elbow, or shoulders, or a combination thereof. For example, while being carried with the bottom side of the cover layer 16 vertical, the roofing support 32 can be manipulated by movement of the wrist or elbow so that the bottom side of the cover layer is horizontal. It also allows the roofing support 32 to be easily thrown or tossed to another location on a sloped roof 36, for example.

Referring to FIGS. 1-63B, the core member 12 and longitudinally-extending first roof contact side 28 also comprises a base attachment structure 72 configured for selective attachment to and detachment from a mating core attachment structure 160 of the longitudinally-extending base member 150 as described herein. The base attachment structure 72 may comprise any structure or structural form or device or fastener mechanism or combination of fastener mechanisms configured to provide the selective attachment to and detachment of core member to the core attachment structure 160 of the longitudinally-extending base member 150 including the roof attachment member 15 disposed thereon, and vice versa. In one embodiment, the base attachment structure 72 comprises a plurality of core recesses 74 (FIG. 63A) or core protrusions 162' (FIG. 63B), or a combination thereof, that is configured to receive a corresponding core attachment structure 160 that comprises a plurality of base protrusions 162 (FIG. 63A) or base recesses 74' (FIG. 63B), or a combination thereof. In the case of core protrusions 162' the core protrusions may have all of the elements and features of the base protrusions 162 described herein and may be described and so designated herein by changing the reference to the element or feature description from "base" to "core" and the addition of a "'" symbol to the base protrusion 162 element or feature as illustrated in FIG. 63B. Similarly, in the case of base recesses 74', the base recesses may have all of the elements and features of the core recesses 74 described herein and may be described and so designated herein by changing the reference to the element or feature description from "core" to "base" and the addition of a "'" symbol to the core recess 74 element or feature as illustrated in FIG. 63B. The core recesses 74 are recessed within first roof contact side 28 and comprises a core recess sidewall 75 and recess bottom 77. The core recesses 74 may be disposed on the core member 12 in any suitable number and arrangement to provide for the selective attachment and detachment of the longitudinally-extending base member 150 and roof attachment member 15 disposed thereon, including their size, shape (e.g., slot, pad, or the like) orientation (e.g., longitudinal, lateral, or otherwise), location (e.g., peripheral, central), core recess sidewall 75 features (e.g., barbed, interlocking, non-interlocking, interference fit, slip fit, and the like), and function (e.g., as retention, load-bearing, or a combination thereof). In one embodiment, the plurality of core recesses 74 comprise a plurality of load-bearing or area or structural core recesses 76 and a plurality of retention core recesses 73 comprising longitudinally extending core recesses 78 and laterally-extending retention core recesses 80. The core recesses 74, comprising load-bearing core recesses 76 and retention core recesses 73 that comprise longitudinally extending retention core recesses 78 and laterally-extending retention core recesses 80, may be disposed on the core member and first roof contact side 28 in any suitable number of each type of recess and in any suitable combination, pattern or arrangement of the various types. In one embodiment, the load-bearing core recesses 76 comprises two recesses that are disposed centrally in first roof contact side 28 in a longitudinally-extending, spaced apart array. As shown in FIGS. 1-8, the retention core recesses 73, which comprise longitudinally-extending retention core recesses 78 and laterally-extending retention core recesses 80, are disposed peripherally about the load-bearing core recesses 76 with the longitudinally-extending retention core recesses 78 disposed along the opposed longitudinally-extending edges of the load-bearing core recesses 76 and the laterally-extending retention core recesses 80 disposed along the opposed lateral-extending edges of the load-bearing core recesses 76 as well as across the central portion of first roof contact side 28. The longitudinally-extending retention core recesses 78 and laterally-extending retention core recesses 80 may also be described as being disposed peripherally about the first roof contact side 28. The longitudinally-extending retention core recesses 78 are disposed along the longitudinally-extending first core edge 24 and opposed longitudinally-extending second core edge 26. The laterally-extending retention core recesses 80 are disposed proximate the laterally-extending first core end 46 and opposed laterally-extending second core end 56 and also include one or more centrally disposed laterally-extending retention core recess 80 disposed between the load-bearing core recesses 76. In one embodiment, three spaced apart longitudinally-extending retention core recesses 78 extend along proximate the longitudinally-extending first core edge 24 and three spaced apart longitudinally-extending retention core recesses 78 extend along proximate the longitudinally-extending second core edge 26. In this embodiment, one centrally disposed laterally-extending retention core recess 80 extends along proximate the laterally-extending first core end 46 and one centrally disposed laterally-extending retention core recess 80 extends along proximate the laterally-extending second core end 56 and one centrally disposed laterally-extending retention core recess 80 extends laterally between the load-bearing core recesses 76.

Figure 17:
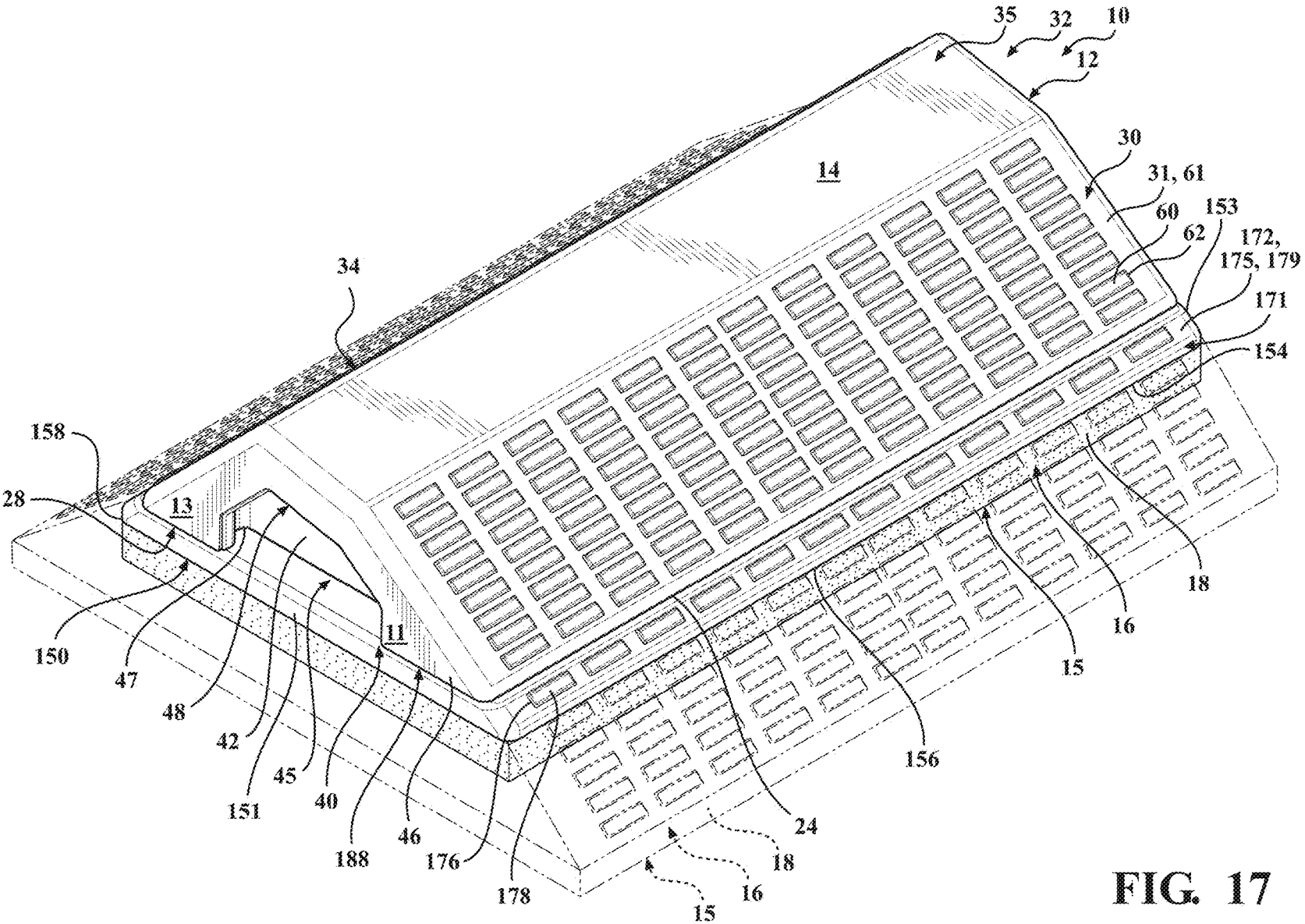
FIG. 17 is a top perspective view of the embodiment of FIG. 16 with the selectively attachable and detachable base member and roof attachment member in a selectively attached position and condition.
Figure 18:
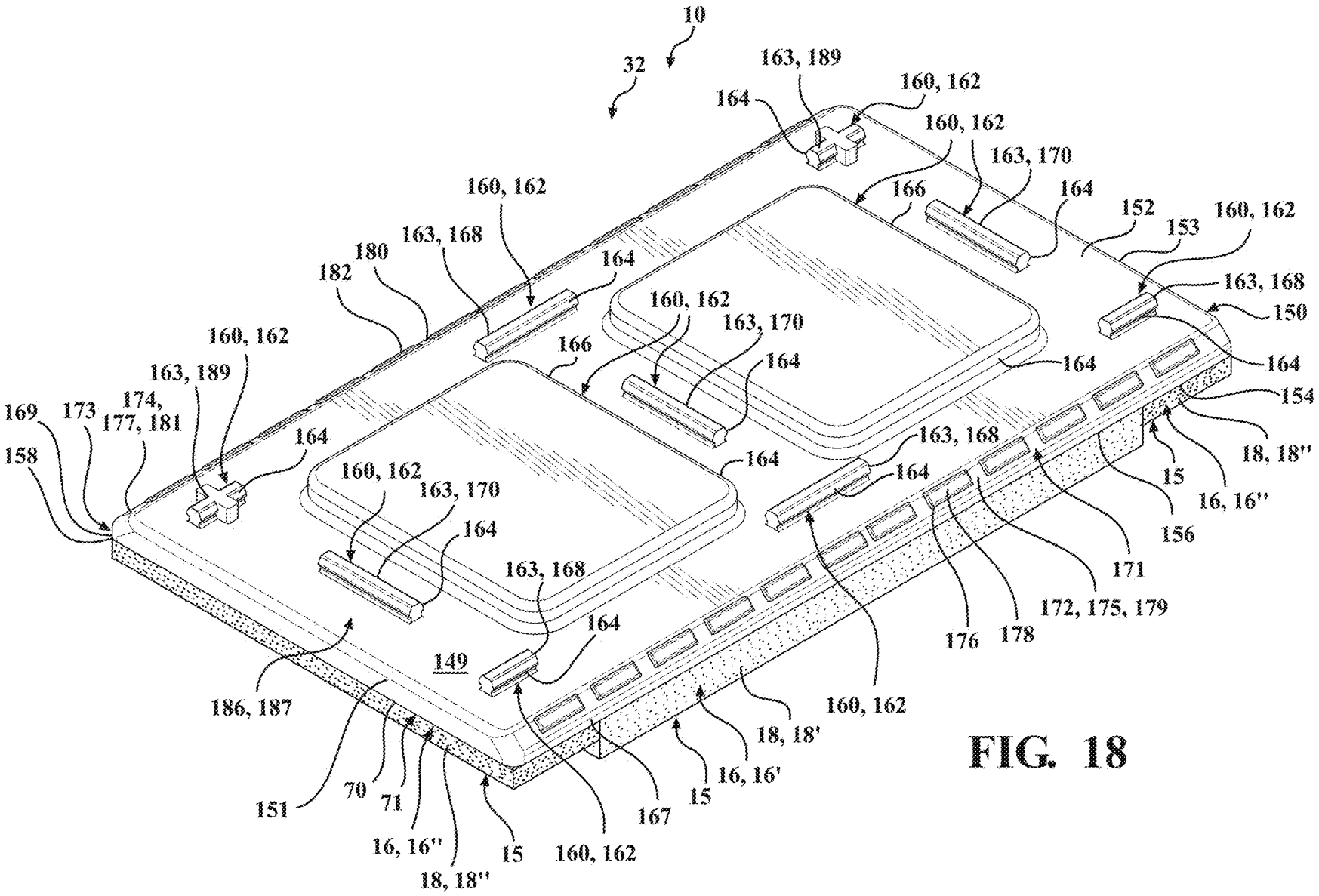
FIG. 18 is a top perspective view of an embodiment of a roofing support system and roof support as disclosed herein illustrating an embodiment of a base member and roof attachment member comprising a plurality of resiliently compressible cover layers, as described herein.
Figure 19:
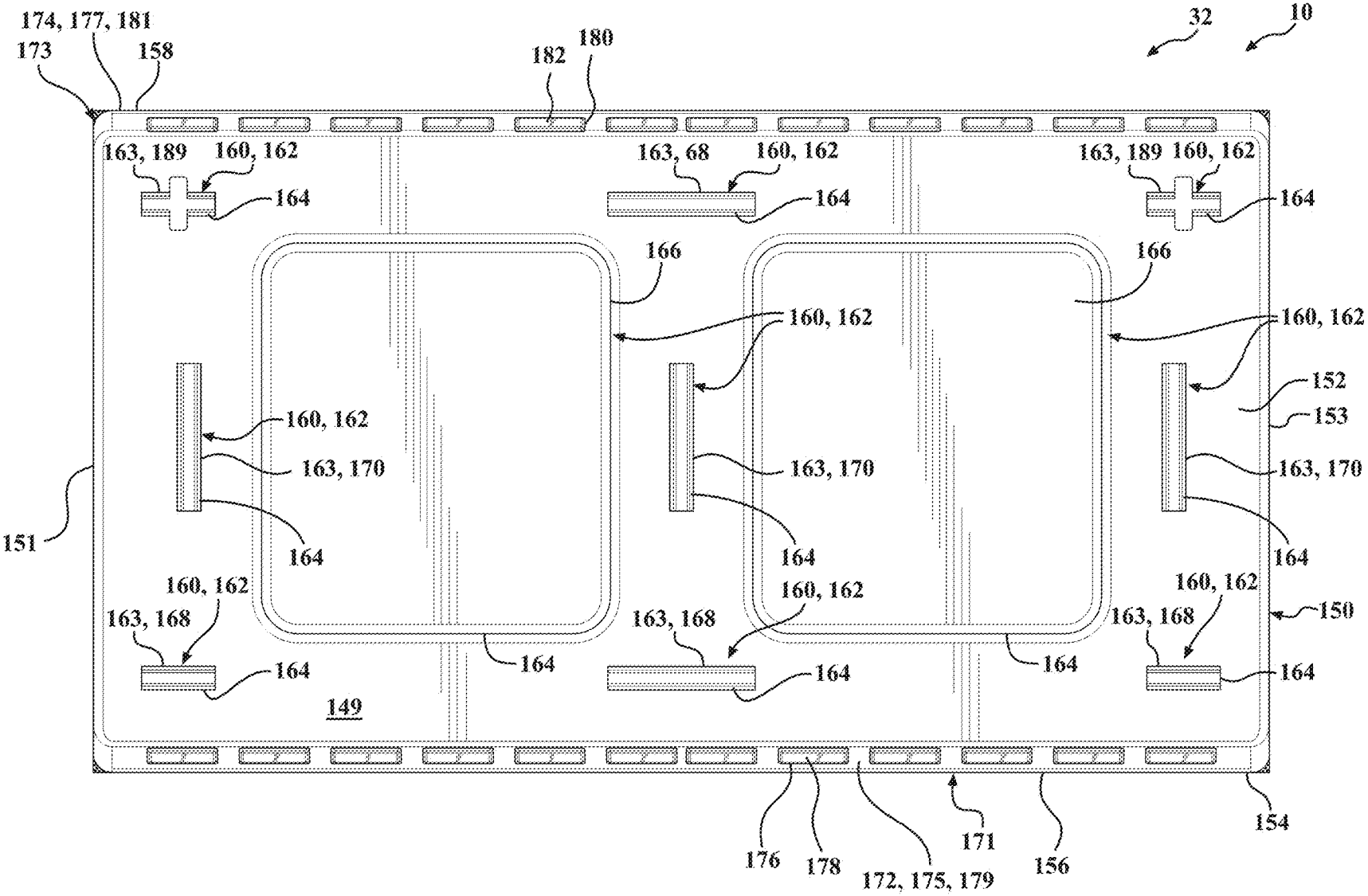
FIG. 19 is a top view of the roofing support system and roof support of FIG. 18.
Figure 20:
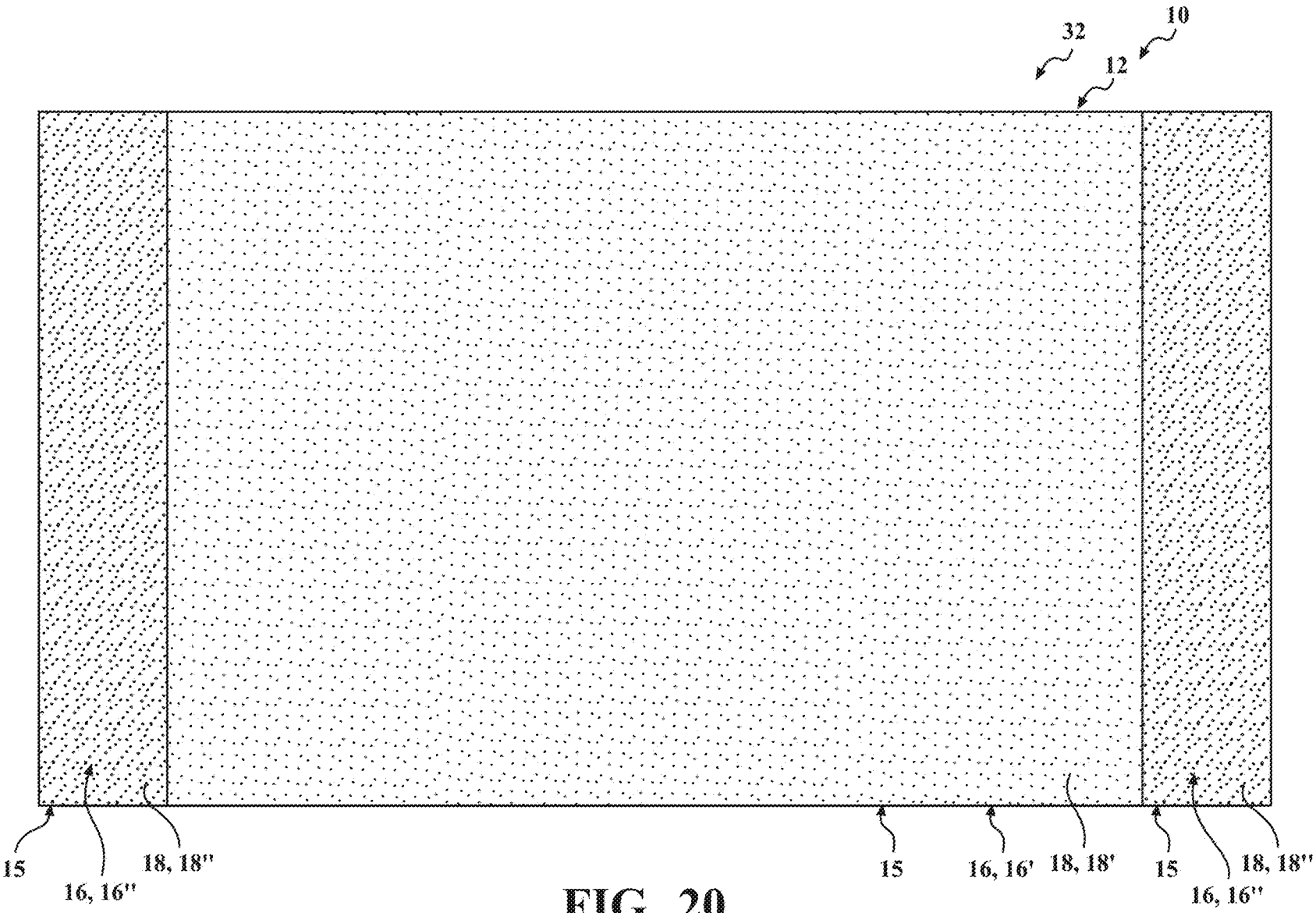
FIG. 20 is a bottom view of the roofing support system and roof support of FIG. 18.
Figure 21:
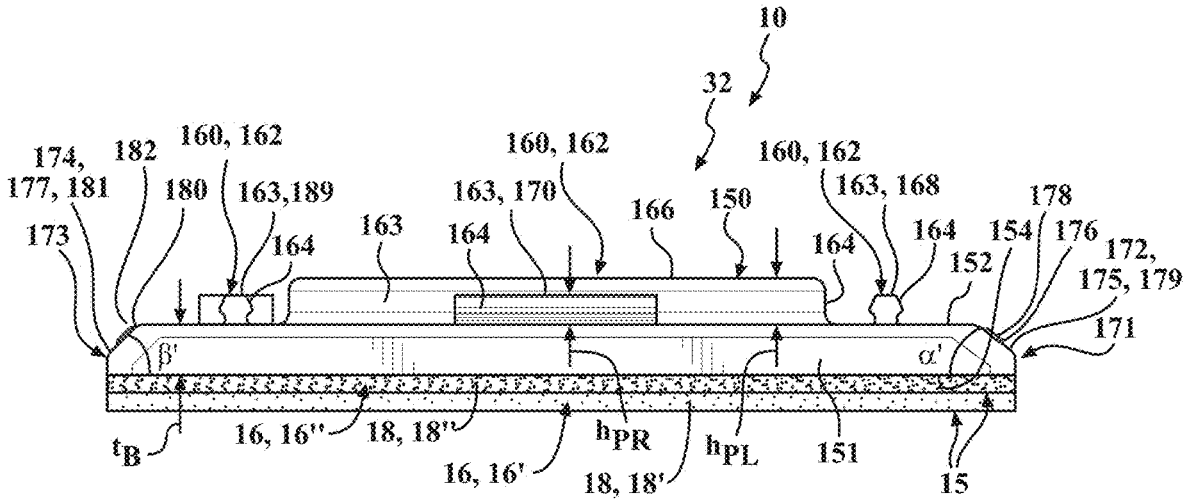
FIG. 21 is a left side view of the roofing support system and roof support of FIG. 18.
Figure 22:
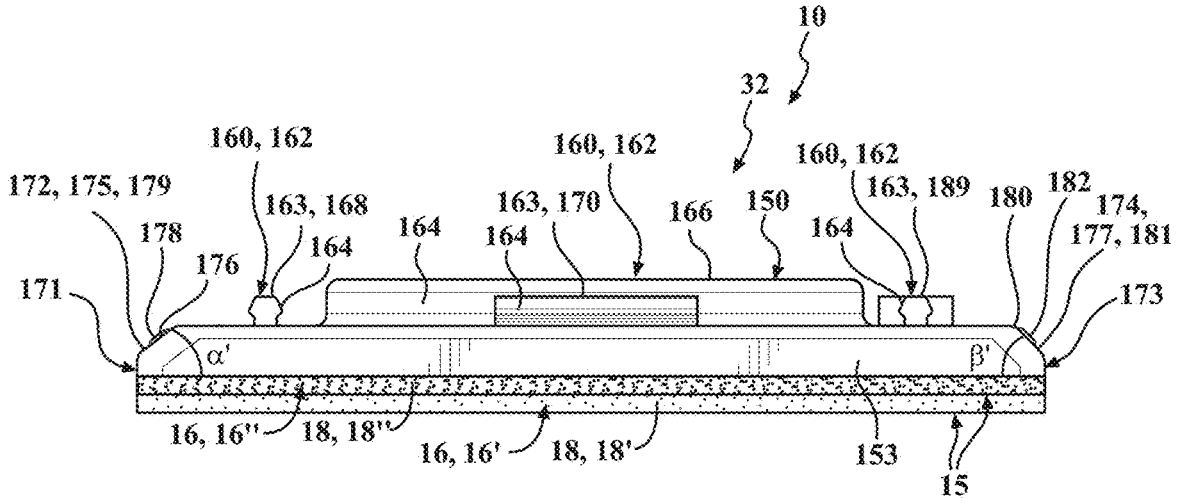
FIG. 22 is a right side view of the roofing support system and roof support of FIG. 18.
Figure 23:
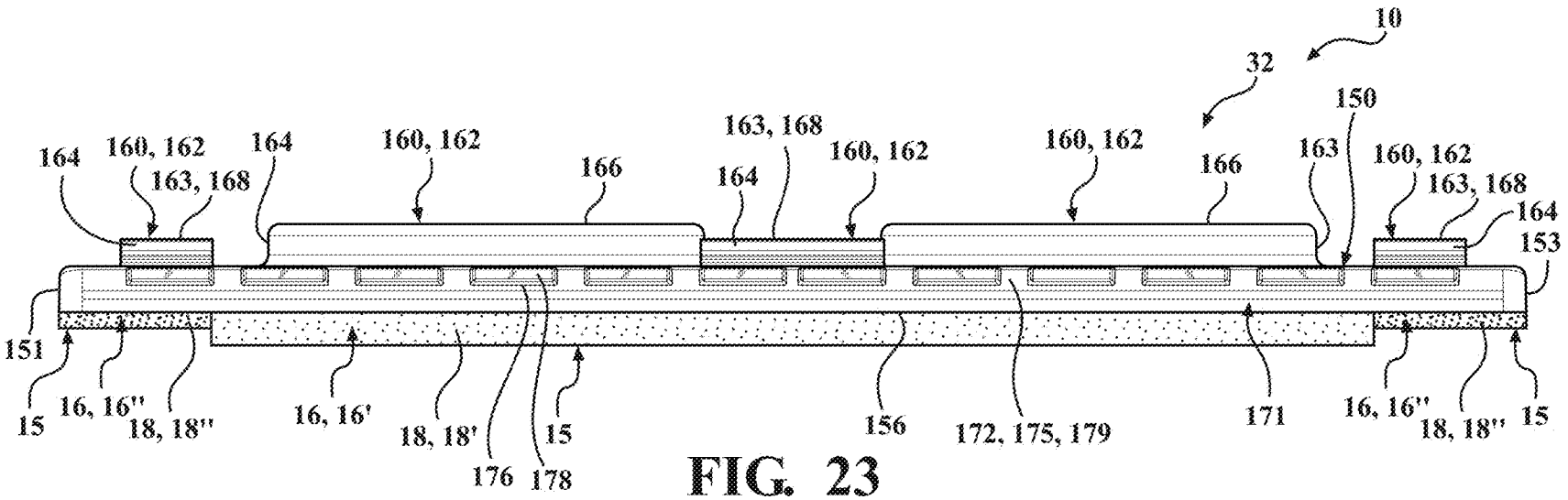
FIG. 23 is a front view of the roofing support system and roof support of FIG. 18.
Figure 24:
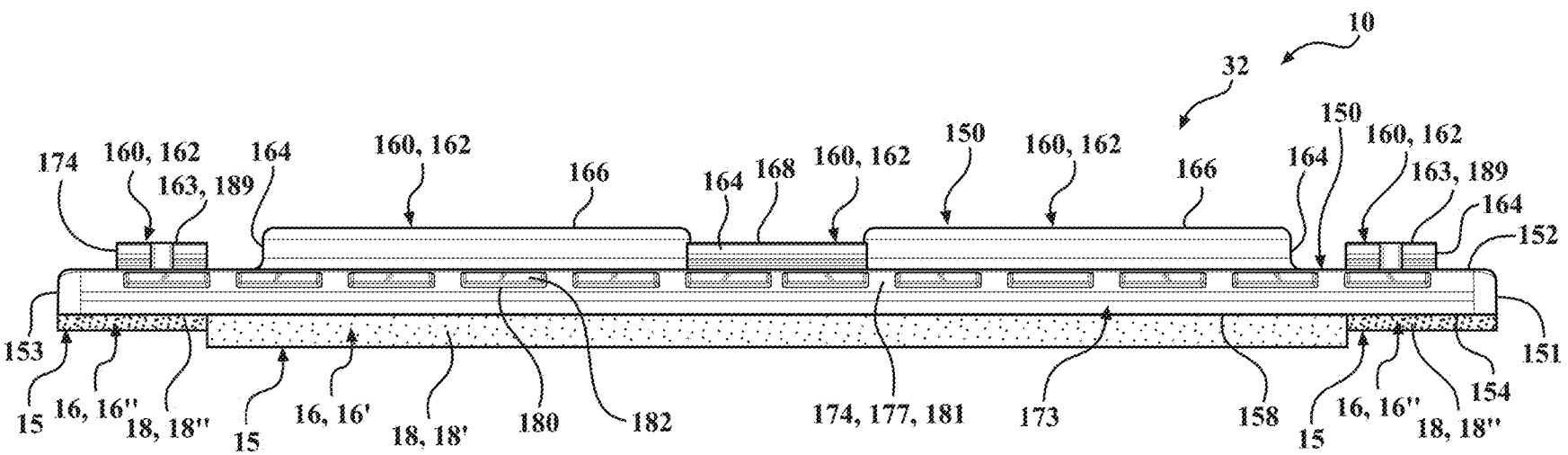
FIG. 24 is a rear view of the roofing support system and roof support of FIG. 18.
Figure 25:
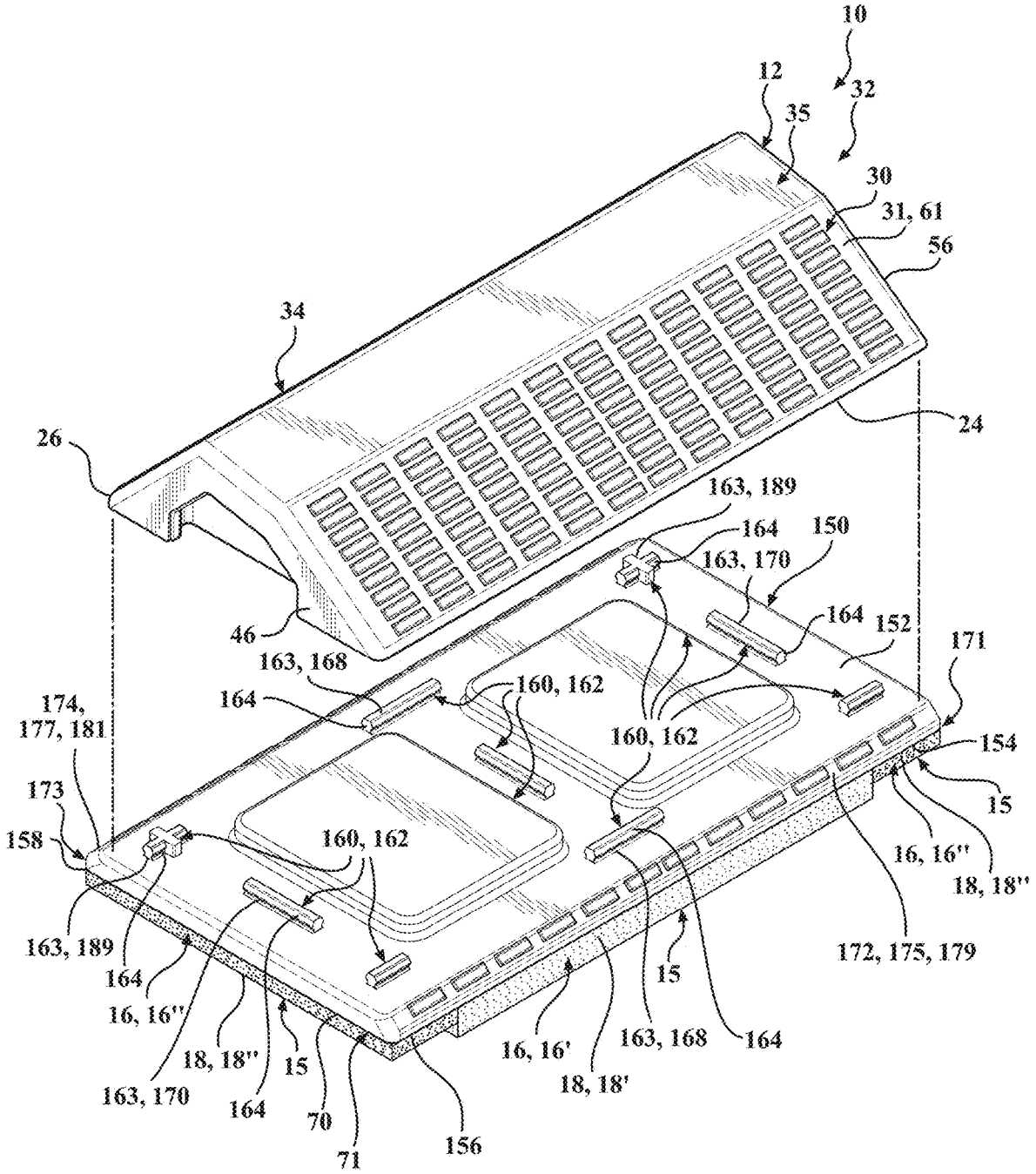
FIG. 25 is an exploded top perspective view of an embodiment of a roofing support system and roof support as disclosed herein comprising a core member and the selectively attachable and detachable base member and roof attachment member of FIG. 18 in a selectively detached position and condition.
Figure 26:
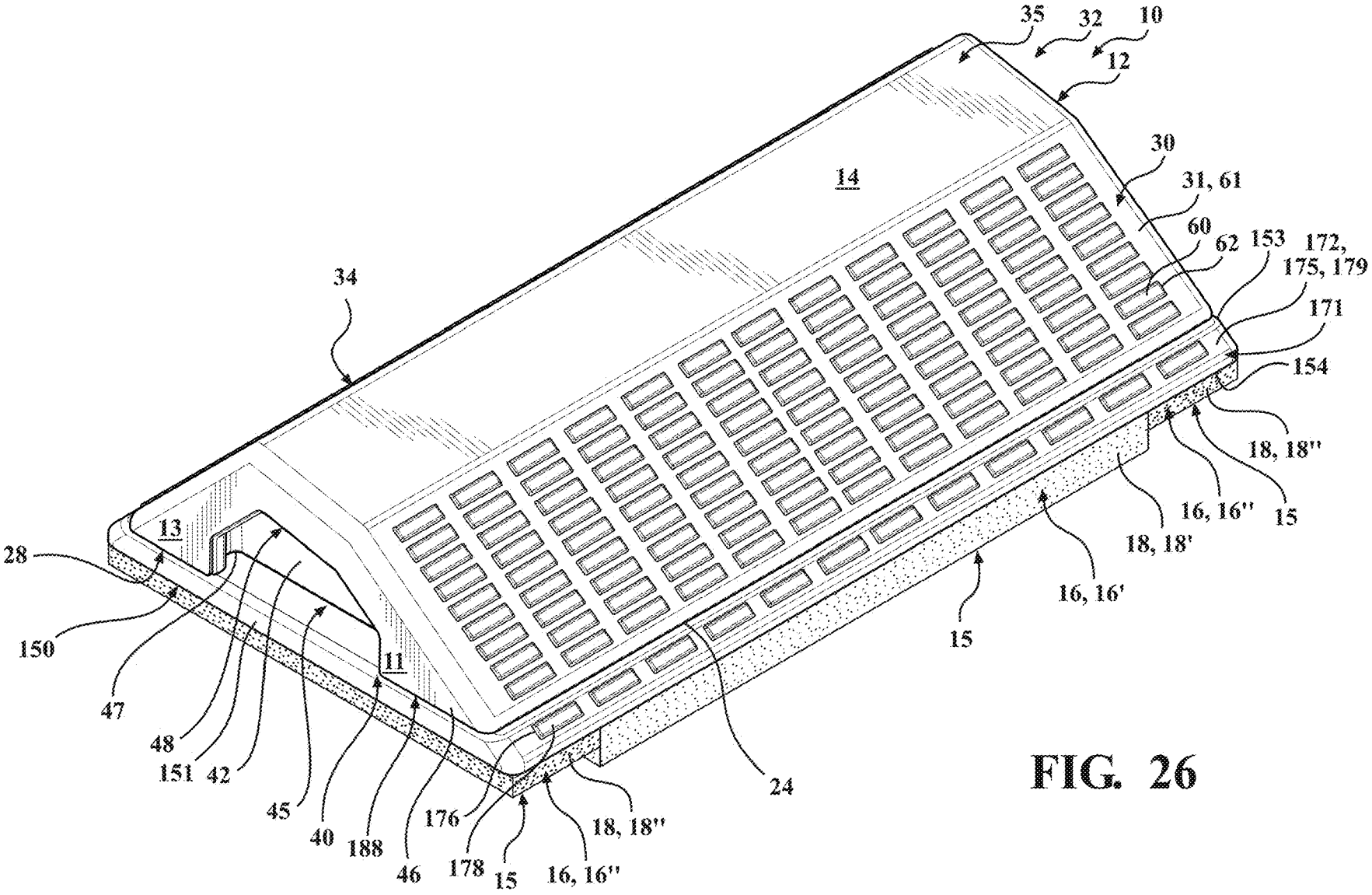
FIG. 26 is a top perspective view of the embodiment of FIG. 25 with the selectively attachable and detachable base member and roof attachment member in a selectively attached position and condition.
Figure 27:
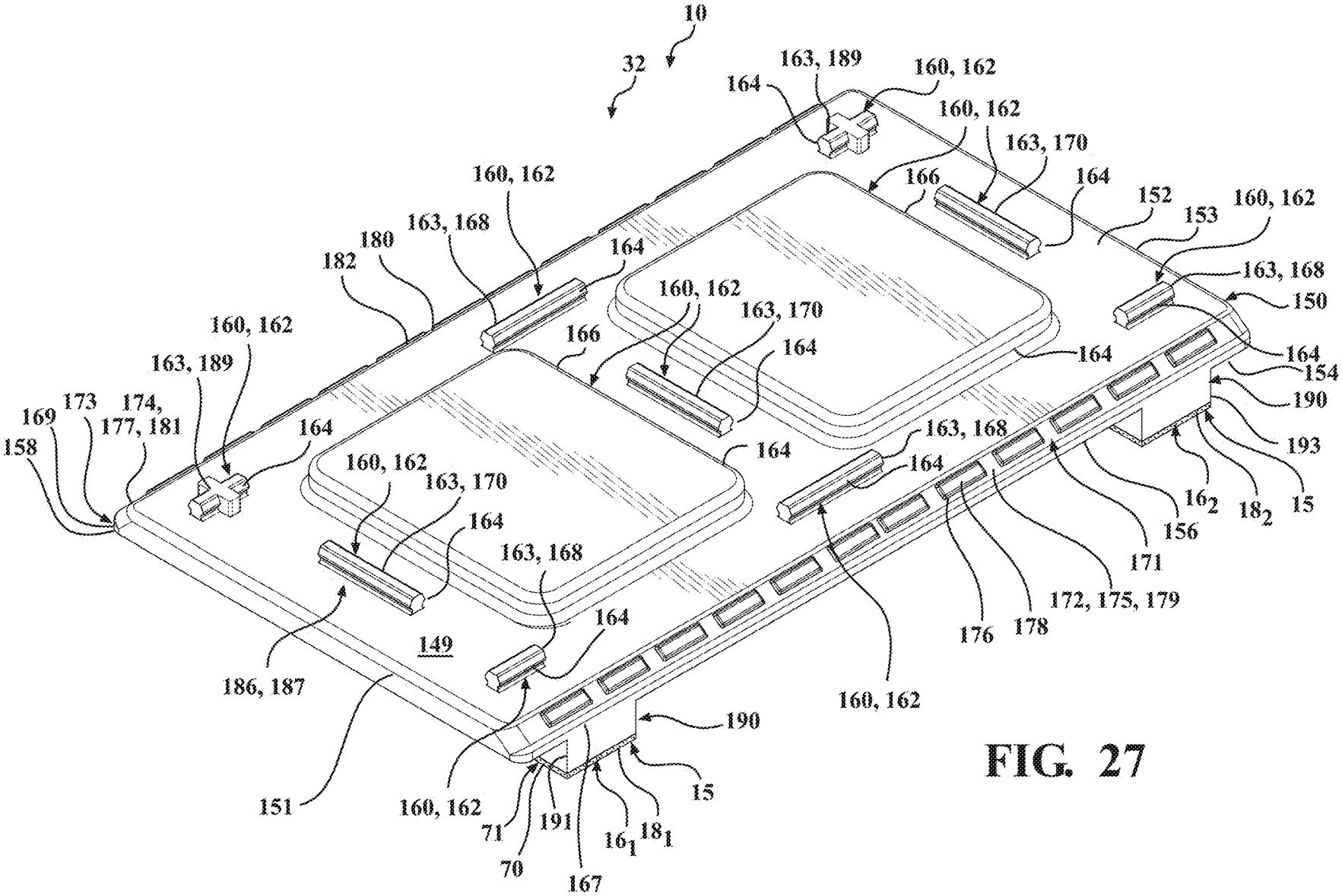
FIG. 27 is a top perspective view of an embodiment of a roofing support system and roof support as disclosed herein comprising a base member and a roof attachment member comprising a plurality of laterally-extending rails disposed inwardly of the base ends that each comprise a permanent magnet and a resiliently compressible cover layer, as described herein.
Figure 28:
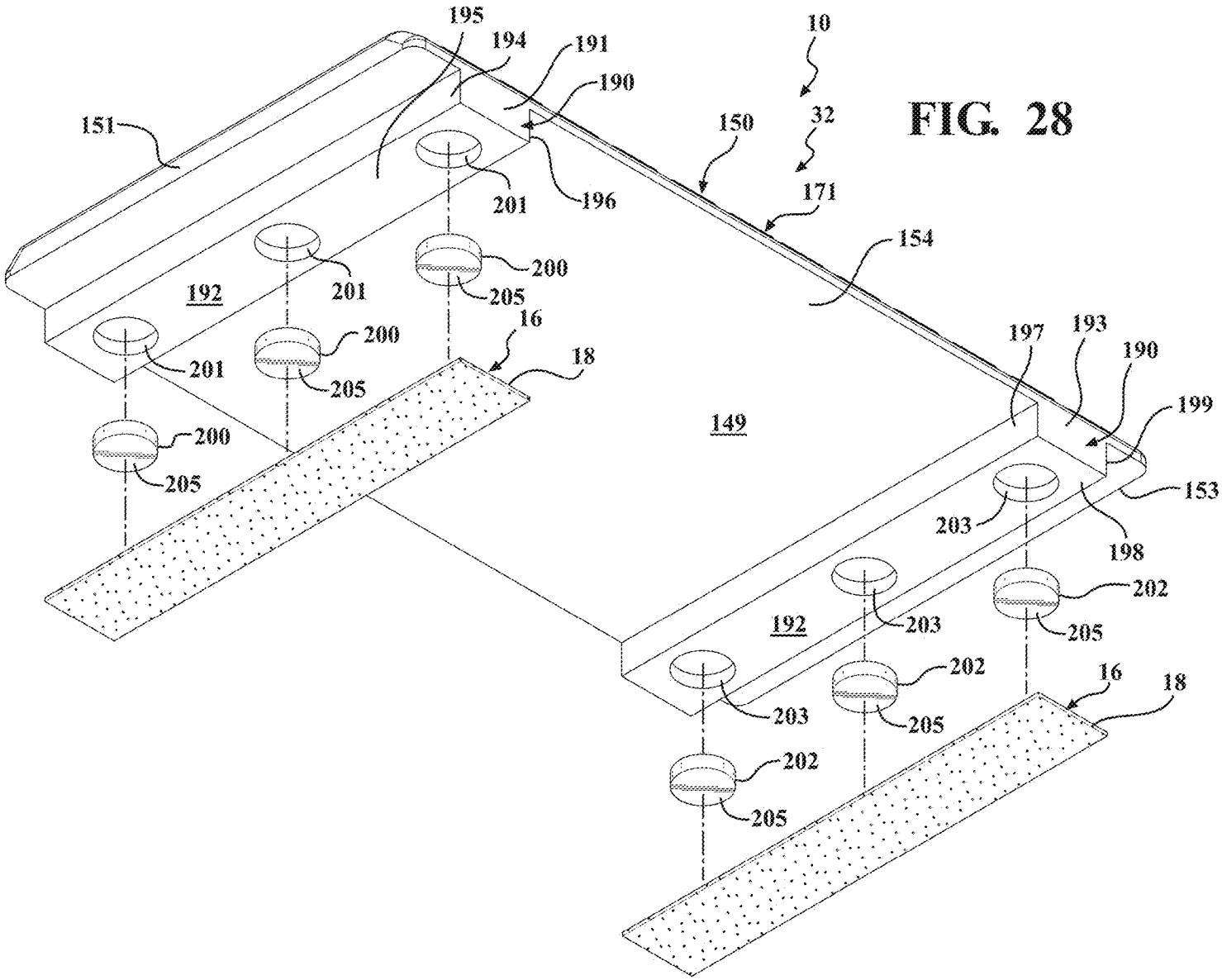
FIG. 28 is an exploded bottom perspective view of the roofing support system and roof support of FIG. 27.
Figure 29:
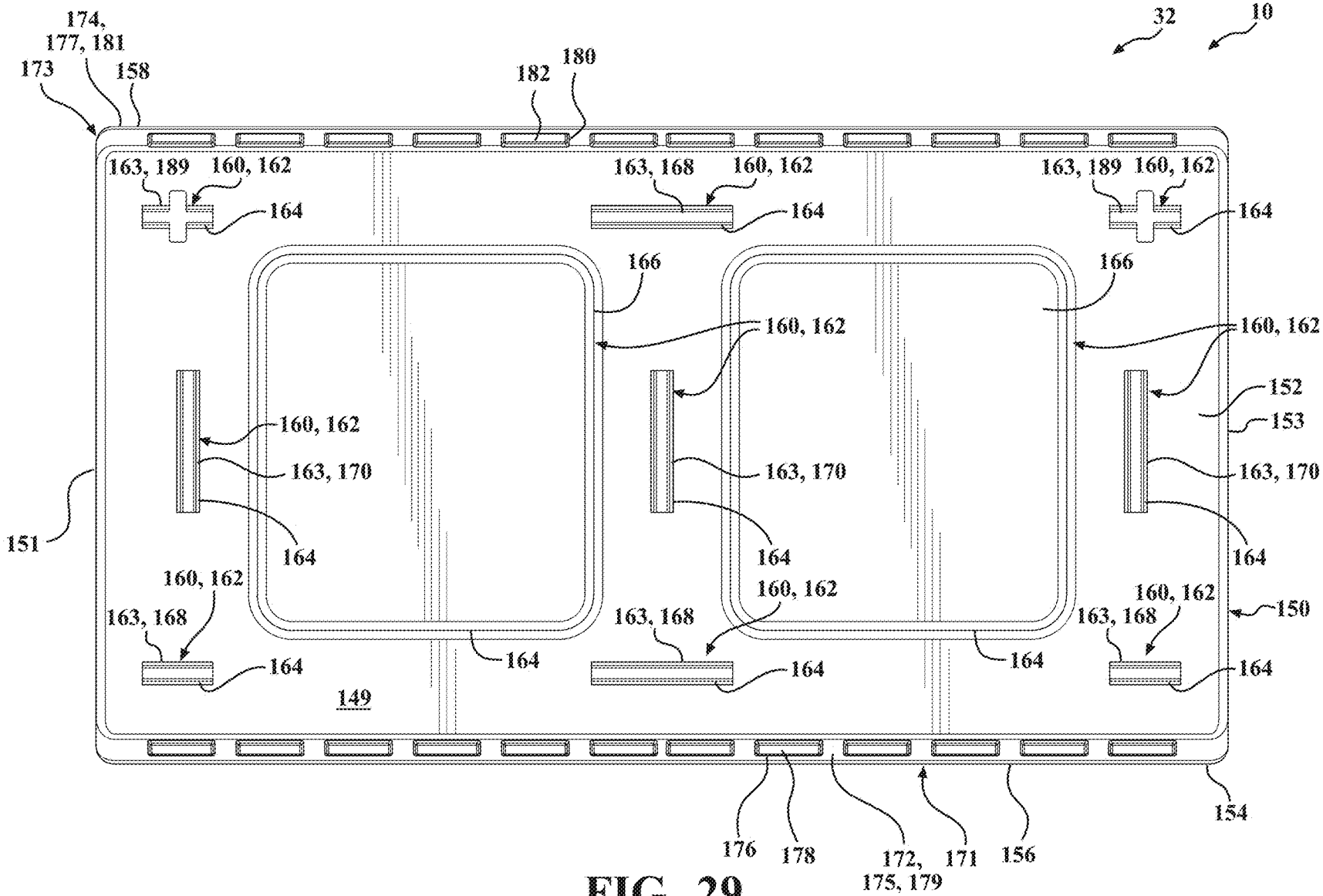
FIG. 29 is a top view of the roofing support system and roof support of FIG. 27.
Figure 30:
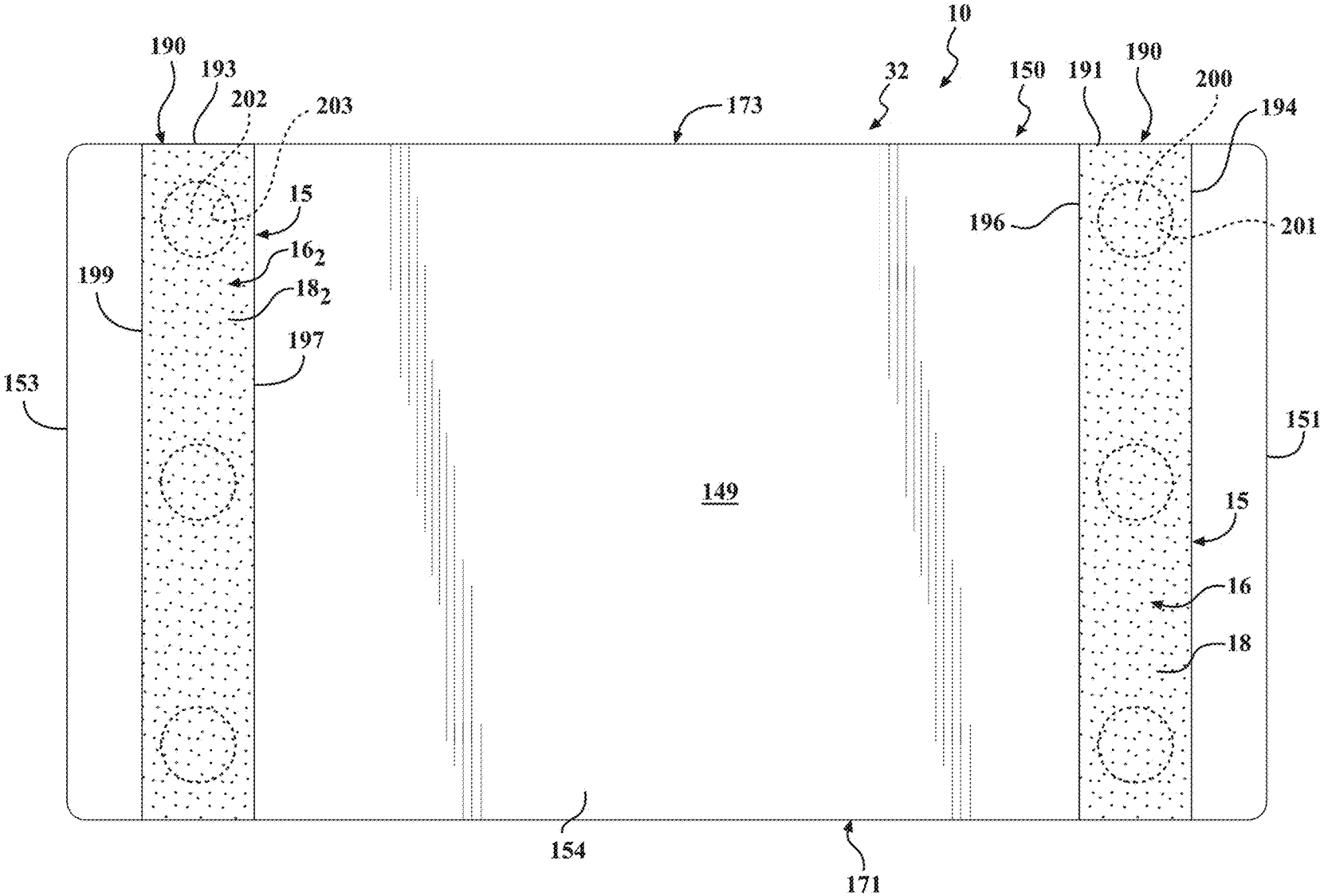
FIG. 30 is a bottom view of the roofing support system and roof support of FIG. 27.
Figure 31:
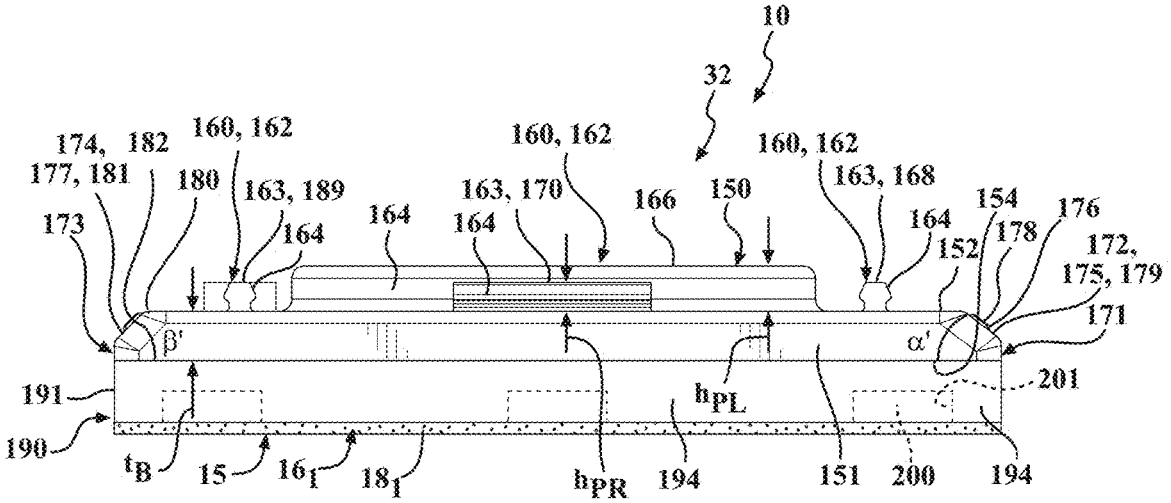
FIG. 31 is a left side view of the roofing support system and roof support of FIG. 27.
Figure 32:
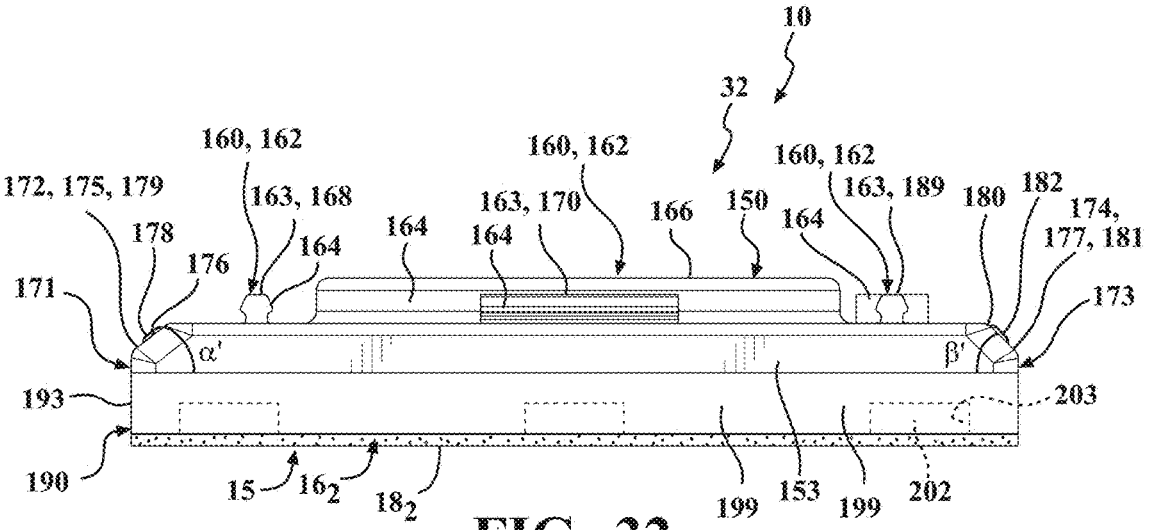
FIG. 32 is a right side view of the roofing support system and roof support of FIG. 27.
Figure 33:
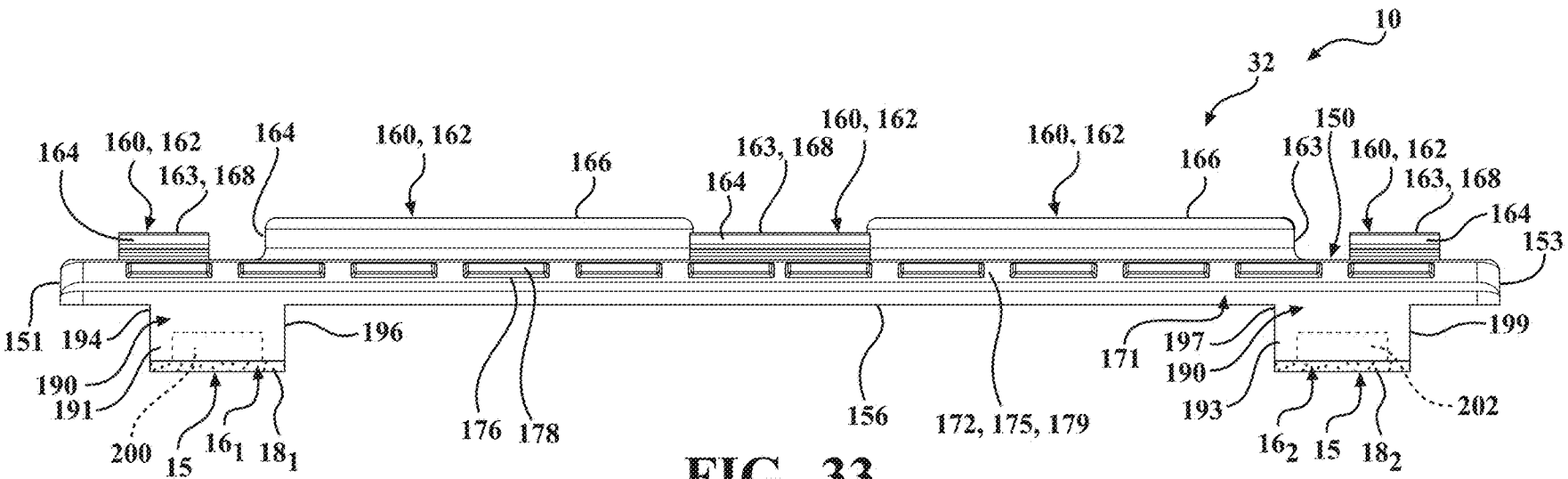
FIG. 33 is a front view of the roofing support system and roof support of FIG. 27.
Figure 34:
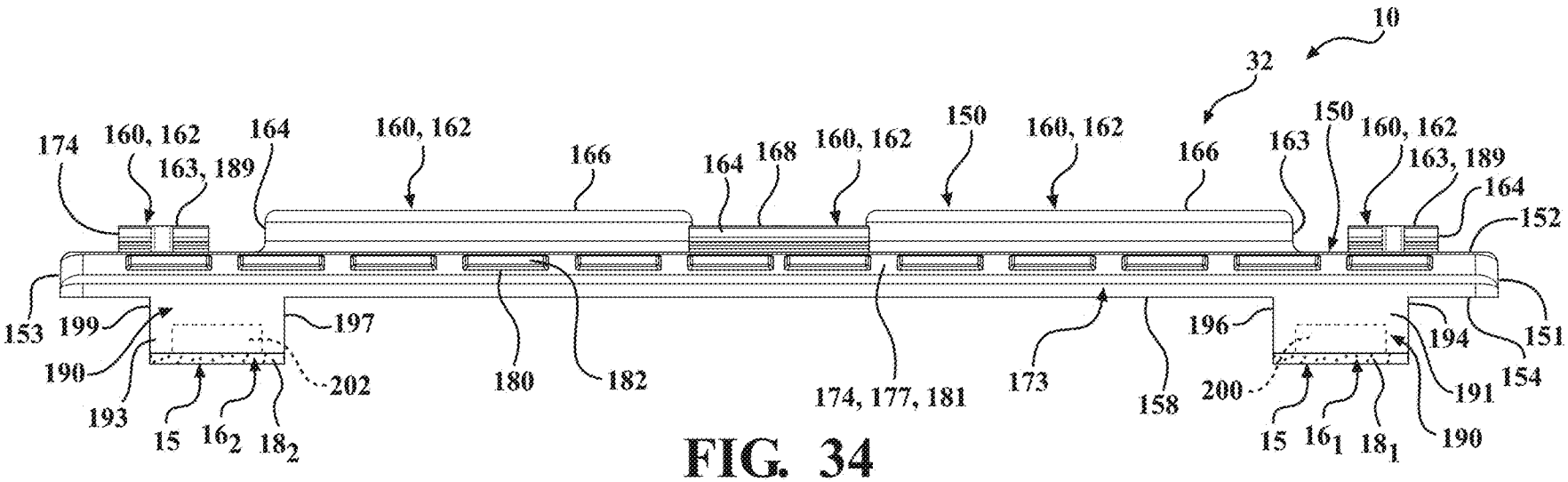
FIG. 34 is a rear view of the roofing support system and roof support of FIG. 27.
Figure 35:
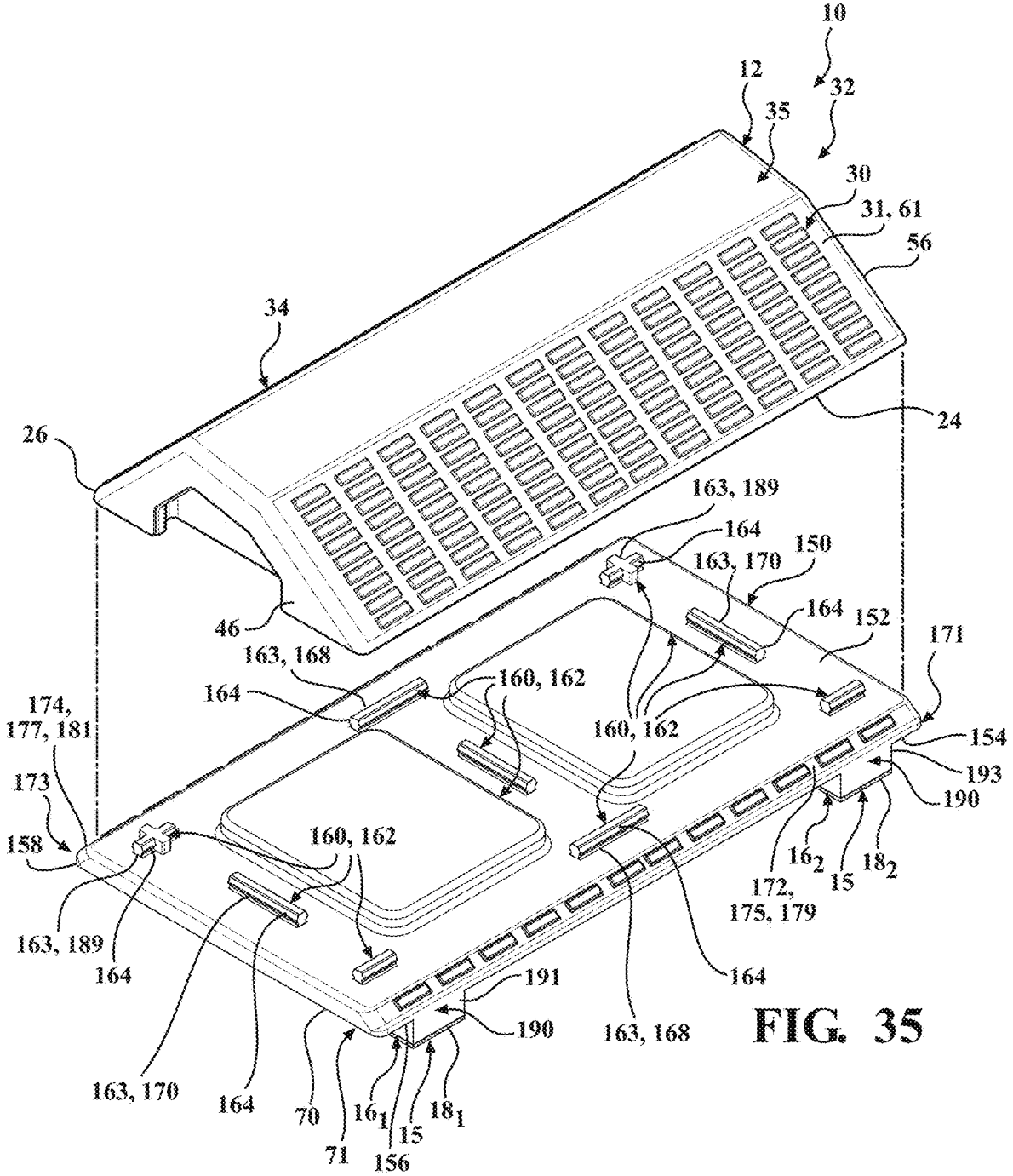
FIG. 35 is an exploded top perspective view of an embodiment of a roofing support system and roof support as disclosed herein comprising a core member and the selectively attachable and detachable base member and roof attachment member of FIG. 27 in a selectively detached position and condition.
Figure 36:
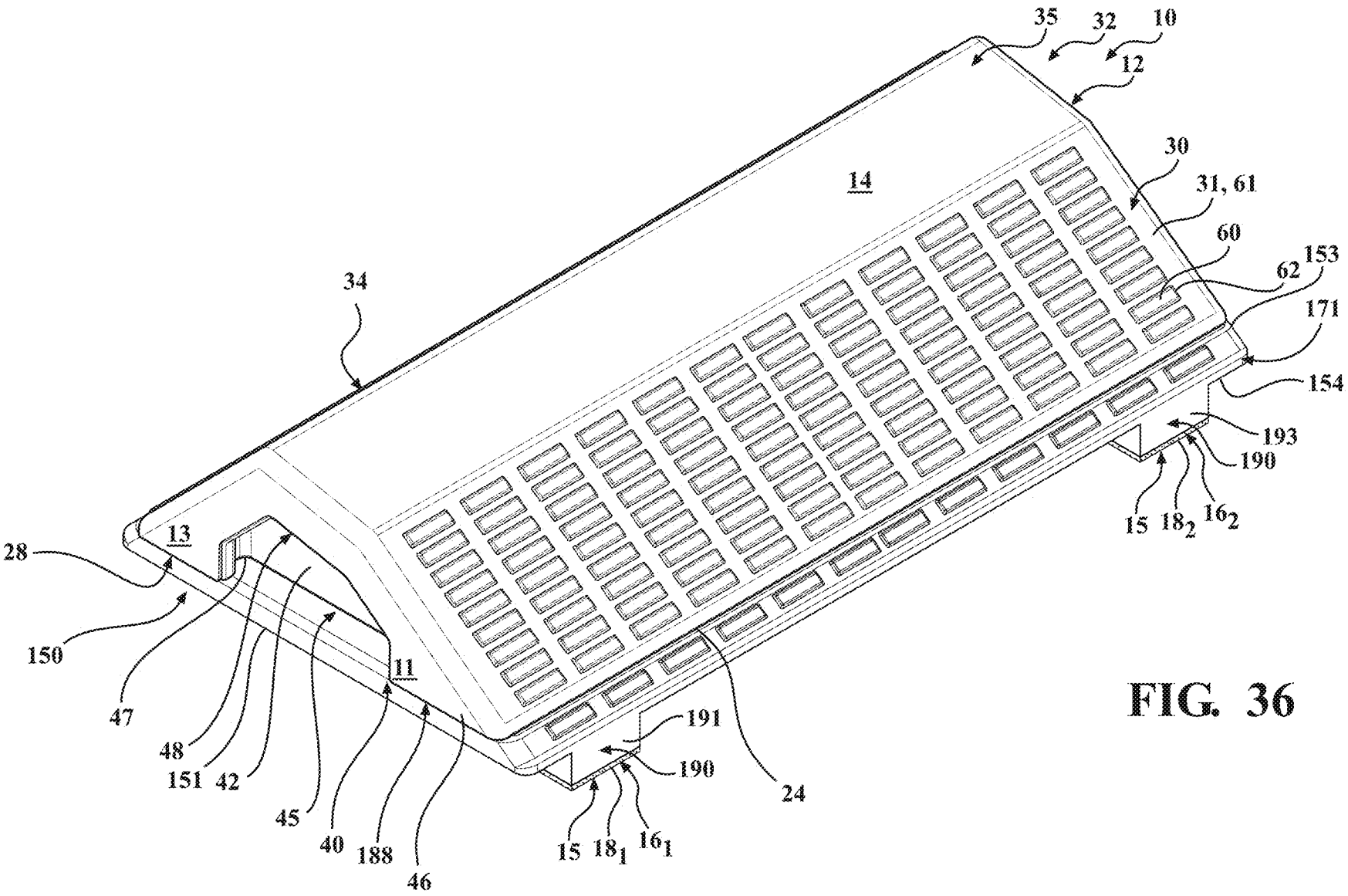
FIG. 36 is a top perspective view of the embodiment of FIG. 35 with the selectively attachable and detachable base member and roof attachment member in a selectively attached position and condition.
Figure 37:
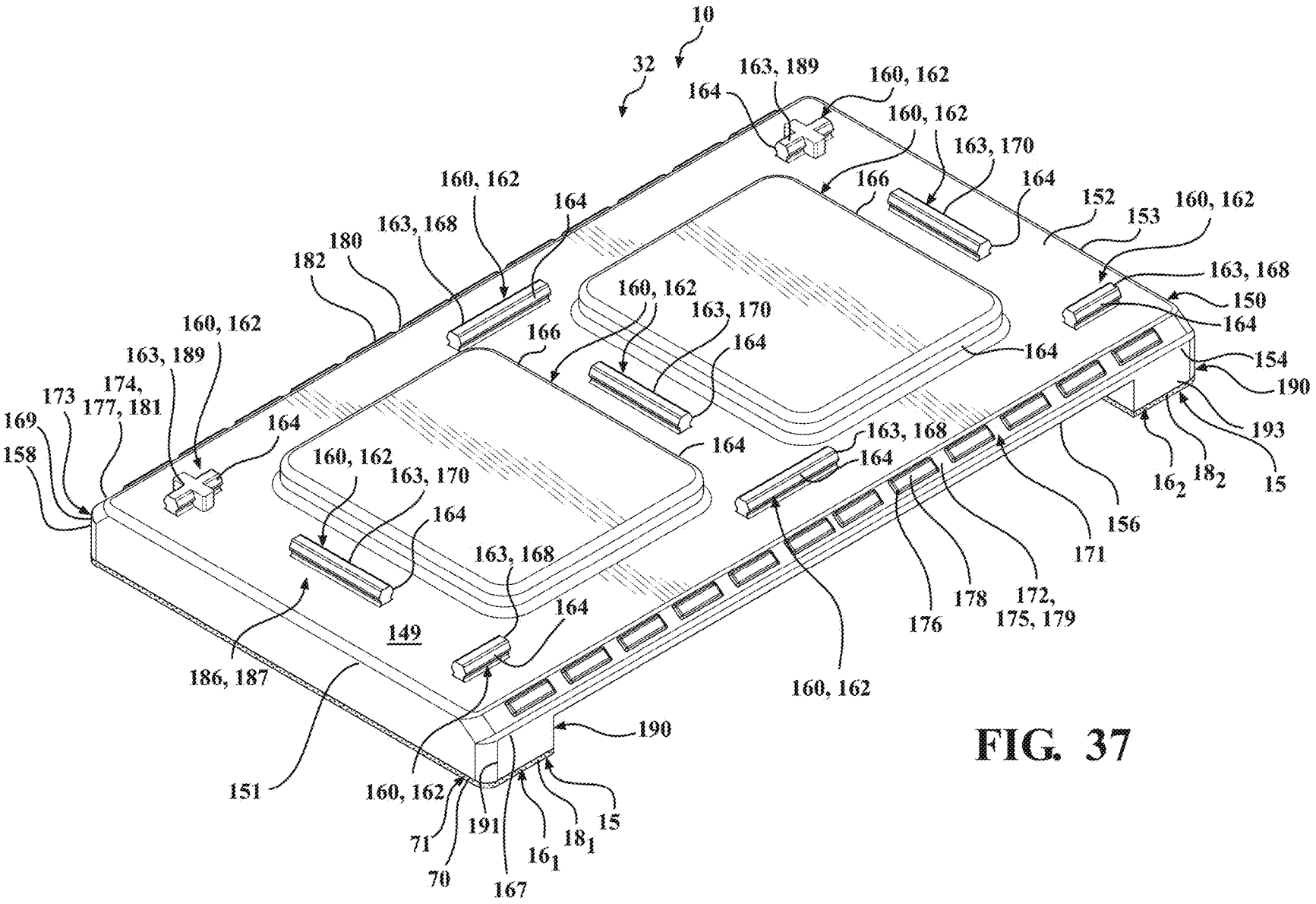
FIG. 37 is a top perspective view of an embodiment of a roofing support system and roof support as disclosed herein comprising a selectively attachable and detachable base member and a roof attachment member comprising a plurality of laterally-extending rails disposed proximate the base ends that each comprise a permanent magnet and a resiliently compressible cover layer as described herein.
Figure 38:
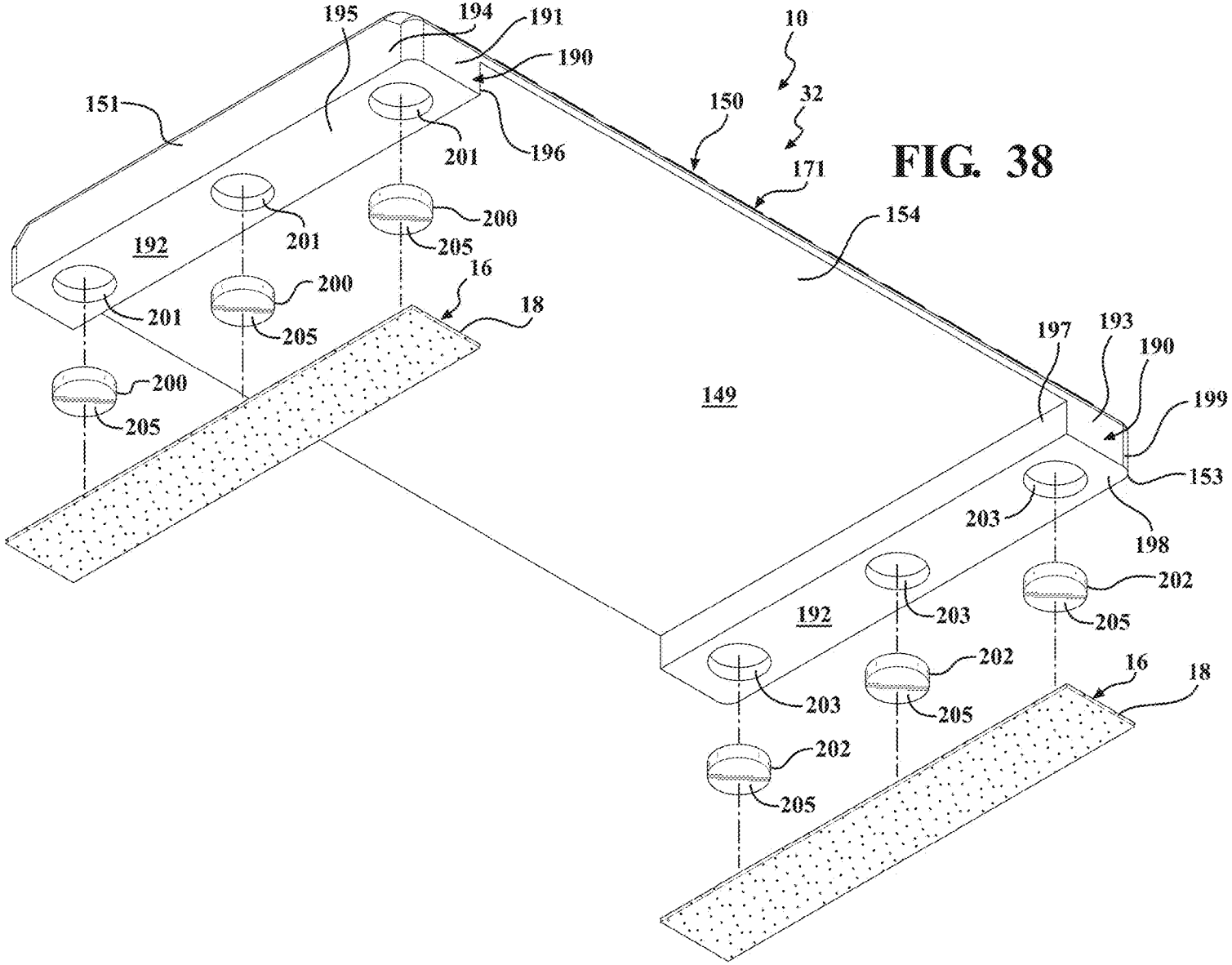
FIG. 38 is an exploded bottom perspective view of the roofing support system and roof support of FIG. 37.
Figure 39:
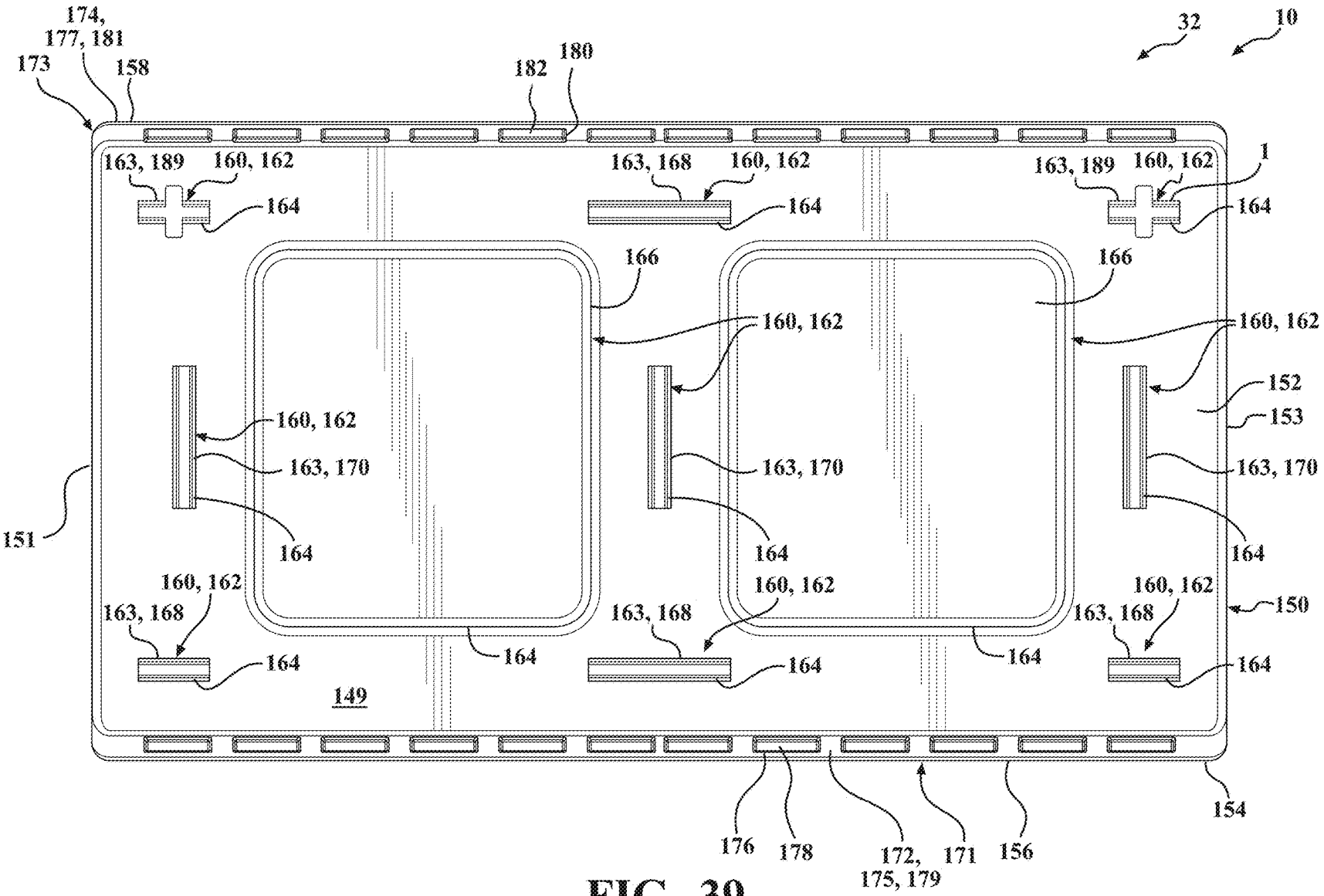
FIG. 39 is a top view of the roofing support system and roof support of FIG. 37.
Figure 40:
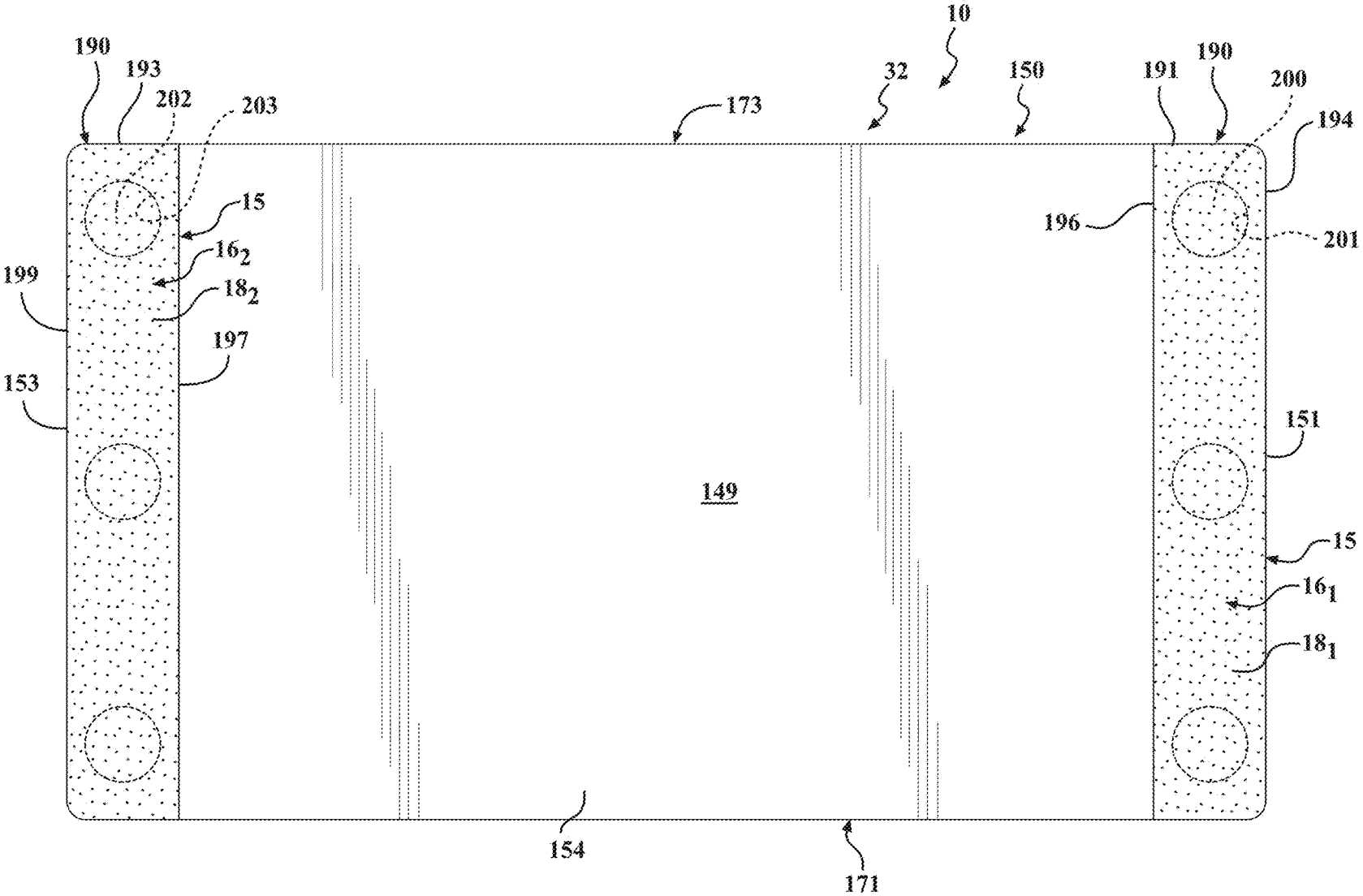
FIG. 40 is a bottom view of the roofing support system and roof support of FIG. 37.
Figure 41:
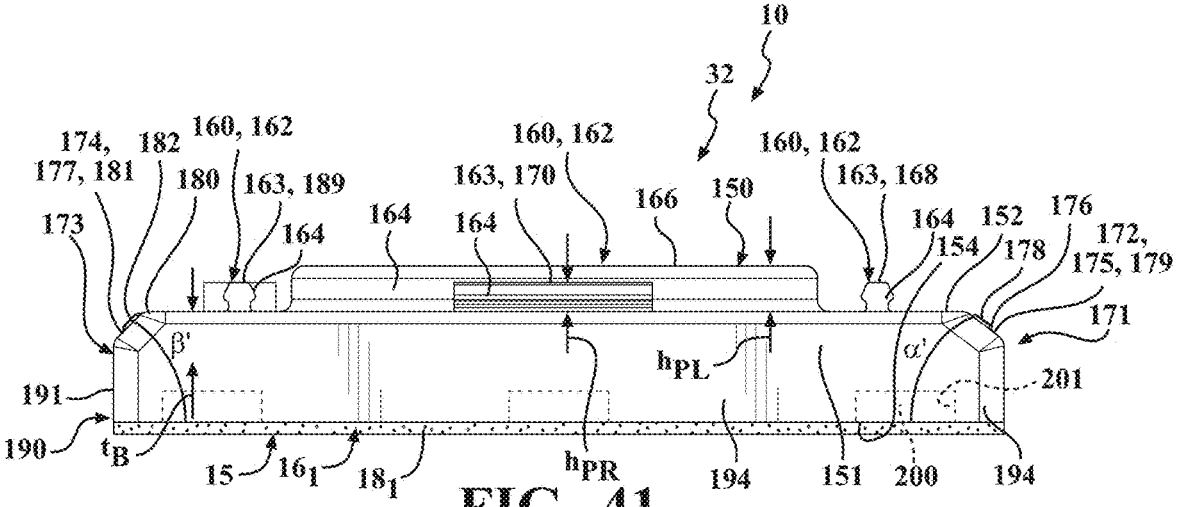
FIG. 41 is a left side view of the roofing support system and roof support of FIG. 37.
Figure 42:
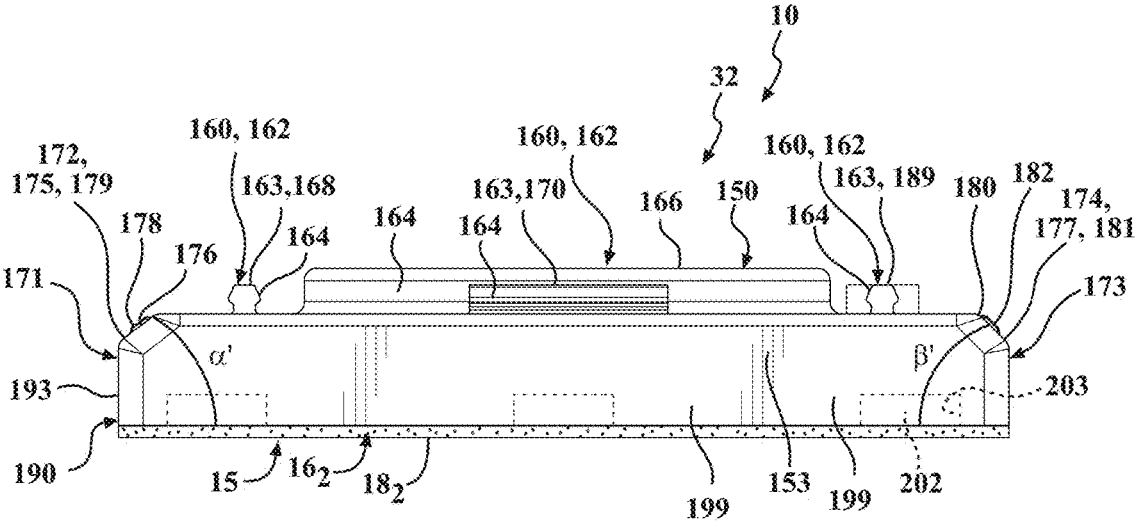
FIG. 42 is a right side view of the roofing support system and roof support of FIG. 37.
Figure 43:
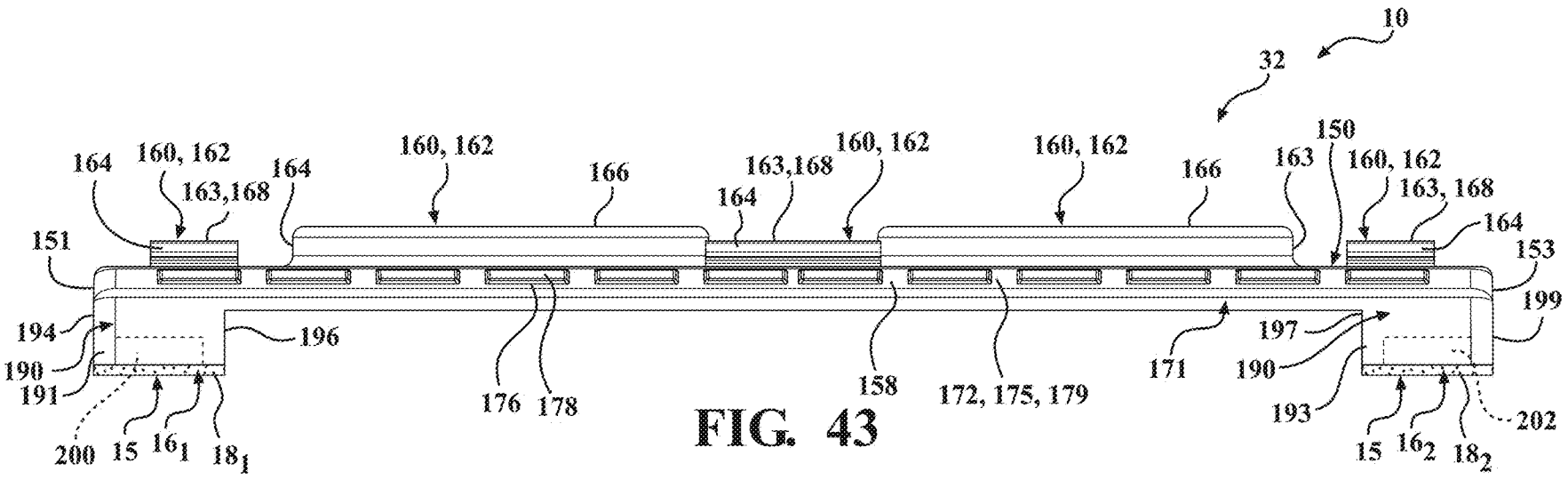
FIG. 43 is a front view of the roofing support system and roof support of FIG. 37.
Figure 44:
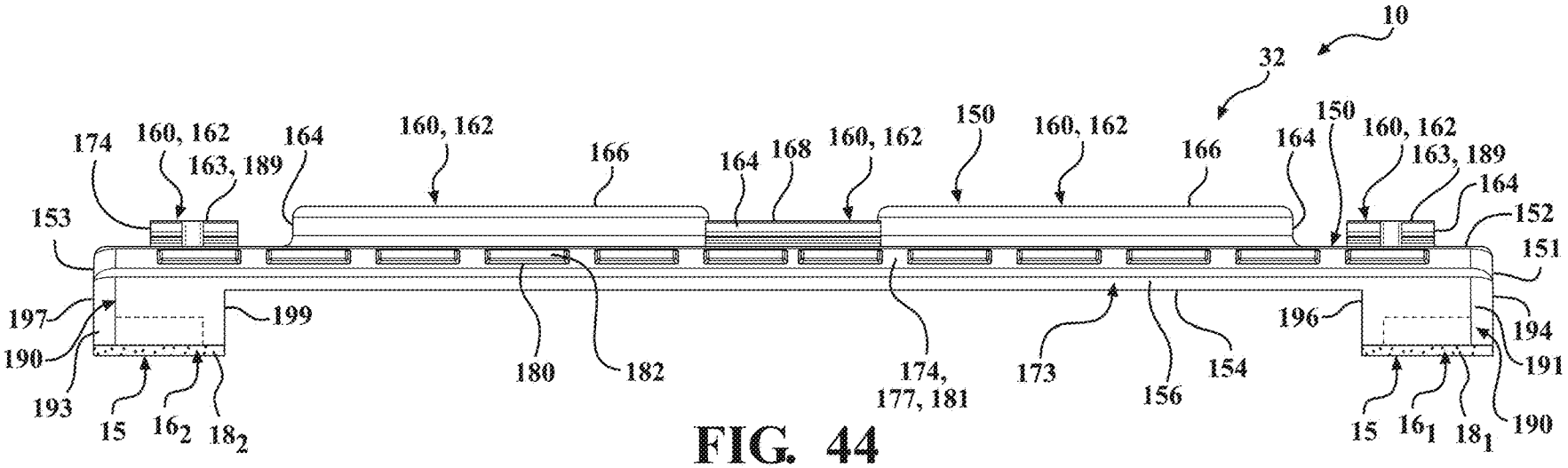
FIG. 44 is a rear view of the roofing support system and roof support of FIG. 37.
Figure 45:
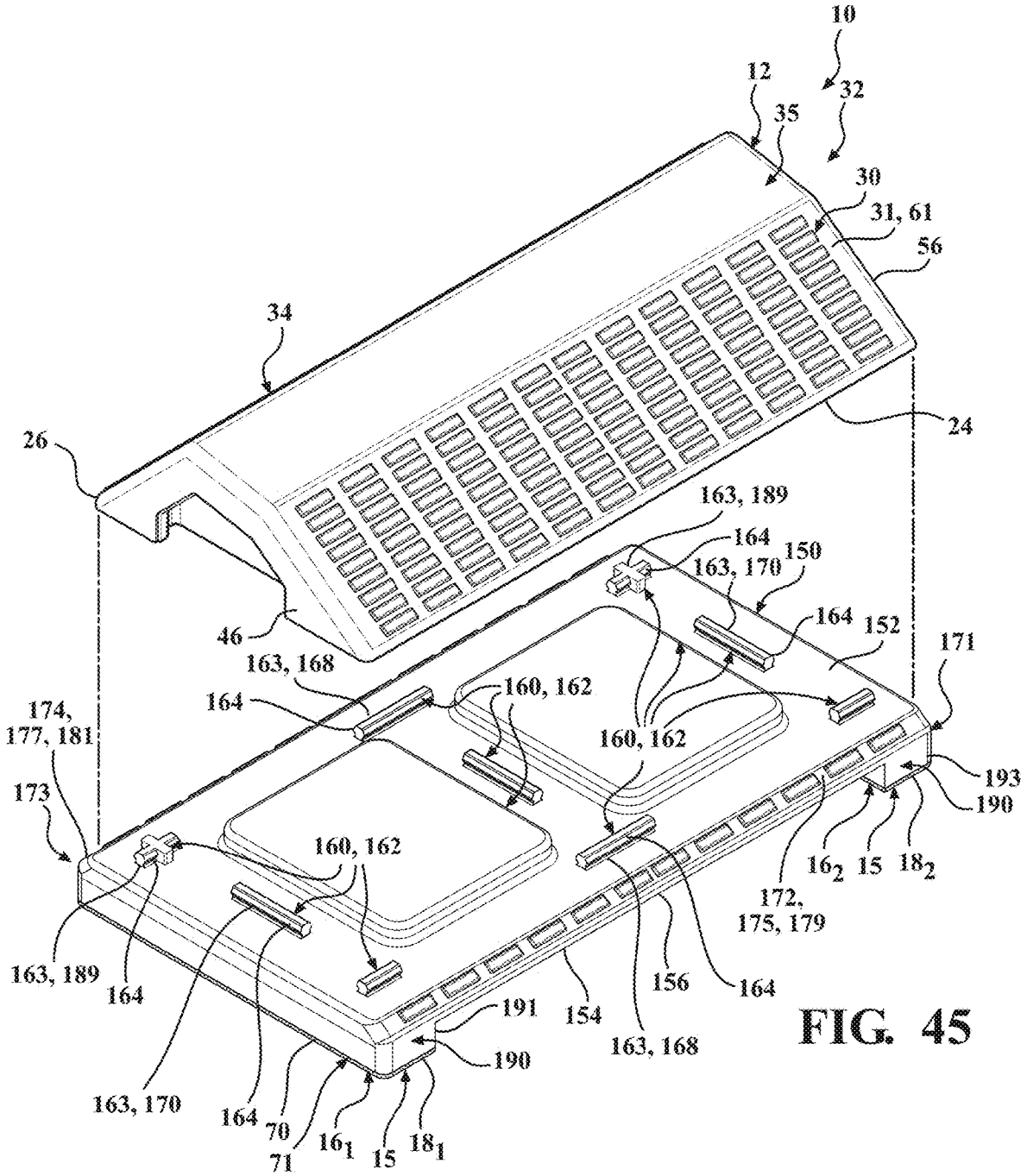
FIG. 45 is an exploded top perspective view of an embodiment of a roofing support system and roof support as disclosed herein comprising a core member and the base member and roof attachment member of FIG. 37 in a selectively detached position and condition.
Figure 46:
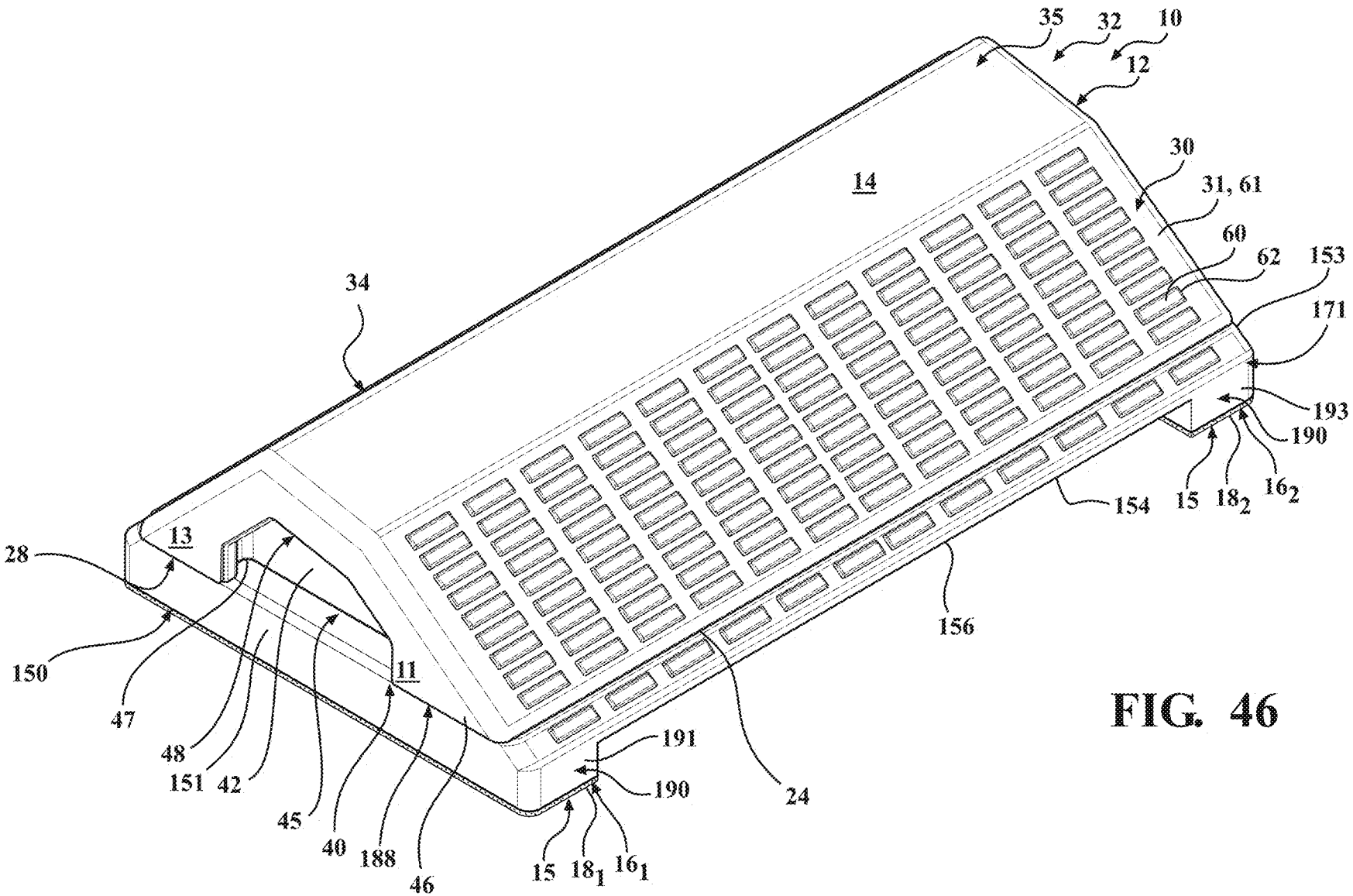
FIG. 46 is a top perspective view of the embodiment of FIG. 45 with the selectively attachable and detachable base member and roof attachment member in a selectively attached position and condition.
Figure 47:
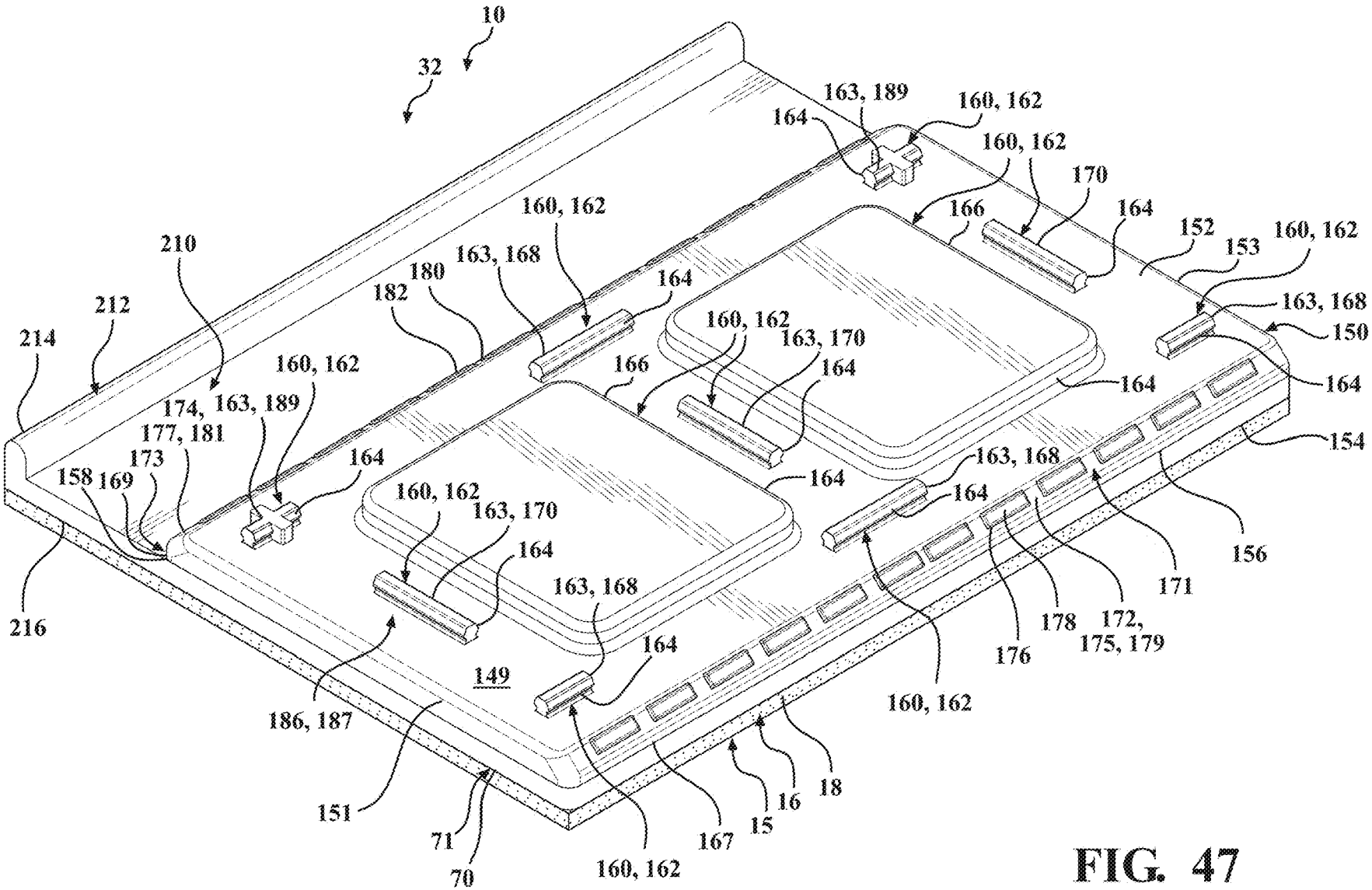
FIG. 47 is a perspective view of another embodiment of a roofing support system and roof support as disclosed herein comprising a selectively attachable and detachable base member comprising an integral longitudinally-extending shelf and a roof attachment member comprising a resiliently compressible cover layer, as described herein.
Figure 48:
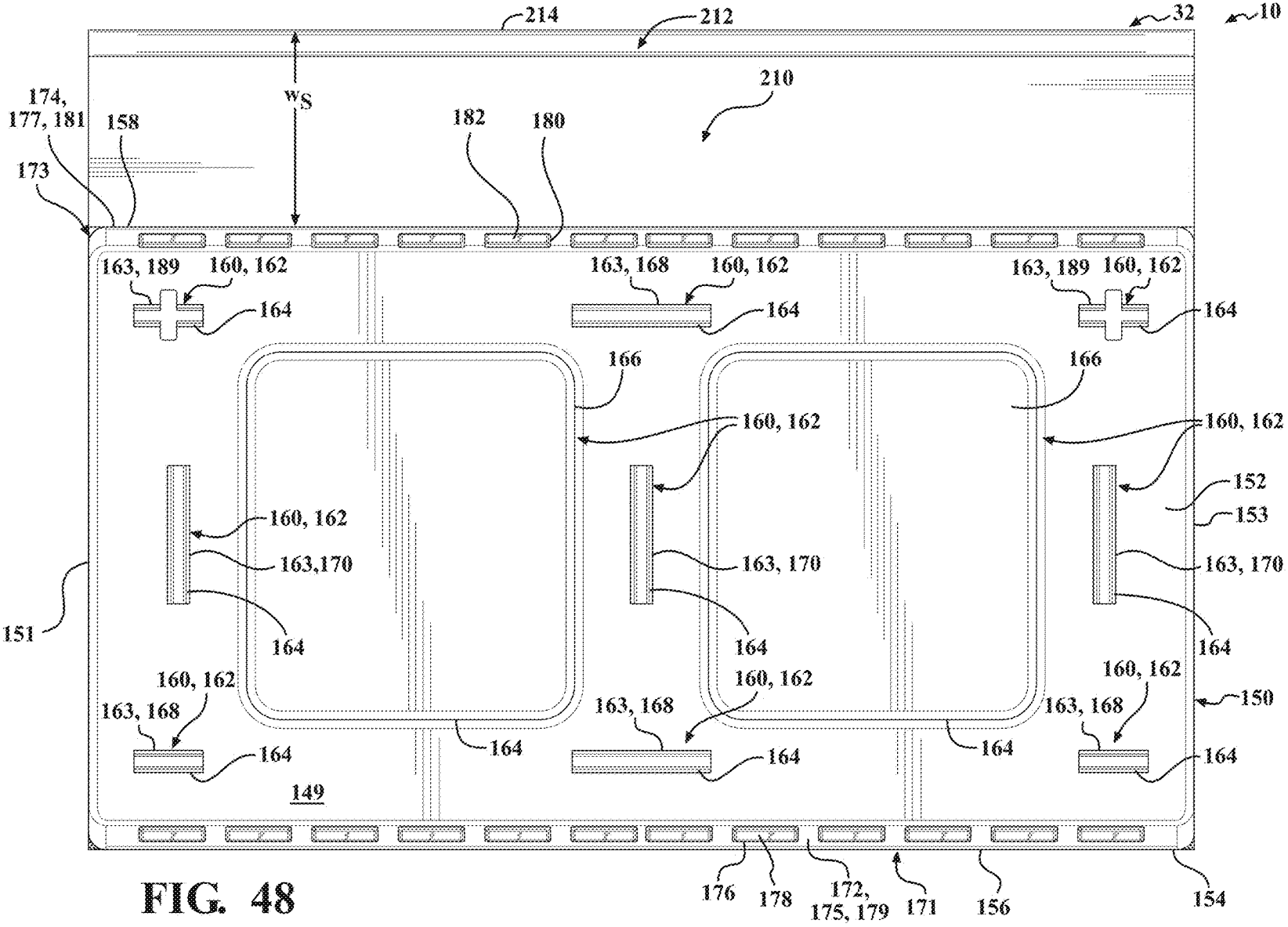
FIG. 48 is a top view of the roofing support system and roof support of FIG. 47.
Figure 49:
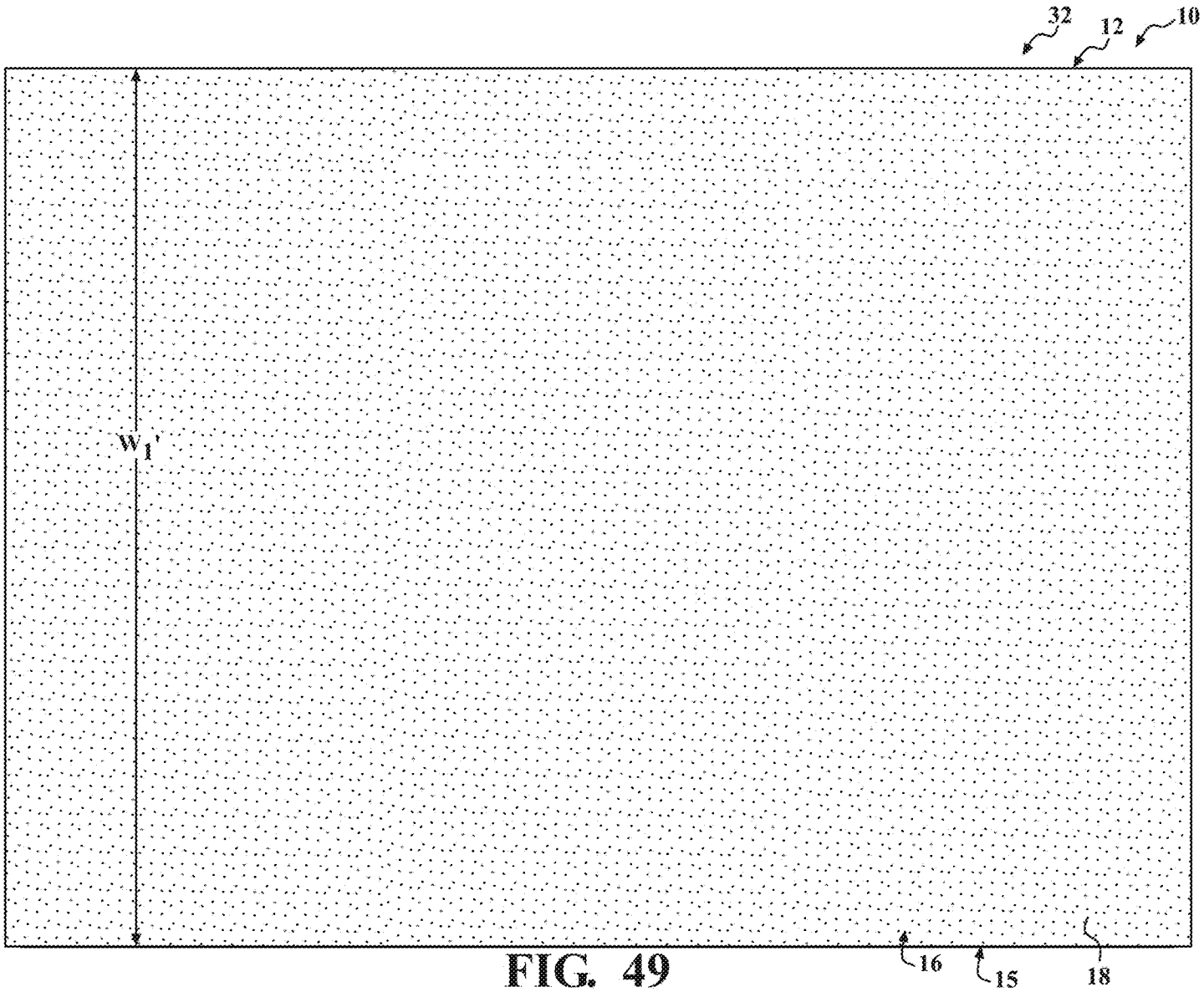
FIG. 49 is a bottom view of the roofing support system and roof support of FIG. 47.

The load-bearing core recesses 76 are configured to receive corresponding load-bearing base protrusions 166 having substantially the same shape and size. The load-bearing core recesses 76 and load-bearing base protrusions 166 are configured to bear the resolved force vectors associated roofing load 2 when the roofing support 32 is in use, particularly the shear force vectors operative in the plane, and at the interface, of the first roof contact side 28 and the first core contact side 152, as well as the normal force vectors associated with the roofing load 2. The load-bearing core recesses 76 and load-bearing base protrusions 166 may have any suitable size and shape sufficient to bear the roofing load 2 as described herein, including any suitable geometric shape, including various circular, elliptical, and other closed curved shapes, as well as triangular, rectangular, and other closed polygonal shapes, and including rounded corner embodiments of these geometric shapes (e.g., rounded rectangular), and where more than one load-bearing core recess 76 is employed may comprise different shapes and/or sizes. The load-bearing core recesses 76 and load-bearing base protrusions 166 will generally occupy a significant portion of the surface area of first roof contact side 28, including various embodiments at least 40%, more particularly at least 50% embodiment, and more particularly at least 60% of the surface area. In one embodiment, the plurality of base attachment structure 72 comprising the core recesses 74 is disposed on first roof contact side 28 and comprises two load-bearing core recesses 76 having the same shapes and sizes, namely, rounded rectangular shapes that are configured to receive two rounded rectangular load-bearing base protrusions 166 as shown in FIGS. 1-8. In this embodiment, the two load-bearing core recesses 76 comprise a rounded square and have a length and width of 5.16 inches, and a depth of about 1.0". The load bearing core recesses 76 comprise a core recess sidewall 75 and a core recess bottom 77. The core recess sidewall 75 of the load-bearing core recesses 76 may comprise any suitable recess sidewall configuration. In one embodiment, the core recess sidewalls 75 of the load-bearing core recesses 76 comprises vertical sidewalls (e.g., FIG. 2) with an inwardly curved (e.g., radius) transition to the core recess bottoms 77 and an outwardly curved (e.g., radius) transition to the first roof contact side 28. The core recess bottoms 77 of the core recesses 76 may have any suitable shape configuration (e.g., convex planar, concave planar, or flat planar), which in the embodiment of FIGS. 1-8 comprises a flat planar shape. In one embodiment, the load-bearing core recesses 76 and corresponding load-bearing base protrusions 166 may also serve as indices for alignment of the corresponding features of the core member 12 and longitudinally-extending base member 150. For example, as shown in FIGS. 17, the load-bearing base protrusions 166 have a height (hPL¬) that is greater than the height (hPR) of retention base protrusions 168, 170, 189. As such, when a roofing worker 6 as a user is seeking to provide a rough alignment of the core member 12 and longitudinally-extending base member 150, such as by placing them in level touching contact and sliding one member over the other, the load-bearing base protrusions 166, which protrude upwardly farther than the retention base protrusions 168, 170, 189 will begin to engage the load-bearing core recesses 76 before the retention base protrusions 168, 170, 189 begin to engage the retention core recesses 78, 80 and thereby index the alignment of the retention base protrusions 168, 170, 189 and retention core recesses 78, 80, 82 and core member 12 and longitudinally-extending base member 150 while selectively attaching them to one another.

The core recesses 74 may also comprise a plurality of retention core recesses 73. In one embodiment, the retention core recesses 73 comprise longitudinally-extending retention core recesses 78 and laterally-extending retention core recesses 80. The retention core recesses 73 comprising longitudinally extending core recesses 78, laterally-extending retention core recesses 80, and/or longitudinally and laterally-extending core recesses 82 or t-shaped core recesses 82 are configured to receive corresponding retention base protrusions 163 having substantially the same shape and size, comprising longitudinally extending base protrusions 168, laterally-extending base protrusions 170, and/or longitudinally and laterally-extending base protrusions 189 or t-shaped base protrusions 189. The retention core recesses 73 and retention base protrusions 163 are configured to retain the core member 12 and longitudinally-extending base member 150/roof attachment member 15 in attached engagement when the roofing support 32 is in use. In one embodiment, the retention core recesses 73 and retention base protrusions 163 are designed to bear no portion of the resolved force vectors associated with a roofing load 2 during use, particularly the shear force vectors operative in the plane, and at the interface, of the first roof contact side 28 and the first core contact side 152, as well as the normal force vectors associated with the roofing load 2, but in other embodiments may bear a small portion of these force vectors. The retention core recesses 73 and retention base protrusions 163 may have any suitable sizes and shapes sufficient to retain the core member 12 and longitudinally-extending base member 150/roof attachment member 15 in attached engagement, including any suitable geometric shapes, including various slot-shaped contoured (e.g., in cross-section) recesses and mating rail-shaped contoured (e.g., in cross-section) protrusions 163, where the contours of the slot-shaped core recess sidewalls 75 and contours of the rail-shaped base protrusion sidewalls 164 are the same with the contours of the base protrusion sidewalls being slightly smaller in size than the core recess sidewalls 75 so as to nest together with the recesses in interlocking mating engagement as shown in FIG. 63. In one embodiment, the rail-shaped protrusion sidewalls 164 include opposed convex portions 183 that are configured to nest within opposed concave core sidewall portions 83 of the core recess sidewalls 75 in interlocking mating engagement as shown in FIG. 63, for example. In one embodiment, the contours of the slot-shaped core recess sidewalls 75 comprise a flat planar core recess bottom 77 that tapers on opposed sides 67, 69 of sidewall 75 upwardly and outwardly to a core recess crown 85 or widest part of the recess and then tapers inwardly and upwardly to narrower core recess neck 86 and the contours of the rail-shaped base protrusion sidewalls 164 comprise a flat planar base protrusion top 165 that tapers downwardly and outwardly on opposed sides 157, 159 to a base protrusion crown 184 or widest part of the protrusion and then tapers downwardly and inwardly to a base protrusion neck 185, with the corresponding elements of the retention base protrusions 163 being slightly smaller than those of the retention core recesses 73 as shown in FIG. 63. The contours of the slot-shaped recess 75 sidewalls and rail-shaped base protrusion sidewalls 164 of FIG. 63 are configured to provide snap-lock engagement/attachment of the retention base protrusions 163 within the retention core recesses 73 and the retention of core member 12 to longitudinally-extending base member 150 by application of a normal or substantially normal joining or attachment force (FA) pressing these members together. Conversely, the contours of the slot-shaped recess 75 sidewalls and rail-shaped base protrusion sidewalls 164 of FIG. 63 are configured to provide snap-unlock disengagement/detachment by applying a normal or substantially normal separation or detachment force (FD) in the opposite direction. In one embodiment, the plurality of retention core recesses 73 comprise longitudinally-extending retention core recesses 78 and laterally-extending retention core recesses 80 having substantially rectangular or rectangular slot shapes as shown in FIGS. 1-8. The slot-shaped retention core recesses 73 may have any suitable length, and the slot-shaped longitudinally-extending retention core recesses 78 and/or laterally-extending retention core recesses 80 and/or longitudinally and laterally-extending retention core recesses 82 may have the same lengths or different lengths. In one embodiment, the longitudinally-extending retention core recesses 78 comprise a plurality of shorter recesses (e.g., 3.15 inches) and longer recesses (e.g., 5.16 inches), and have a depth (dRR) of about 0.50 to 0.75 inches, more particularly 0.50 to 0.60 inches. In one embodiment, three longitudinally-extending retention core recesses 78 (e.g., two shorter recesses proximate first core end 46 and second core end 56 and one longer recess disposed approximately equidistant between them) are spaced apart and disposed along the first core edge 24 and three opposed retention core recesses, including two shorter longitudinally and laterally-extending retention core recesses 82 and one longer longitudinally-extending retention core recess 78 are spaced apart and disposed along the second core edge 26 in the same configuration. In one embodiment, the t-shape longitudinally and laterally-extending retention core recesses 82 along the second core edge 26 also advantageously serve as poka-yoke or error-proofing features when assembling the core member 12 and base member 150 by preventing them by being assembled with the base member 150 (or core member 12) reversed from orientation shown in FIGS. 1-17, for example. In this embodiment, one laterally-extending retention core recesses 80 is disposed along the first core end 46 between the opposed longitudinally-extending retention core recesses 78 disposed proximate the first core end 46, one laterally-extending retention core recesses 80 is disposed along the second core end 56 between the opposed longitudinally-extending retention core recesses 78 disposed proximate the second core end 56, and one laterally-extending retention core recesses 80 is disposed between the load-bearing core recesses 76 and between the opposed longitudinally-extending retention core recesses 78 disposed between the first core end 46 and second core end 56. In this embodiment, the slot-shaped retention core recesses 73 and corresponding retention base protrusions 163 comprise a selectively engageable retainer 186, and more particularly a selectively engageable peripheral retainer 187, which upon engagement secures the core member 12 to the longitudinally-extending base member 150 and roof attachment member 15, and more particularly upon engagement secures the core member 12 to the longitudinally-extending base member 150 about their periphery at the interface 188 between them.

Figure 58:
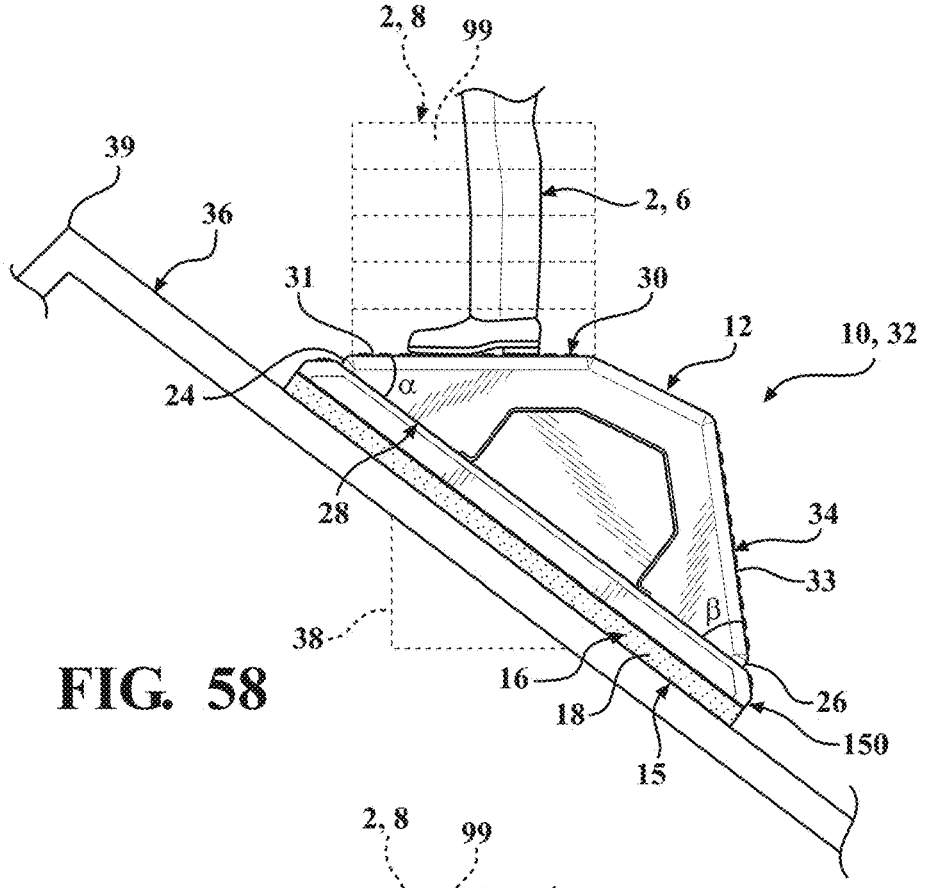
FIG. 58 is a schematic side view of a roofing support system and roof support as described herein (e.g., FIG. 9) in use on a first sloped roof with a first roof pitch and the second side and second working surface facing upslope and providing a horizontal or substantially horizontal second working surface and a second side portable platform for support of a roofing worker or roofing load.
Figure 59:
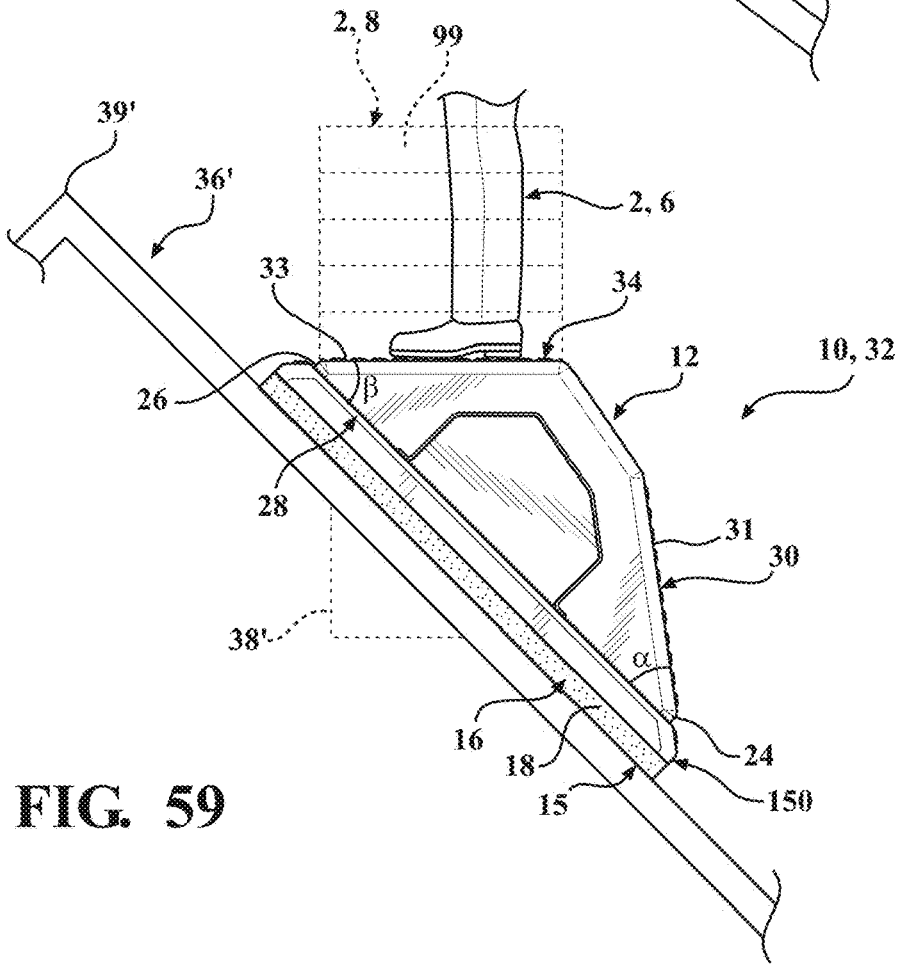
FIG. 59 is a schematic side view of a roofing support system and roof support as described herein (e.g., FIG. 9) reversed and in use on a second sloped roof with a second roof pitch and the third side and third working surface facing upslope and providing a horizontal or substantially horizontal third working surface and a third side portable platform for support of a roofing worker or roofing load.

The longitudinally-extending core member 12 also comprises a longitudinally-extending second side 30 comprising a second side working surface 31, and in one embodiment having a second width (w2) and a second length (l2) that is greater than the second width, tapering toward the longitudinally-extending first core edge 24 at a first predetermined acute angle ($\alpha$) from the first roof contact side 28. The longitudinally-extending first roof contact side 28 and the longitudinally-extending second side 30 taper toward one another at the longitudinally-extending first core edge 24. The longitudinally-extending second side 30 may also be referred to as the second load-bearing side 30 and is configured to receive and support the roofing load 2 depending on the orientation of the lightweight composite roofing support system 10 on the sloped roof 36 and which of the longitudinally-extending second side 30 or longitudinally-extending third side 34 is oriented upslope as shown in FIGS. 58 and 59. The longitudinally-extending second side 30 comprising a second side working surface 31 is a generally flat, planar, continuous surface, that is configured for use as described herein by a roofing worker 6, and in a preferred embodiment will not include any raised features or recesses or other surface discontinuities, other than non-skid or traction elements described herein, that would be recognized by those of ordinary skill in the roofing arts as a potential safety hazard, such as a potential stumbling or tripping hazard to a roofing worker.

The longitudinally-extending core member 12 also comprises a longitudinally-extending third side 34 comprising a third side working surface 33, and in one embodiment having a third width (w3) and a third length (l3) that is greater than the third width, tapering toward the longitudinally-extending second core edge 26 at a second predetermined acute angle ($\beta$) from the longitudinally-extending first roof contact side 28. The longitudinally-extending third side 34 may also be referred to as the third load-bearing side 34 and is also configured to alternately receive and support the roofing load 2 depending on the orientation of the lightweight composite roofing support system 10 on the sloped roof 36 and which of the longitudinally-extending second side 30 or longitudinally-extending third side 34 is oriented upslope as shown in FIGS. 58 and 59. The longitudinally-extending third side 34 comprising a third side working surface 33 is a generally flat, planar, continuous surface, that is configured for use as described herein by a roofing worker, and in a preferred embodiment will not include any raised features or recesses or other surface discontinuities, other than non-skid or traction elements described herein, that would be recognized by those of ordinary skill in the roofing arts as a potential safety hazard, such as a potential stumbling or tripping hazard to a roofing worker.

Figure 61:
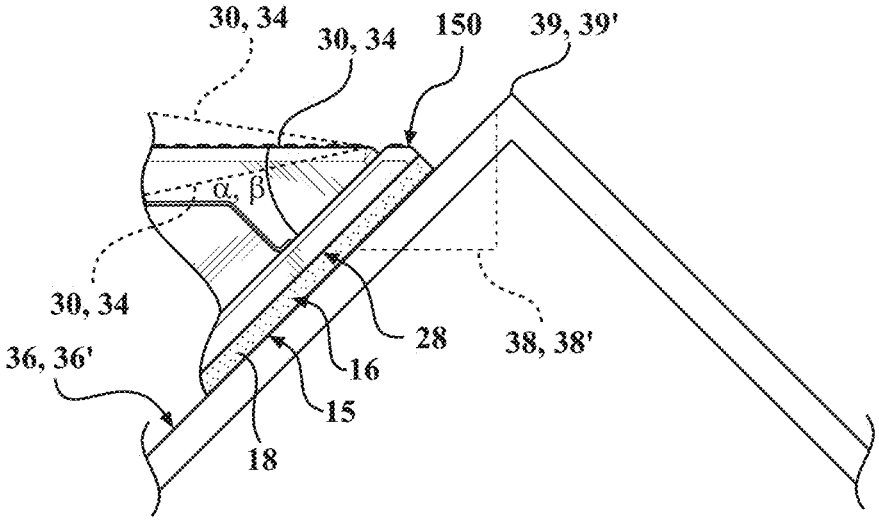
FIG. 61 is a schematic illustration of a roofing support system and roof support as disclosed herein illustrating that the second side or third side may be oriented on sloped roofs with a plurality of roof pitches to provide a horizontal or substantially horizontal working surface on these sloped roofs.

In one embodiment, as illustrated in FIG. 58, in a first configuration or orientation where the longitudinally-extending first core edge 24 is defined by the intersection of the longitudinally-extending first roof contact side 28 and longitudinally-extending second side 30 and the predetermined first acute angle (α) between these sides is configured for placement facing up-roof closest to the peak 39 or apex of the sloped roof 36 with the longitudinally-extending first roof contact side 28 facing, and longitudinally-extending base member 150 and roof attachment member 15, such as cover layer 16, in pressing contact against the sloped roof 36 and the longitudinally-extending first core edge 24 substantially parallel or parallel to the peak. In this configuration, the predetermined first acute angle (α) may be selected to be the same as a common first roof angle or pitch 38 (e.g., a 10/12 pitch) of the sloped roof 36, which in the case of a 10/12 pitch (39.81°) sloped roof 36 means that the predetermined first angle (α) is also 39.81°, so that the second side 30 extends in the direction of the first peak 39 as a substantially horizontal or horizontal first platform, which advantageously provides a very useful substantially level or level longitudinally-extending second side working surface 31 on the sloped roof 36 for use as described herein. As used herein, substantially parallel includes minor misorientations of the longitudinally-extending first core edge 24 with the line defined by the first peak 39 such that they are non-parallel, and the longitudinally-extending second side 30 is not level, but rather substantially level although it may be slightly inclining or declining as compared to the first peak 39 of the first sloped roof 36. One of ordinary skill in the roofing arts will understand that substantially parallel orientations still provide a very advantageous and useful longitudinally-extending second side working surface 31 of longitudinally-extending second side 30 as compared to the alternative of using the steeply first pitched roof 36 as the working surface. One of ordinary skill in the roofing arts will also understand that when the orientation with the longitudinally-extending first core edge 24 at the intersection of longitudinally-extending first roof contact side 28 and longitudinally-extending second side 30 and defining predetermined first acute angle (α) is placed facing up-roof closest to the peak 39, and substantially parallel or parallel to the peak, that the lightweight composite roofing support system 10 also provides a very advantageous and useful longitudinally-extending second side working surface 31 (i.e. second side 30) for first sloped or pitched roofs 36 with a range of similar roof pitches that are greater than and less than the predetermined first acute angle (α) and the first predetermined roof angle or pitch 38 (e.g. a 10/12 pitch) as illustrated schematically in FIG. 61. In one embodiment, where the predetermined first acute angle (α) is 39.81° corresponding to a 10/12 first predetermined roof angle or pitch 38, the range of similar roof pitches may comprise, for example, a range of 14/12 to 7/12 (excluding 10/12), or more particularly 12/12 to 8/12 (excluding 10/12), even though the longitudinally-extending second side working surface 31 of second side 30 is only substantially horizontal, not completely horizontal, or level on these roofs. The slight inward or outward slope of the second side working surface 31 of longitudinally-extending second side 30 over this range of similar roof pitches is still very advantageous and much preferred compared to working without the lightweight composite roof support system 10 and using the actual roof surfaces of these steeply pitched roofs 36 as the working surface to support roofing loads 2, particularly in the case of roofing workers 6 trying to move, walk, stand, crouch, kneel, sit, or lie on, or to stack, place or otherwise stage or store roofing materials 8 or equipment on, the sloped roof 36 as shown in FIG. 61. In one embodiment, the second side working surface 31 comprises a second side non-skid surface 61 over all, or a portion or portions, of the second side working surface 31. In one embodiment, the second side non-skid surface 61 comprises a second side surface texture or surface roughness, or a predetermined second side pattern, such as an embossed pattern. The second side non-skid surface 61 may be formed by adding a non-skid material to the second side working surface 31 after molding or integrating a non-skid material or materials to the second side working surface 31 during molding, to provide a second side surface texture or pattern, or may be integrally formed in the core material of the second side working surface 31 by molding the same into the surface as an embossed pattern, for example. In one embodiment, the second side working surface 31 comprises a second side non-skid surface 61 comprising a plurality of integrally formed second side protrusions 60 projecting upwardly from the second side working surface 31 as second side protruding traction elements 62. The protrusions may have any suitable shape or profile as viewed from above, including various circular, rectangular, chevron, herringbone, or whorl shapes. In one embodiment, the second side protrusions 60 have a protruding rectangular shape and are disposed in an array or pattern comprising a plurality of spaced apart columns and rows and comprise a plurality of second side protruding traction bars or elements 62.

Figure 50:
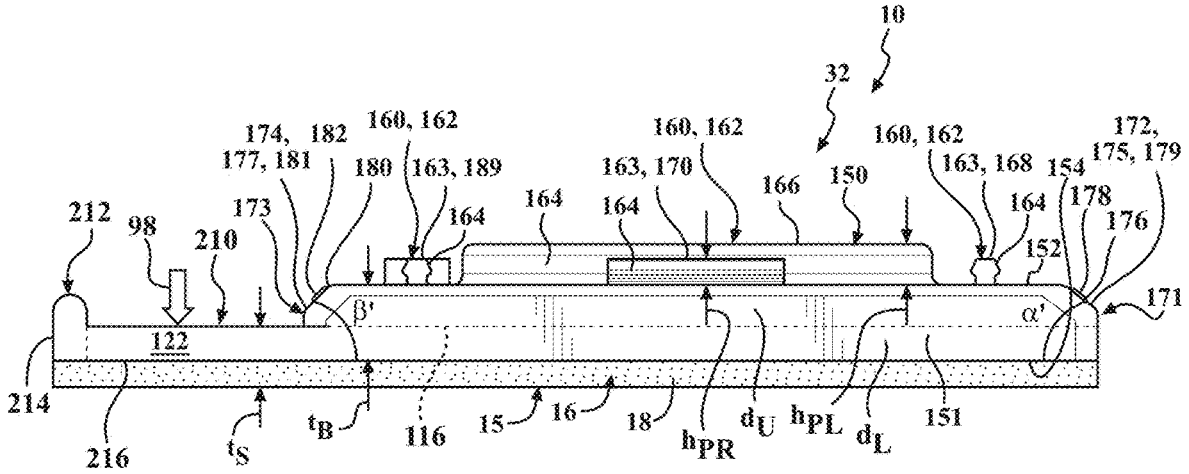
FIG. 50 is a left side view of the roofing support system and roof support of FIG. 47.
Figure 51:
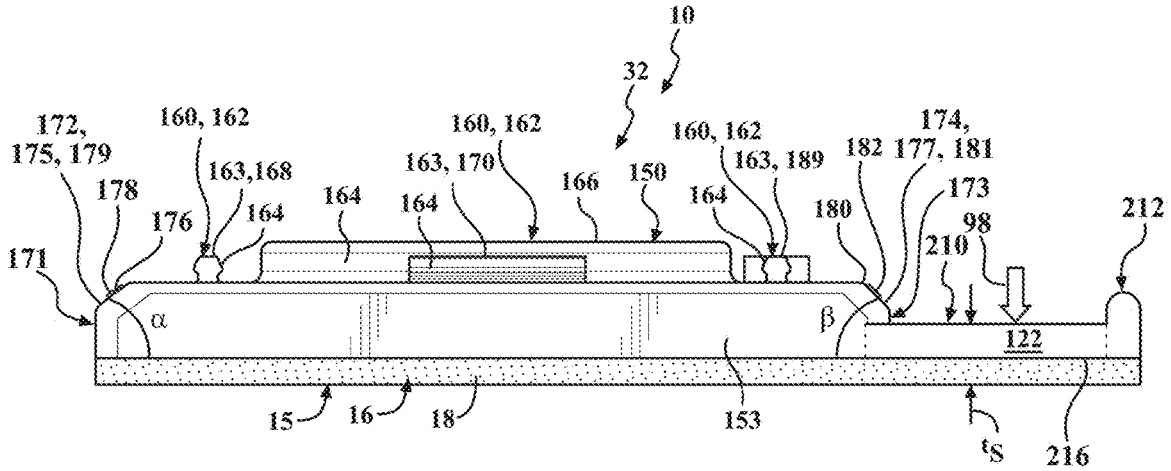
FIG. 51 is a right side view of the roofing support system and roof support of FIG. 47.
Figure 52:
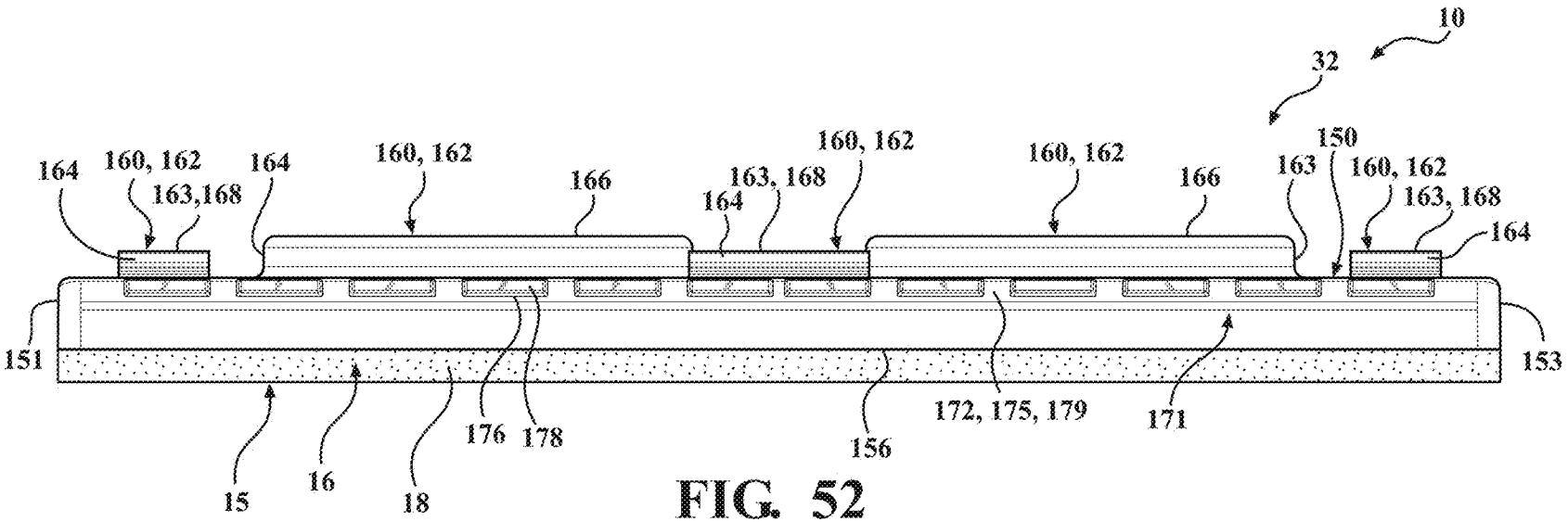
FIG. 52 is a front view of the roofing support system and roof support of FIG. 47.
Figure 53:
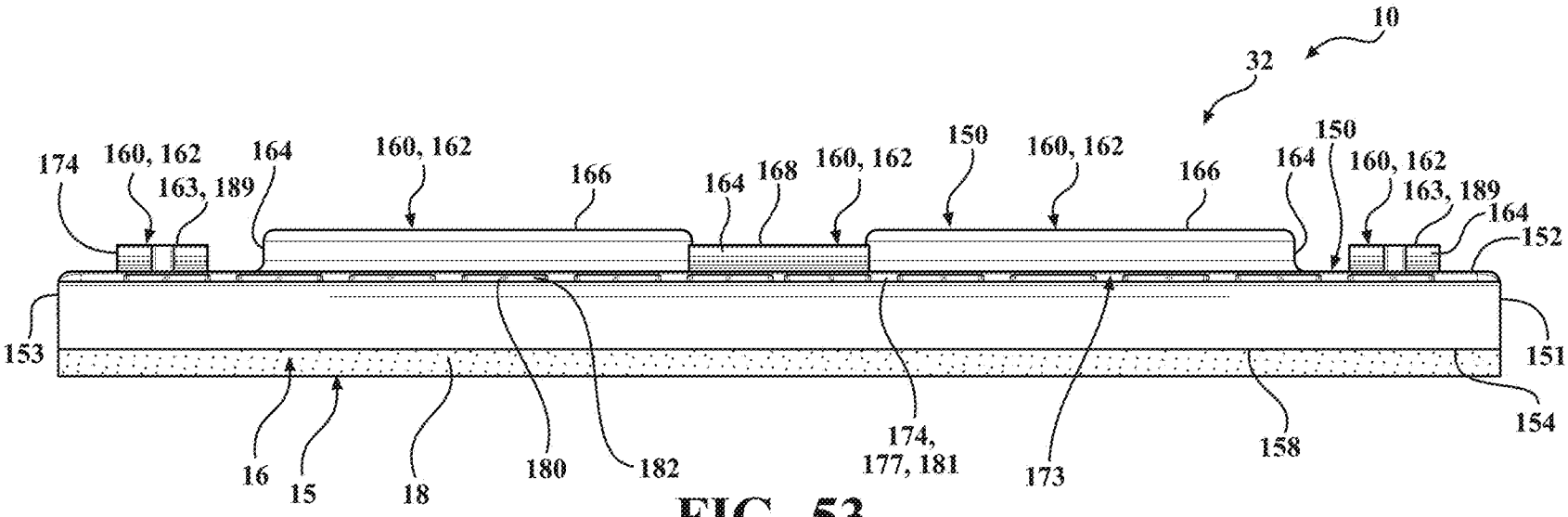
FIG. 53 is a rear view of the roofing support system and roof support of FIG. 47.
Figure 54:
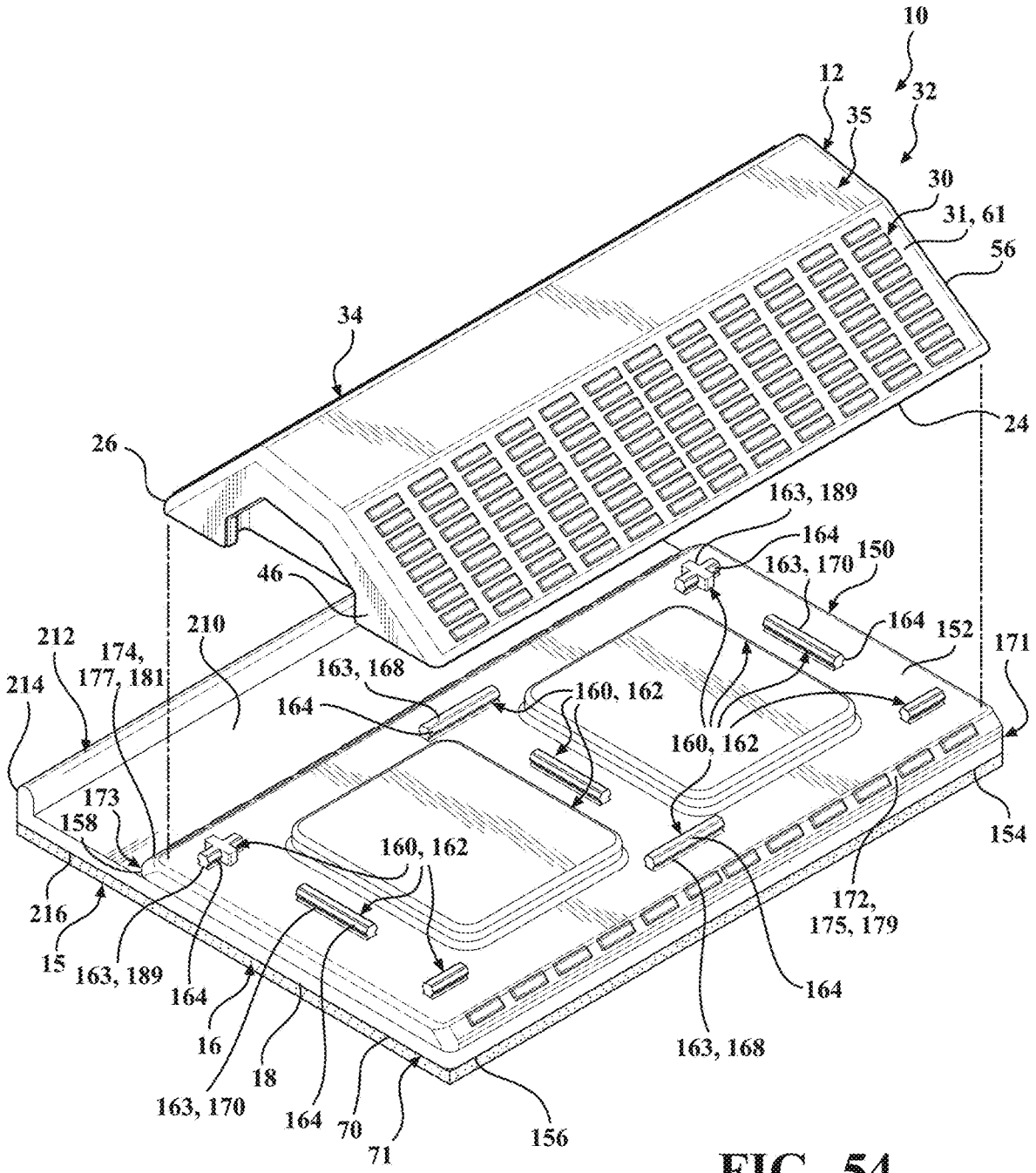
FIG. 54 is an exploded top perspective view of an embodiment of a roofing support system and roof support as disclosed herein comprising a core member and the base member and roof attachment member of FIG. 47 in a selectively detached position and condition.
Figure 55:
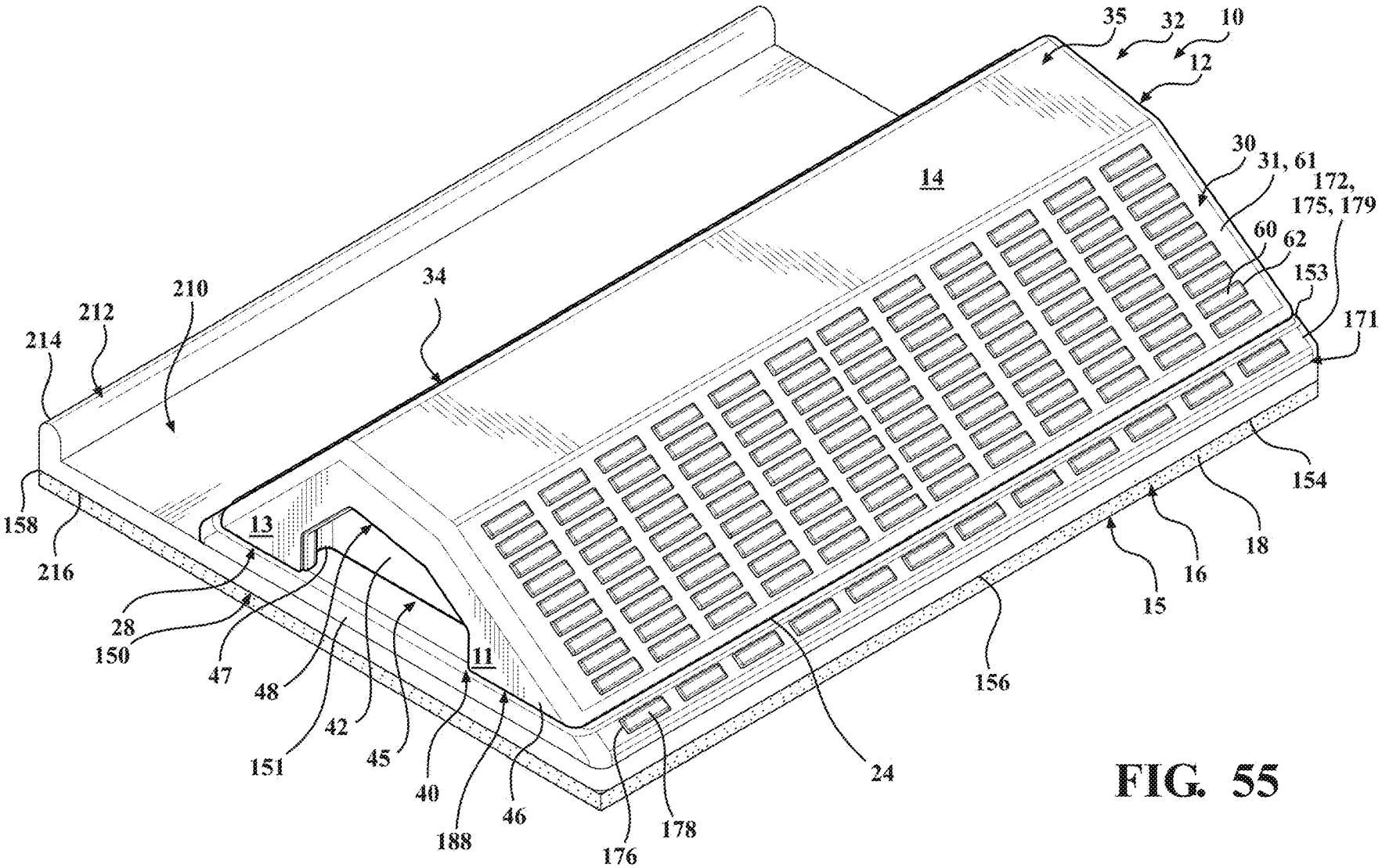
FIG. 55 is a top perspective view of the embodiment of FIG. 54 with the selectively attachable and detachable base member and roof attachment member in a selectively attached position and condition.

As illustrated in FIGS. 58 and 59, in one embodiment the lightweight composite roofing support system 10 is also reversible and configured for an alternate use in a second configuration or orientation on another sloped roof or sloped roofs 36' having a second predetermined roof pitch 38', or range of pitches, that is different from the first predetermined roof pitch 38 or range of pitches. Alternately, in this embodiment, as will easily be understood by one of ordinary skill both from the embodiments of FIGS. 1-61, the second configuration or orientation (FIG. 59) of lightweight composite roofing support system 10 may be reversed, rotated or otherwise changed by 180° from the first orientation (FIG. 58) so that predetermined second acute angle (β) is placed facing up-roof closest to the second peak 39' or apex of another or second steeply pitched roof 36' or roofs having a second predetermined roof pitch 38', or range of pitches, that is different than the first predetermined roof pitch 38. In the second configuration or orientation, the longitudinally-extending second core edge 26 is defined by the intersection of the longitudinally-extending third side 34 and the longitudinally-extending first roof contact side 28 and the predetermined second acute angle (β) between these sides is configured for placement facing up-roof closest to the second peak 39' or apex of the second sloped roof 36' with the longitudinally-extending first roof contact side 28 facing, and longitudinally-extending base member 150 and roof attachment member 15, such as cover layer 16, in pressing contact against the sloped roof 36 and the longitudinally-extending second core edge 26 substantially parallel or parallel to the peak. In this configuration, the predetermined second acute angle (β) may be selected to be the same as a second predetermined roof angle or pitch 38' (e.g., a 12/12 pitch) of the sloped roof 36, which in the case of a 12/12 pitch (45°) roof 36 means that the predetermined second acute angle (β) is also 45°, so that the longitudinally-extending third side 34 extends in the direction of the second peak 39' as a substantially horizontal or horizontal second platform, which advantageously provides a very useful substantially level or level longitudinally-extending third side working surface 33 on the second sloped roof 36' for use as described herein. As used herein, substantially parallel includes minor misorientations of the longitudinally-extending second core edge 26 with the line defined by the second peak 39' such that they are non-parallel, and third side 34 is not level, but rather substantially level although it may be slightly inclining or declining as compared to the second peak 39' of the second steeply sloped roof 36'. One of ordinary skill in the roofing arts will understand that substantially parallel orientations still provide a very advantageous and useful longitudinally-extending third side working surface 33 of longitudinally-extending third side 34 as compared to the alternative of using the second steeply pitched roof 36' as the working surface. One of ordinary skill in the roofing arts will also understand that when the orientation with the longitudinally-extending second core edge 26 at the intersection of longitudinally-extending third side 34 and longitudinally-extending first roof contact side 28 and defining predetermined second acute angle (β) is placed facing up-roof closest to the peak 39, and substantially parallel or parallel to the peak, that the lightweight composite roofing support system 10 also provides a very advantageous and useful longitudinally-extending third side working surface 33 (i.e. third side 34) for second sloped or pitched roofs 36' with a range of similar roof pitches that are greater than and less than the predetermined second acute angle (β) and the second predetermined roof angle or pitch 38' (e.g. a 12/12 pitch) as illustrated schematically in FIG. 61. In one embodiment, where the predetermined second acute angle (β) is 45° corresponding to a 12/12 second predetermined roof angle or pitch 38', the range of similar roof pitches may comprise, for example, a range of 16/12 to 9/12 (excluding 12/12), or more particularly 14/12 to 10/12 (excluding 12/12), even though the longitudinally-extending third side working surface 33 of longitudinally-extending third side 34 is only substantially horizontal, not completely horizontal, or level on these roofs. The slight inward or outward slope of the third side working surface 33 of the longitudinally-extending third side 34 for these roof pitches is still very advantageous and much preferred compared to working without the roof support system and using the roof surfaces of these steeply pitched roofs 36' as the working surface to support roofing loads 2, particularly in the case of roofing workers 6 trying to move, walk, stand, crouch, kneel, or sit on the roof as shown in FIG. 50. In one embodiment, the third side working surface 33 comprises a third side non-skid surface 63 over all, or a portion or portions, of the third side working surface 33. In one embodiment, the third side non-skid surface 63 comprises a third side surface texture or surface roughness, or a predetermined third side pattern, such as an embossed pattern, which may the same or different than the second side non-skid surface 61. The third side non-skid surface 63 may be formed by adding a non-skid material after molding or integrating a non-skid material or materials to the third side working surface 33 during molding, to provide a third side surface texture or pattern, or may be integrally formed in the core material 14 of the third side working surface 33 by molding the same into the surface as an embossed pattern. In one embodiment, the third side working surface 33 comprises a third side non-skid surface 63 comprising a plurality of integrally formed third side protrusions 65 projecting upwardly from the third side working surface 33 as third side protruding traction elements 66. The protrusions may have any suitable shape or profile as viewed from above, including various circular, rectangular, chevron, herringbone, or whorl shapes. In one embodiment, the third side protrusions 65 have a protruding rectangular shape and are disposed in an array or pattern comprising a plurality of spaced apart columns and rows and comprise a plurality of third side protruding traction bars or elements 66.

In one embodiment, even though the second side working surface 31 may incorporate second side non-skid surface 61 that may include second side protruding traction elements 62 and third side working surface 33 may incorporate third side non-skid surface 63 that may include third side protruding traction elements 66, these working surfaces are generally planar as defined by the surfaces of the respective protruding second side protruding traction elements 62 and protruding third side protruding traction elements 66 and only include features that enhance the working surface for use by a roofing worker 6 (e.g., enhance traction or provide a non-skid surface), including the ability to move, walk, stand, crouch, kneel, sit, or lie on the surface safely, and will not include raised elements or features that protrude above the third side non-skid surface 63 or third side protruding traction elements 66, such as raised trays or raised edges, or alternately recessed features, such as recessed trays or recessed features, that would make these surfaces non-planar and that one of ordinary skill in the art would understand to represent potential tripping or loss-of-balance hazards or otherwise comprise a safety hazard, since it is understood that the steeply sloped roofs 36 whereon use of lightweight composite roofing support systems 10 are particularly advantageous require the avoidance and/or elimination of all such hazards.

Figure 60:
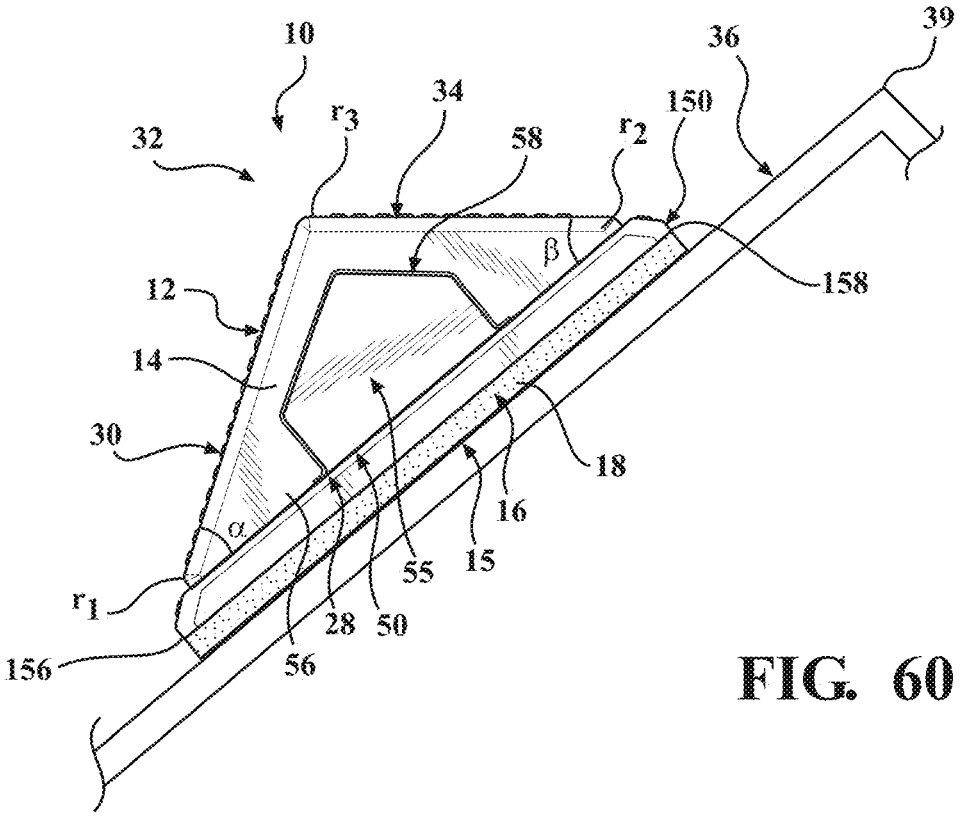
FIG. 60 is a side view of an embodiment of a roofing support system and roof support as disclosed herein illustrating an embodiment of a core member with an acute rounded triangular cross-section shape on a sloped roof with a roof pitch and the third side and third working surface facing upslope and providing a horizontal or substantially horizontal third working surface and a third side portable platform for support of a roofing worker or roofing load.

In one embodiment the longitudinally-extending core member 12 comprises a dual or double-wedge lateral cross-section 22 shape that is substantially uniform or the same along the longitudinal axis 9, and in other embodiments that is substantially uniform or the same along the longitudinal axis except in the regions proximate the opposed first core end 46 and second core end 56, which include first slot opening 40 and first handle or grip recess 45 and second slot opening 50 and second handle or grip recess 55, respectively (e.g., FIGS. 1-8). In one embodiment, the dual or double-wedge lateral cross-section 22 comprises a scalene triangular cross-section shape that is substantially uniform or uniform along the longitudinal axis 9, and in other embodiments is a scalene triangle that is substantially uniform or uniform along the longitudinal axis except in the regions proximate the opposed first core end 46 and second core end 56, which include first slot opening 40 and first handle or grip recess 45 and second slot opening 50 and second handle or grip recess 55, respectively, analogous to the manner illustrated in FIGS. 1-8, and as illustrated by second core end 56 shown in FIG. 60, which, for example, includes second slot opening 50 and second handle or grip recess 55, and has similar end features to those shown in FIGS. 1-8. The longitudinally-extending first roof contact side 28 is the hypotenuse of the scalene triangular cross-section shape and the shorter sides of the scalene triangle comprise the longitudinally-extending second side 30 and longitudinally-extending third side 34 as shown in FIG. 60.

In another embodiment, the lateral cross-section 22 comprises an irregular convex quadrilateral shape and/or trapezium shape (where none of the sides are of equal length) and/or a truncated scalene triangle (that is truncated proximate what would otherwise be the obtuse angle of the scalene triangle) that is substantially uniform or the same size along the longitudinal axis, and in other embodiments is substantially uniform or the same along the longitudinal axis except in the regions proximate the opposed first core end 46 and second core end 56, which include first slot opening 40 and first handle or grip recess 45 and second slot opening 50 and second handle or grip recess 55, respectively (e.g., FIGS. 1-8, 17, 26, 36 and 46). The longest side of the irregular convex quadrilateral and/or trapezium and/or truncated scalene triangle comprises the longitudinally-extending first roof contact side 28, and the sides adjacent to the longitudinally-extending first roof contact side 28 comprise the longitudinally-extending second side 30, and longitudinally-extending third side 34. The irregular convex quadrilateral and/or trapezium and/or truncated scalene triangle also comprises a longitudinally-extending fourth side 35 as shown in FIGS. 1-8, for example. In this embodiment, where the lateral cross-section 22 comprises an irregular convex quadrilateral and/or trapezium and/or truncated scalene triangle the longitudinally-extending fourth side 35 is not parallel to the longitudinally-extending first roof contact side 28. The longitudinally-extending fourth side 35 is generally not a working surface because of the rather extreme slope (e.g., FIGS. 58, 59), but rather a transition surface that extends between the second side 30 and the third side 34. However, in one embodiment, the fourth side 35 may optionally include a plurality of optional recesses or pockets 60 (e.g., FIG. 1) formed therein that may be used to temporarily hold and/or store any predetermined item, including various construction or roofing materials or equipment described herein, such as replacement nails for a nailing gun, for example. In one embodiment illustrated schematically in FIGS. 5 and 6, the dual or double-wedge lateral cross-section 22 shape may comprise a scalene trapezoidal shape and the longitudinally-extending fourth side 35' is parallel to the longitudinally-extending first side 28. While useful, a scalene trapezoidal lateral cross-section 22 generally reduces the width (w2 or w3) of the second side 30 or third side 34 and the respective size of the second side working surface 31 or third side working surface 33 as may be understood in FIGS. 5 and 6.

The longitudinally-extending core member 12 may have any suitable configuration and any suitable size. In one embodiment, the longitudinally-extending core member 12 has an integral one-piece configuration, which may be produced by molding or forming the core material 14 into the shape of the core member as illustrated in FIGS. 1-8, for example. While the size of the core member 12 may be characterized with regard to any of the sides thereof, in one embodiment, it is characterized by the size of the longitudinally-extending first contact side 28. The longitudinally-extending first contact side 28 may comprise any suitable length (I1) and width (w1). In one embodiment, the size may comprise a length (I1) that ranges from 20 to 144 inches, more particularly 24 to 72 inches, even more particularly 24 to 48 inches, and yet more particularly 24-36 inches. In one embodiment, the size may comprise a width (w1) that ranges from 18 to 48 inches, more particularly 20 to 40 inches, even more particularly 20 to 30 inches, and yet more particularly 22-28 inches. In one embodiment, the length (I1) is greater than the width (w1). In one embodiment, the second side length (I2) and third side length (I3) are the same as the first roof contact side length (I1), and the second side width (w2) and third side width (w3) will scale geometrically with the first roof contact side width (w1) and the selection of acute angles ($\alpha$) and ($\beta$) together with the position, including width (w4) and angulation from horizontal of longitudinally extending fourth side 35. In one embodiment, the length (I1) ranges from 24-48 inches, the width (w1) ranges from 17-36 inches, the second side length (I2) and third side length (I3) are the same as the first roof contact side length (I1), the second side width (w2) ranges from 8-18 inches, $\alpha$=39.81° (e.g., an 10/12 pitch), the third side width (w3) ranges from 8-18 inches, and $\beta$=45° (e.g., a 12/12 pitch).

The longitudinally-extending core member 12 may be formed from any suitable core material 14, including various metals, engineering thermoplastic or thermoset polymers, or composites thereof. In one embodiment, the core material 14 comprises a rigid or substantially rigid engineering thermoplastic or thermoset polymer. In one embodiment, the core material 14 comprises a rigid or substantially rigid engineering thermoplastic or thermoset polymer comprising polystyrene (PS), polyethylene (PE), polypropylene (PP), polyurethane (PU), or ethylene-vinyl acetate (EVA), or a combination thereof, and more particularly an expanded foam comprising polystyrene (EPS), polyethylene (EPE), polypropylene (EPP), polyurethane (EPU), or ethylene-vinyl acetate (EEVA), or a combination thereof, which, as used herein, includes chemical or physical combinations thereof, including copolymers thereof. In one embodiment, the core material 14 comprises a rigid or substantially rigid expanded foam of EPP having the properties set forth in FIG. 64, or another expanded polymer foam having properties within the ranges set forth in FIG. 64, more particularly a density, compressive strength, compression set, tensile strength, and flexural strength within the ranges set forth in FIG. 64. In one embodiment, the expanded foam comprises EPP or EEVA comprising a density of 1.25-12 lb./ft3, and more particularly 2-8 lb./ft3, and more particularly 3-7 lb./ft3, and yet more particularly 3-6 lb./ft3. In one embodiment, the core member 12 comprises EPP or EEVA having a density of 5 lb./ft3. The core member 12 may be molded as an integral or one-piece component to include all of the elements described herein by any suitable molding or forming method, including various conventional molding methods employed to mold rigid or substantially rigid engineering thermoplastic or thermoset polymers, particularly rigid or substantially rigid expanded engineering thermoplastic or thermoset polymer foams, including injection molding. In one embodiment, as used herein, a rigid or substantially rigid core material 14 may be defined by the material properties, particularly a compressive strength, compression set, tensile strength and flexural strength within the ranges set forth in FIG. 64. In another embodiment, as used herein, a rigid or substantially rigid core material may be defined as substantially non-compressible (i.e. experiences only a minor amount of elastic deformation) under a predetermined roofing load 2 (I), including less than 10% elastic deformation under the predetermined roofing load (I), more particularly less than 5% deformation, and even more particularly less than 1% deformation, and includes ranges of 0.1-10% deformation, more particularly 0.1-5% deformation, and even more particularly 0.1-3% deformation. In one embodiment, the predetermined roofing load 2 may include the weight of at least one person, which in one embodiment ranges from 100 to 350 lbs., or the weight of at least one bundle of shingles, which in one embodiment ranges from 40-80 lbs., or the weight of at least one roll of underlayment, which in one embodiment ranges from 16-100 lbs., or a combination thereof. In other embodiments, the predetermined roofing load 2 may include a plurality of the above items.

As illustrated in FIG. 60 in one embodiment, the roofing support system 10 and first roofing support 32 comprises a longitudinally-extending third side 34, and the dual or double-wedge shape lateral cross-section comprises a triangular lateral cross-section, including a generally or substantially scalene triangular lateral cross-section, with the longitudinally-extending third side 34 opposite the first predetermined angle ($\alpha$) formed by the convergence, including the intersection, of the longitudinally-extending third side 34 and the longitudinally-extending second side 30. As used herein, generally or substantially with reference to the cross-sectional shape includes embodiments where the converging sides do not actually intersect to form a vertex, but rather shapes that include one or more blunted edge or radii (e.g., r1, r2, r3 in FIG. 60) in place of the vertices (e.g., a blunted or rounded triangular shape), but where one of ordinary skill would readily recognize a generally or substantially triangular lateral cross-sectional shape or form.

Referring to FIGS. 1-17 and 58-62, particularly FIGS. 9-17, in one embodiment, the lightweight composite roofing support system 10 comprises a longitudinally-extending core member 12 comprising a core material 14 as described herein, a longitudinally-extending base member 150 comprising a base material 149, and a longitudinally-extending roof attachment member 15 comprising a roof attachment material or materials 17. The longitudinally-extending base member 150 and longitudinally-extending roof attachment member 15 are joined to one another and are selectively attachable to and detachable from the longitudinally-extending core member 12. The roof attachment member 15 is configured to attach the lightweight composite roofing support system 10 to a sloped roof 36. Because they are in intimate contact with the surface of sloped roof, and the surface of the sloped roof 36 and roofing materials 8 that comprise this surface during the construction or repair of the roof are generally quite abrasive, from the bare wood roof deck to the underlayment materials to the outermost roofing materials (e.g., asphalt or fiberglass shingles), and the roof attachment member 15 and/or the longitudinally-extending base member 150 are subject to wear and/or damage from impact or contact with roofing materials 8 or equipment as it is moved (e.g., slid, tossed, thrown, etc.) across the surface of the roof or moved from one roofing job site and roof type to another job site and roof type, the longitudinally-extending base member 150 and roof attachment member 15 are selectively attachable to and detachable from the core member 12 in order that they may be selectively removeable and replaceable with a new base member/roof attachment member as they become worn or damaged in use, or when the job requirements such as the roof type changes and it is desirable to change from one type of roof attachment member to another type of roof attachment member 15.

In one embodiment, the longitudinally-extending base member 150 comprising the base material 149 comprises a longitudinally-extending first core contact side 152 and an opposed longitudinally-extending base bottom side 154 comprising a longitudinally-extending first base edge 156 and an opposed longitudinally-extending second base edge 158. The first core contact side 152 comprises a flat planar surface and comprises a core attachment structure 160 disposed thereon that is configured for selective attachment to and detachment from the mating base attachment structure 72 of the core member 12. In one embodiment, the longitudinally-extending base bottom side 154 comprises a flat planar surface and is configured for disposition of the roof attachment member 15 thereon. The roof attachment member 15 is configured for contact with and adhesion to the outermost surface of a sloped roof 36. The core attachment structure 160 may comprise any structure or structural form or device or fastener mechanism or combination of fastener mechanisms configured to provide the selective attachment to and detachment of longitudinally-extending base member 150 and the roof attachment member 15 disposed thereon to the base attachment structure 72 of the core member 12, and vice versa. In one embodiment, the core attachment structure 160 comprises a plurality of base protrusions 162 or base recesses 74' (FIG. 63B), or a combination thereof, that is configured to receive the corresponding base attachment structure 72 that comprises a plurality of core recesses 74 or core protrusions 162' (FIG. 63B), or a combination thereof. The base protrusions 162 protrude from the first core contact side 152 and comprise a base protrusion sidewall 164 and base protrusion top 165. The base protrusions 162 may be disposed on the longitudinally-extending base member 150 in any suitable number and arrangement to provide for the selective attachment and detachment of the core member 12, including their size, shape (e.g., rail, pad, or the like) orientation (e.g., longitudinal, lateral, or otherwise), location (e.g., peripheral, central), base protrusion sidewall 164 features (e.g., barbed, interlocking, non-interlocking, interference fit, slip fit, and the like), and function (e.g., as retention, load-bearing, or a combination thereof). In one embodiment, the plurality of base protrusions 162 comprise a plurality of area or structural or load-bearing base protrusions 166 and a plurality of retention base protrusions 163 comprising longitudinally-extending retention base protrusions 168 and laterally-extending retention base protrusions 170. The base protrusions 162 may be disposed on the longitudinally-extending base member 150 and first core contact side 152 in any suitable number of each type of protrusion and in any suitable combination, pattern or arrangement of the various types of protrusions. In one embodiment, the load-bearing base protrusions 166 comprise two protrusions that are disposed centrally on first core contact side 152 in a longitudinally-extending, spaced apart array. As shown in FIGS. 9-17, the retention base protrusions 163, which comprise longitudinally-extending base protrusions 168 and laterally-extending base protrusions 170, are disposed peripherally about the load-bearing base protrusions 166 with the longitudinally-extending retention base protrusions 168 disposed along the opposed longitudinally-extending edges of the load-bearing base protrusions 166 and the laterally-extending retention base protrusions 170 disposed along the opposed lateral-extending edges of the load-bearing base protrusions 166 as well as across the central portion of first core contact side 152. The longitudinally-extending retention base protrusions 168 and laterally-extending retention base protrusions 170 may also be described as being disposed peripherally about the first core contact side 152. The longitudinally-extending retention base protrusions 168 are disposed along the longitudinally-extending first base edge 156 and opposed longitudinally-extending second base edge 158. The laterally-extending retention base protrusions 170 are disposed proximate the laterally-extending first base end 151 and opposed laterally-extending second base end 153 and also include one or more centrally disposed laterally-extending retention base protrusions 170 disposed between the load-bearing base protrusions 166. In one embodiment, three spaced apart longitudinally-extending retention base protrusions 168 extend along proximate the longitudinally-extending first base edge 156 and three spaced apart longitudinally-extending retention base protrusions 168 extend along proximate the longitudinally-extending second base edge 158. In this embodiment, one centrally disposed laterally-extending retention base protrusion 170 extends along proximate the laterally-extending first base end 151 and one centrally disposed laterally-extending retention base protrusion 170 extends along proximate the laterally-extending second base end 153 and one centrally disposed laterally-extending retention base protrusions 170 extends laterally between the load-bearing base protrusions 166. The base protrusions 162 and core recesses 72 are configured to engage one another in the manner and for the purposes described herein.

In one embodiment, the longitudinally-extending base member 150 further comprises a longitudinally-extending second base side 171 that extends upwardly from the first base edge 156 to the first core contact side 152 and an opposed longitudinally-extending third base side 173 that extends upwardly from the second base edge 158 to the first core contact side 152. The second base side 171 and opposed third base side 173 may each have any suitable shape and size, and in certain embodiments may comprise second vertical sidewall 167 or sidewall portion and an opposed third vertical sidewall 169 or sidewall portion. In one embodiment, the second base side 171 comprises a second tapered portion 172 tapering toward the longitudinally-extending base bottom side 154 and first base edge 156 at a first acute base angle (α') from the first core contact side 152. The second tapered portion 172 intersects the second vertical sidewall portion 167. The second tapered portion 172 comprises a second base side working surface 175. The third base side 173 comprises a third tapered portion 174 tapering toward the longitudinally-extending base bottom side 154 and second base edge 158 at a second acute base angle (β') from the first core contact side 152. The third tapered portion 174 intersects the third vertical sidewall portion 169. The third tapered portion 174 comprises a third base side working surface 177. In one embodiment, the second base side working surface 175 comprises a second base side non-skid surface 179 and the third base side working surface 177 comprises a third base side non-skid surface 181. The second base side non-skid surface 179 and the third base side non-skid surface 181 may comprise any suitable non-skid surfaces, including the types of non-skid surfaces described herein with regard to second side non-skid surface 61 and third side non-skid surface 63. In one embodiment, the second base side working surface 175 comprises a second base side non-skid surface 179 comprising a plurality of integrally formed second side traction elements 176 comprising second base side protrusions 178 projecting upwardly from the second base side working surface 175. In one embodiment, the third base side working surface 177 comprises a third base side non-skid surface 181 comprising a plurality of integrally formed third side traction elements 180 comprising third base side protrusions 182 projecting upwardly from the third base side working surface 177.

The longitudinally-extending base member 150 has a base thickness (tB). The base thickness (tB) may comprise any suitable thickness. In certain embodiments, the base thickness (tB) ranges from 1-8 inches, more particularly 1-5 inches, and even more particularly 1-4 inches. In one embodiment, the base thickness (tB) is about 1 inch, the second tapered portion 172 comprises second base side working surface 175 and second base side non-skid surface 179 that comprises an array of a single row of integrally formed second side traction elements 176 comprising second base side protrusions 178, and the third tapered portion 174 comprises third base side working surface 177 and third base side non-skid surface 181 that comprises an array of a single row of integrally formed third side traction elements 180 comprising third base side protrusions 182. In one embodiment, the first acute angle (α) of the core member 12 and first acute base angle (α') of the longitudinally-extending base member 150 are selected to be the same angle (e.g., 39.81°, corresponding to a first predetermined 10/12 pitch 38) and the second side working surface 31 of core member 12 and the second base side working surface 175 are co-planar working surfaces and the second base side working surface also comprises a generally flat, planar, continuous surface and acts as and comprises an extension of the second core side working surface 31. The slight discontinuity at the interface 188 between them along first core edge 24 does not detract from the generally flat, planar, continuous surfaces of second core side working surface 31 or second base side working surface 175 as it is not significantly raised or recessed from these surfaces and does not represent a stumbling or tripping hazard. Thus, the base thickness (tB) and the width of the second tapered portion 172 (wTP2) may be selected to determine the width (wTP2) of the second base side working surface 175 and the extent of the extension of the second side working surface 31. In the embodiment of FIGS. 9-17, the base thickness (tB) and the width of the second tapered portion 172 (wTP2) may be selected to provide an array of six rows of integrally formed second side traction elements 176 comprising second base side protrusions 178, which very advantageously significantly extends the size of the second side working surface 31. Similarly, in this embodiment, the second acute angle (β) of the core member 12 and second acute base angle (β') of the longitudinally-extending base member 150 are selected to be the same angle (e.g., 45°, corresponding to a second predetermined 12/12 pitch 38') and the third side working surface 33 of core member 12 and the third base side working surface 177 are co-planar working surfaces and the third base side working surface also comprises a generally flat, planar, continuous surface and acts as and comprises an extension of the third side working surface 33. The slight discontinuity at the interface 188 between them along second core edge 26 does not detract from the generally flat, planar, continuous surfaces of third core working surface 33 or third base side working surface 177 as it is not significantly raised or recessed from these surfaces and does not represent a stumbling or tripping hazard. Thus, the base thickness (tB) and the width of the third tapered portion 174 (wTP3) may be selected to determine the width of the third base side working surface 177 and the extent of the extension of the third side working surface 33. In the embodiment of FIGS. 9-17, the base thickness (tB) and the width of the third tapered portion 174 (wTP3) may be selected to provide an array of five rows of integrally formed third side traction elements 180 comprising third base side protrusions 182, which very advantageously significantly increases and extends the size of the third side working surface 33. The use of the longitudinally-extending base member 150 and the base thickness (tB) to extend the sizes of second side working surface 31 and third side working surface 33 extension very advantageously provide tremendous flexibility to the lightweight composite roofing support system 10 and the ability to accommodate roofing loads 2 of very different sizes and shapes, including a plurality of roofing workers 6 on a single roofing support 32, for example, by providing a working surface that is wide enough for workers to pass by one another as they move in a longitudinal direction along the roofing support 32. The maximum width of the second tapered portion 172 (wTP2) and the width of the third tapered portion 174 (wTP3) can easily be calculated using the base thickness (tB) and the first acute base angle (α') and the second acute base angle (β'), respectively, as wTP2=tB/sin α' and wTP3=tB/sin β'.

The longitudinally-extending base member 150 may comprise any suitable base material 149. In one embodiment, the base material 149 may comprise and be selected from any of the core materials 14 described herein. In one embodiment, the base material 149 comprises the same material as the core material 14, and the base material may be selected to have the same properties (e.g., properties described in FIG. 64) as the core material or different properties, including properties that are greater than, equal to, or less than those of the core material. In one embodiment, the base material 149 has a density that is less than or equal to the density of the core material 14, and in another embodiment has a density that is greater than the density of the core material 14. In one embodiment, the core material 14 and the base material 149 comprise a rigid or substantially rigid engineering thermoset or thermoplastic polymer and the roof attachment member 15 comprises a resiliently compressible cover layer 16 comprising a cover material 18 comprising a resiliently compressible polymer foam. In one embodiment, the core material 14 comprises EPP and the base material 149 comprises EPP having a density that is less than or equal to the density of the core material 14. In one embodiment, the core material 14 comprises EPP having a density in the range of 5-7 lb./ft3, more particularly 5-6 lb/ft3, and more particularly 5 lb/ft3, and the base material 149 comprises EPP having a density of 3-5 lb/ft3, more particularly 3-4 lb/ft3, and more particularly 3 lb./ft3. In one embodiment, the base material 149 comprises a different material than the core material 14, more particularly a different material than the core material 14 selected from the core materials disclosed herein.

The longitudinally-extending base member 150 may have any suitable size and shape, including the shapes described and illustrated herein. In one embodiment, the longitudinally-extending base member 150 comprises a longitudinally-extending member with an irregular hexagonal cross-sectional shape as described herein and as may be understood from the side views FIGS. 12 and 13, for example. In certain embodiments, the first core contact side 152 is a generally flat planar side except for the core attachment structure 160 disposed thereon and closely corresponds to the size and shape (e.g., rectangular or rounded rectangular) of first roof contact side 28, including one embodiment in which the length (IB1) and width (wB1) of the first core contact side are the same as the length (I1) and width (w1) of the first roof contact side and the shapes are the same. The size and shape of the longitudinally-extending base bottom side 154 may have any suitable size and shape, including the sizes and shapes described and illustrated herein. In one embodiment, the length of the longitudinally-extending base bottom side 154 is the same as the length (I1) of the first roof contact side 28 and the maximum width of the base bottom side can easily be calculated using the width (w1), base thickness (tB), the first acute base angle ($\alpha'$), the second acute base angle ($\beta'$), respectively, as $wBB=w1+tB/\tan\alpha'+tB/\tan\beta'$.

Figure 10:
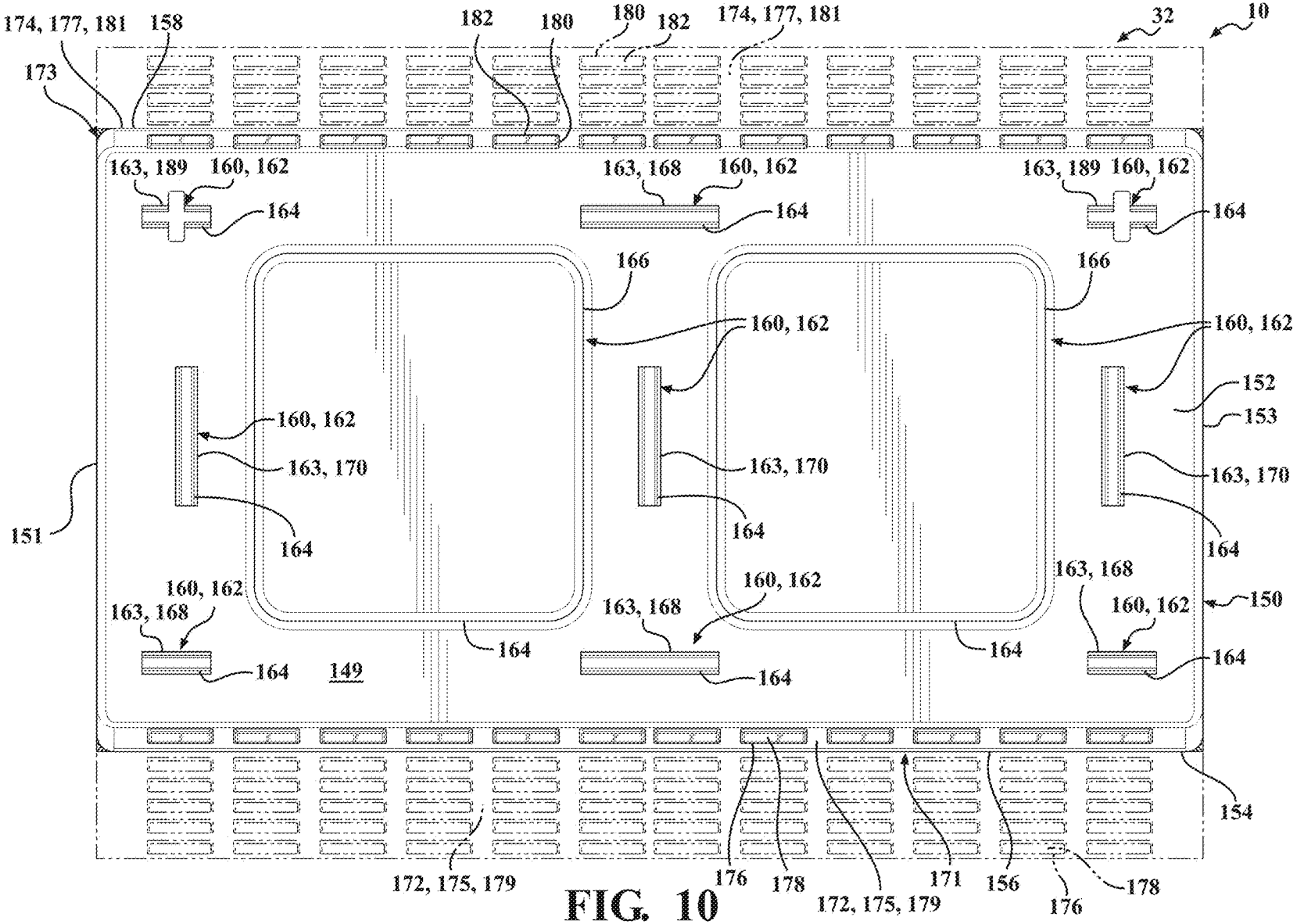
FIG. 10 is a top view of the roofing support system and roof support of FIG. 9.
Figure 11:
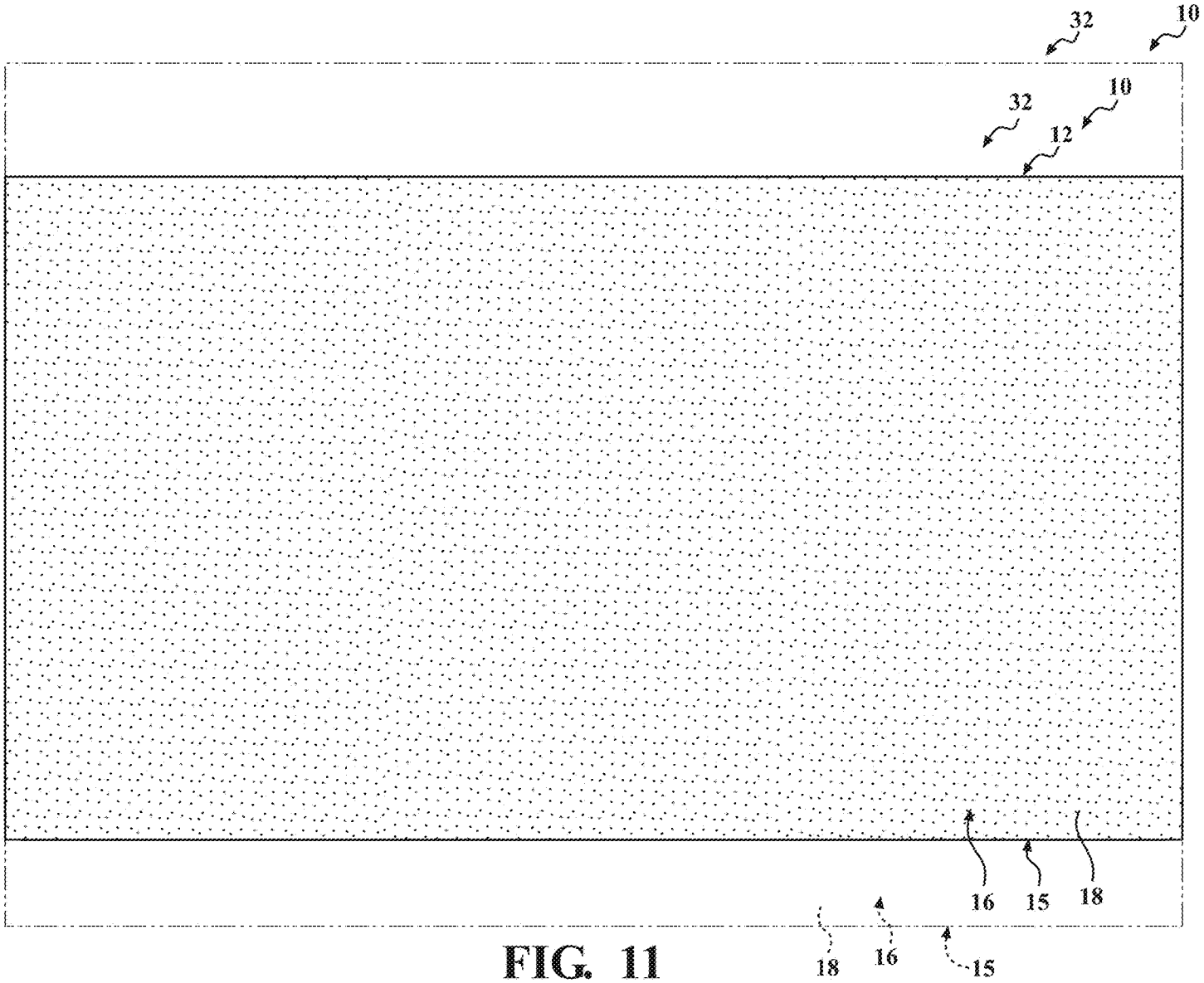
FIG. 11 is a bottom view of the roofing support system and roof support of FIG. 9.
Figure 12:
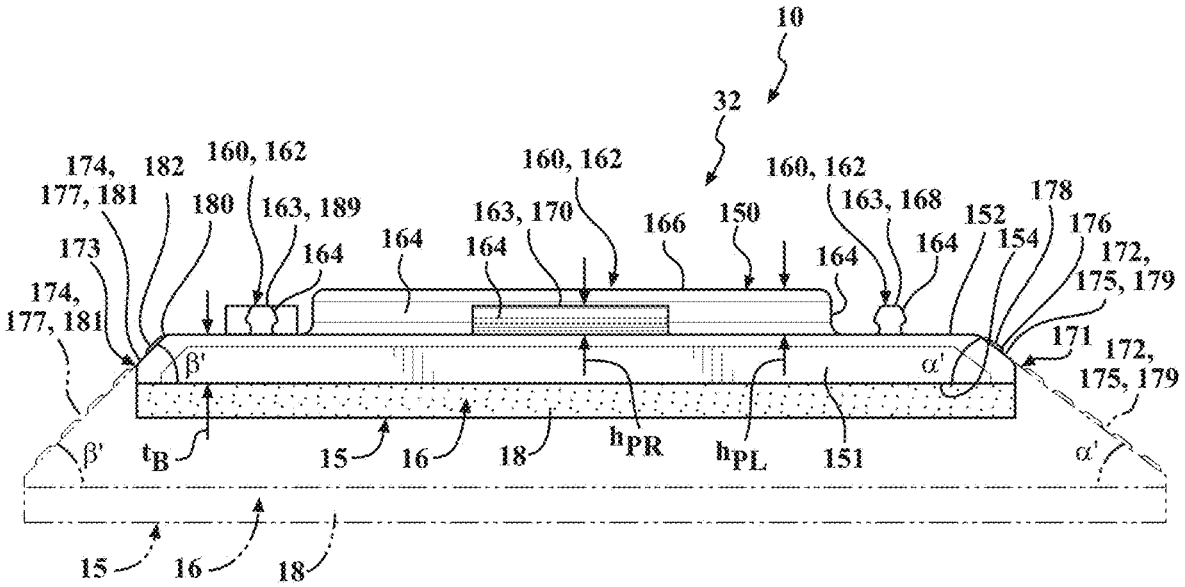
FIG. 12 is a left side view of the roofing support system and roof support of FIG. 9.
Figure 13:
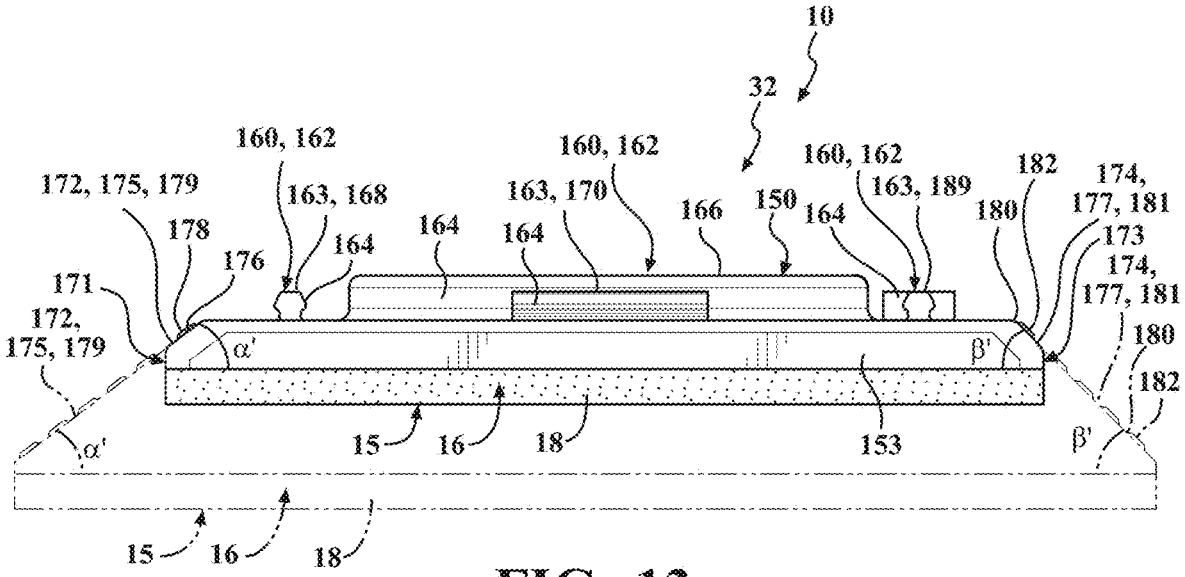
FIG. 13 is a right side view of the roofing support system and roof support of FIG. 9.
Figure 14:
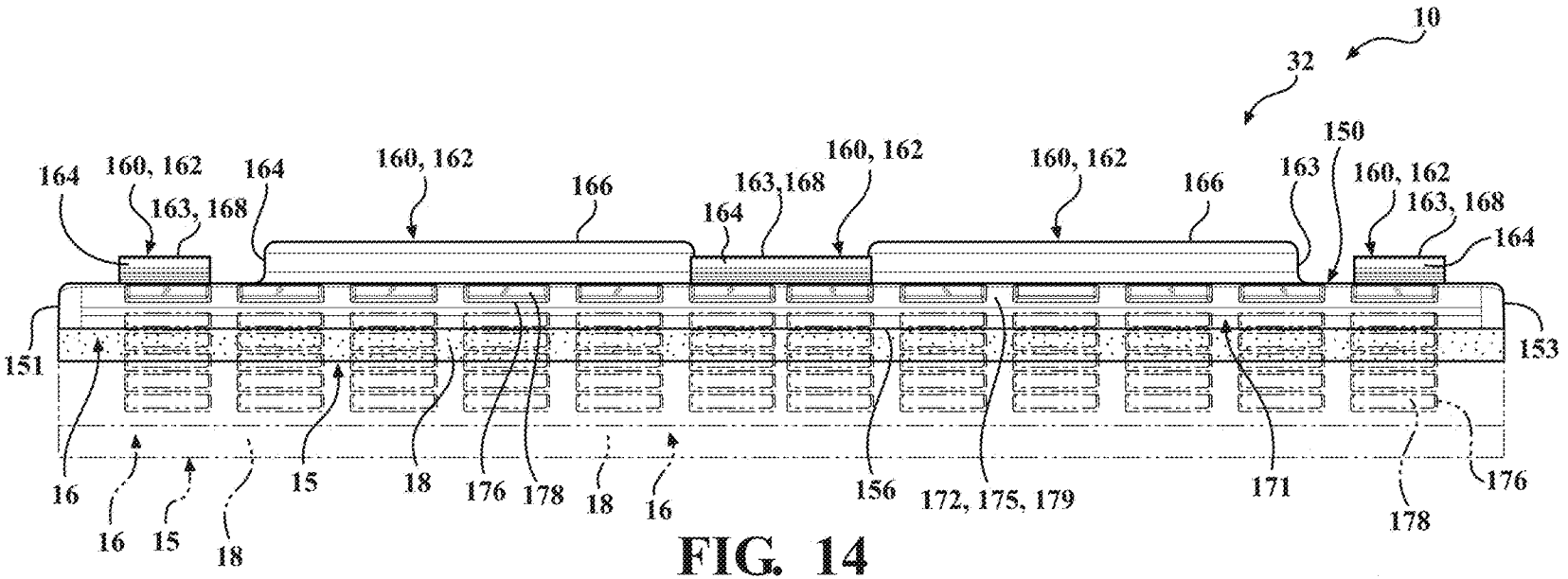
FIG. 14 is a front view of the roofing support system and roof support of FIG. 9.
Figure 15:
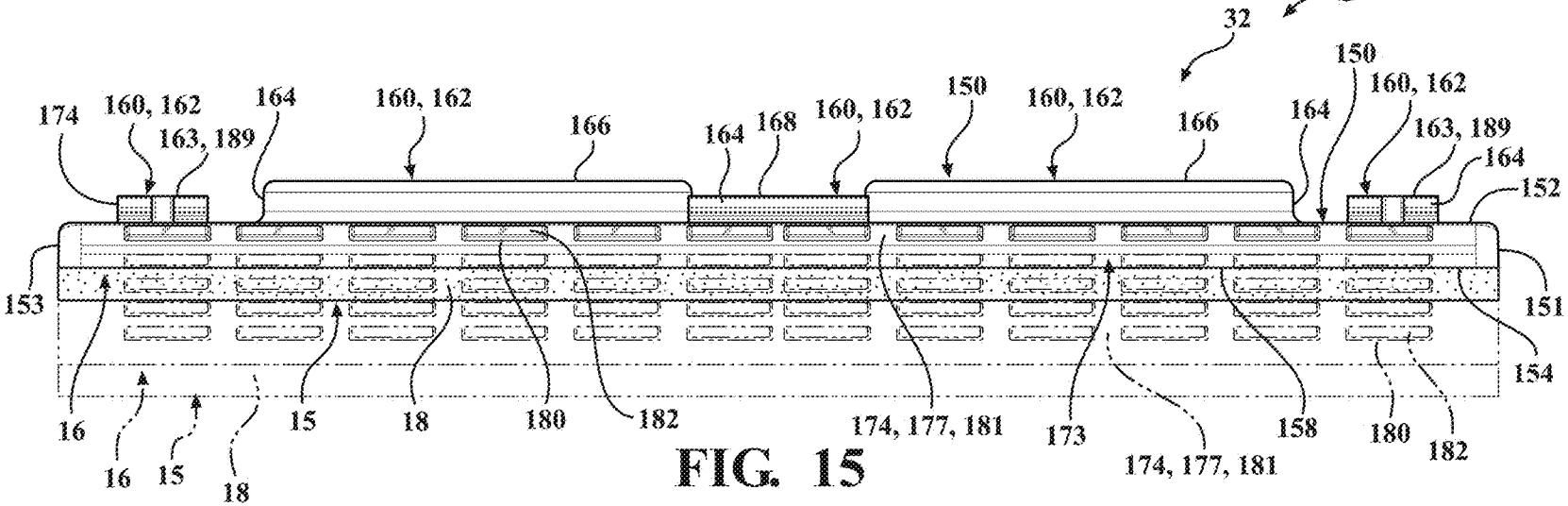
FIG. 15 is a rear view of the roofing support system and roof support of FIG. 9.
Figure 16:
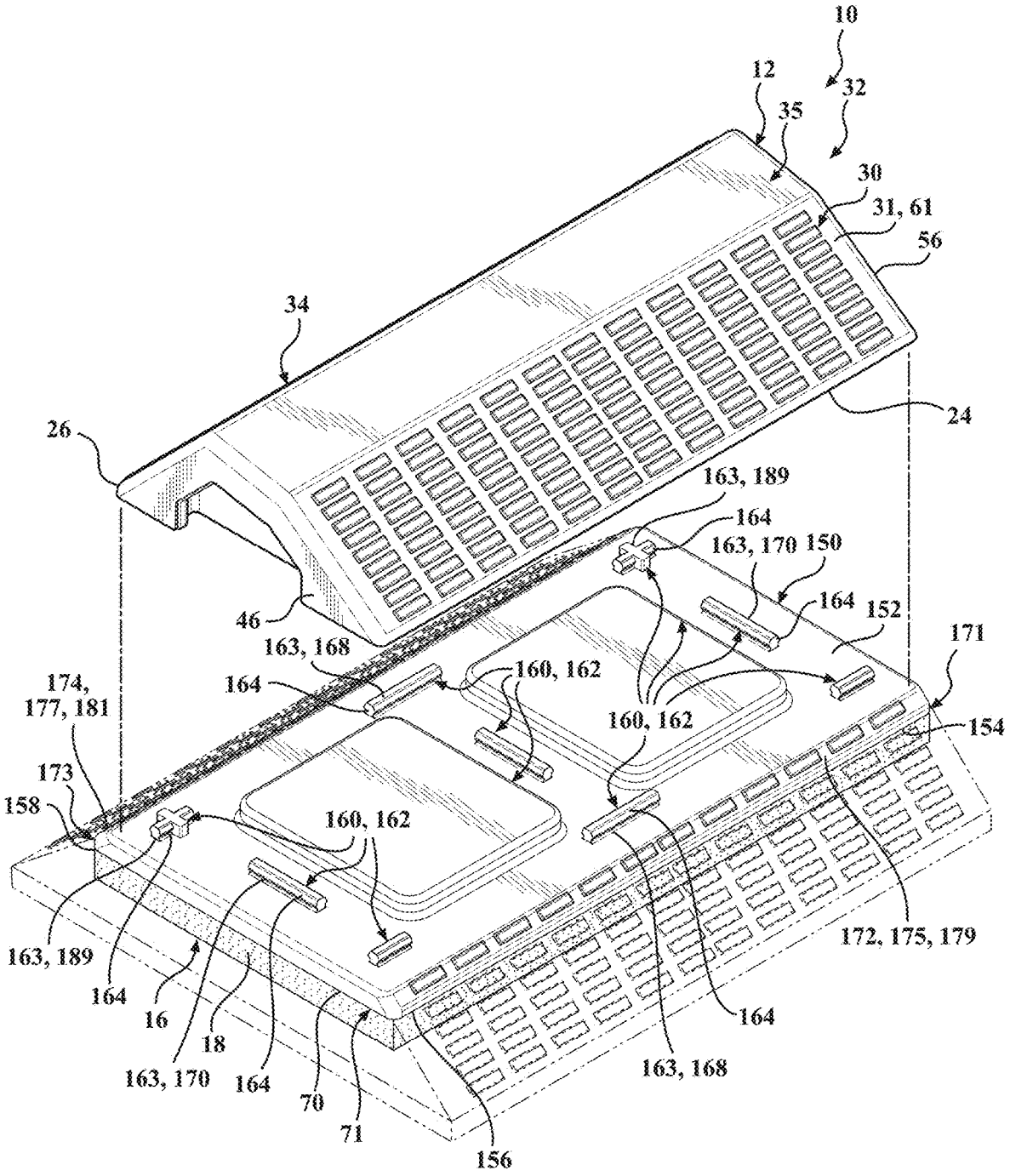
FIG. 16 is an exploded top perspective view of an embodiment of a roofing support system and roof support as disclosed herein comprising a core member and the selectively attachable and detachable base member and roof attachment member of FIG. 9 in a selectively detached position and condition.

Referring to FIGS. 1-17 and 58-62, particularly FIGS. 9-17, in one embodiment, the lightweight composite roofing support system 10 comprises a longitudinally-extending core member 12 comprising a core material 14 as described herein, a longitudinally-extending base member 150 that is selectively attachable to and detachable from the first roof contact side 28 of the core member 12, and a longitudinally-extending roof attachment member 15 that comprises a resiliently compressible cover layer 16 comprising a resiliently compressible cover material 18 that is disposed on and covering the bottom side 154 of the longitudinally-extending base member 150. In one embodiment, the longitudinally-extending core member 12, longitudinally-extending base member 150, and longitudinally-extending roof attachment member 15 comprising the longitudinally-extending resiliently compressible cover layer 16 comprise a lightweight composite roofing support system 10 and a first roofing support 32. As used herein, the term "covering" in the context of the longitudinally-extending resiliently compressible cover layer 16 covering the longitudinally-extending base bottom side 154 comprises covering all or any portion of the longitudinally-extending base bottom side. The term "covering" includes in certain embodiments covering at least a portion of the longitudinally-extending base bottom side 154, and in certain other embodiments includes covering all or substantially all of longitudinally-extending base bottom side 154, and in certain other embodiments may extend outwardly beyond the edges of the longitudinally-extending base bottom side 154, such as, for example, extending slightly outwardly of the longitudinally-extending base bottom side 154, including in the corners as shown in FIG. 10, for example.

The lightweight composite roofing support system 10 and roofing support 32 also comprises a roof attachment member 15. The roof attachment member 15 may comprise any suitable attachment member configured to provide secure attachment of the lightweight composite roofing support system 10 and roofing support 32 to the sloped roof 36, particularly secure attachment to the roofing material 8 that comprises the outermost surface of the sloped roof. The roof attachment member 15 may, for example, be selected to provide secure attachment as a function of the roofing material 8, including the surface morphology or roughness of the roofing material, that comprises the outermost surface or outermost layer of the sloped roof 36, which roofing material may also vary as a function of the stage of construction of the roof from the initial structural layers of dimensional lumber, plywood, OSB, and the like, to intermediate underlayment materials of various types of rolled roofing (e.g., tar paper, various polymers, natural or synthetic rubbers frequently referred to as snow and ice shield materials, and the like), to the outermost surface materials that comprise asphalt or fiberglass shingles (e.g., a base mat of organic material (e.g., cellulose fibers) or inorganic material (e.g., glass fibers) that is saturated and coated with asphalt and then surfaced with ceramic-coated opaque mineral granules), glass, ceramic, wood (e.g., cedar shakes), metal (e.g., coated steel, copper, and the like), and polymers (e.g., plastic sheet).

In one embodiment, the roof attachment member 15 comprises a longitudinally-extending resiliently compressible cover layer 16 comprising any suitable resiliently compressible cover material 18. The roof attachment member 15 comprising a longitudinally-extending resiliently compressible cover layer 16 may be used on any of the roofing materials 8 described herein, including those associated with all of the stages of roof construction described herein. In one embodiment, the resiliently compressible cover material comprises a resiliently compressible elastomer, including thermoset and thermoplastic elastomers. In one embodiment, the resiliently compressible cover material comprises a resiliently or reversibly compressible polymer, including a resiliently compressible polymer foam, and including a resiliently or reversibly compressible elastomeric foam. The resiliently or reversibly compressible elastomeric foam may include resiliently or reversibly compressible thermoset and/or thermoplastic elastomeric foam and may include both open-cell and closed-cell foam. In one embodiment, the cover material 18 comprises a resiliently or reversibly compressible polymer, such as a resiliently or reversibly compressible elastomeric foam, and comprises polyurethane (PU), polystyrene (PS), polyisocyanurate (PIR), polyethylene (PE), polypropylene (PP), poly(ethylene-vinyl acetate) (EVA), poly(vinyl chloride) (PVC), or a natural or synthetic rubber, silicone, or a combination thereof which, as used herein, includes chemical or physical combinations thereof, including copolymers thereof. In one embodiment, the polyurethane (PU) foams may include both open-cell and closed-cell polyether polyurethane and polyester polyurethane foams. In one embodiment, the cover material 18 comprises a resiliently or reversibly compressible open-cell polyether polyurethane foam. In one embodiment, the cover material 18 comprises a viscoelastic, low-resilience, foam or memory foam, particularly various polyurethane (PU) memory foams. In one embodiment, the resiliently compressible cover material comprises a resiliently or reversibly compressible foam comprising a flexible foam, particularly a flexible polyurethane foam (FPF). In one embodiment, the cover material 18 comprises a resiliently or reversibly compressible flexible open-cell polyether polyurethane foam (FPF) having properties within the ranges specified in FIG. 65, or other resiliently or reversibly compressible open-cell foam having properties within the ranges specified in FIG. 65.

In one embodiment, the resiliently compressible cover material 18 may be selected as a function of the material comprising the surface of the sloped roof 36. In one embodiment, in the case of sloped roofs comprising asphalt and plastic rolled roofing materials, asphalt or fiberglass shingles, wood (e.g., cedar shakes), which generally have high surface roughness and high abrasiveness, the cover material 18 may comprise a resiliently compressible polymer foam, such as a flexible open-cell polyether polyurethane foam (FPF) as described herein. In another embodiment, in the case of sloped roofs comprising ceramic shingles or tiles, metal sheets, glass sheets, and polymer sheets, which generally have low surface roughness and low abrasiveness, the cover material 18 may comprise a resiliently compressible polymer or polymer foam, such as natural or synthetic rubber and rubber foam, as well as silicone and silicone foam. In another embodiment, in the case of sloped roofs comprising shingles, tiles, sheets, or panels comprising ceramic, metal, glass, and polymer, which generally have low surface roughness and low abrasiveness, the cover material 18 may comprise a resiliently compressible polymer or polymer foam, such as natural or synthetic rubber and rubber foam, as well as silicone and silicone foam. In another embodiment, in the case of sloped roofs comprising shingles, tiles, sheets, or panels comprising ceramic, metal, glass, and polymer, which generally have low surface roughness and low abrasiveness, but which have been formed to include a shape or texture of another material (e.g., glass solar tiles or shingles formed to resemble scalloped ceramic tiles or natural slate tiles, or cedar shakes), the cover material 18 may comprise a resiliently compressible composite such as an upper layer of a resiliently compressible polymer foam as described herein, such as a polyurethane foam, which may be relatively thicker, attached to a lower layer (i.e. roof contact layer) of a resiliently compressible polymer or polymer foam, such as natural or synthetic rubber or rubber foam, as well as silicone and silicone foam, which may be relatively thinner. The composite provides an upper foam to enable conformity to the shape and larger texture features of the roof material (e.g., the shape of a curved or scalloped tile or flat with texture variation like a slate tile) and a lower layer of resiliently compressible polymer or polymer foam, such as natural or synthetic rubber and rubber foam, as well as silicone and silicone foam to ensure adhesion to the surface (e.g., glass).

The resiliently compressible cover layer 16 may comprise any suitable shape and size, including in the embodiment of FIGS. 9-17, substantially the same or the same shape and size (e.g., area) as the longitudinally-extending base bottom side 154, and in other embodiments (not shown) a different size and shape as described herein. In one embodiment, the resiliently compressible cover layer 16 comprises a rectangular shape, which includes various rounded rectangular shapes, and comprises the same length and width, including the same ranges of length and width, disclosed herein for the longitudinally-extending base bottom side 154. The cover layer 16 may have any suitable thickness. In one embodiment, the resiliently compressible cover layer 16 has a thickness in the range of 0.020 to 2.5 inches, more particularly 0.5 to 1.5 inches, more particularly 0.5 to 1.0 inches.

In the embodiment of FIGS. 1-17, the longitudinally-extending core member 12 extends in the direction of axis 9, and the longitudinally-extending base member 150 and longitudinally-extending resiliently compressible cover layer 16 are configured to be attached to the core member. The longitudinally-extending resiliently compressible cover layer 16 may be attached to longitudinally-extending base bottom side 154 by any suitable cover layer attachment or attachment mechanism, including in one embodiment an adhesive 70 disposed between them to form an adhesive joint 71 as the attachment. Any suitable adhesive 70 may be used as the adhesive to form the adhesive joint 71, including those that are configured to provide a physical bond, or a chemical bond, or both, between the longitudinally-extending cover layer 16 and longitudinally-extending base bottom side 154. In one embodiment, the adhesive 70 comprises a hot-melt adhesive, particularly a formulated hotmelt adhesive that is designed for adhesion to hard-to-adhere substrates that has a medium set speed, high heat resistance, and excellent low temperature bond performance, such as ADH, Hot Melt Adhesive M535-100N.1 sold by Sonoco®. The adhesive 70 may be applied in any suitable conventional manner and method to the upper surface of the longitudinally-extending cover layer 16 and/or to the longitudinally-extending base bottom side 154, including in one embodiment as a layer that covers the entirety of one or both of these surfaces, and including in another embodiment as a pattern of adhesive applied to one or both of these surfaces as described herein. The longitudinally-extending resiliently compressible cover layer 16 and resiliently compressible cover material 18 may also be attached by being molded directly onto the longitudinally-extending base member 150 and base material 149, or vice versa, such as by co-molding where both elements are formed in a single mold, or by insert molding where one of the elements is formed separately and inserted into a mold for molding of the other element onto it, and the attachment comprises an integrally molded joint comprising a physical and/or chemical bond formed at the interface between them, analogous to the adhesive joint 71. The attachment, such as an adhesive joint 71 or molded joint, will have an adhesive shear strength that is greater than the shear forces at the interface between the longitudinally-extending cover layer 16 and the longitudinally-extending base bottom side 154 upon application of a roofing load 2 as described herein.

In one embodiment, the longitudinally-extending base member 150 may be configured to receive a plurality of different longitudinally-extending cover layers 16 and cover layer materials 18. In one embodiment, the longitudinally-extending cover layers 16 and cover materials 18 may be configured to provide adhesion for use of the lightweight composite roofing support system 10 on a plurality of different slope or pitched roof 36 types, including different roof decks comprising different deck materials, such as wood (e.g. OSB, plywood, or cedar shakes), various asphalt, plastic, or rubber rolled roofing materials, asphalt or fiberglass shingles, plastic/composite/ceramic shingles or tiles, metal sheets, glass sheets, polymer sheets and other conventional roofing materials, as well as the glass surface of various solar shingles and panels.

The selectively attachable and detachable longitudinally-extending base member 150 and roof attachment member 15, such as cover layer 16, enables the lightweight composite roofing support system 10 to include kitting of a plurality of replacement base members 150 and cover layers 16, either with or without the core member 12, to extend the service life of the lightweight composite roofing support system 10 by selectively removing base members 150/cover layers 16 as they become worn in use and replacing the worn longitudinally-extending base member 150/cover layer with a new longitudinally-extending base member 150/cover layer 16 from the kit.

Figure 62:
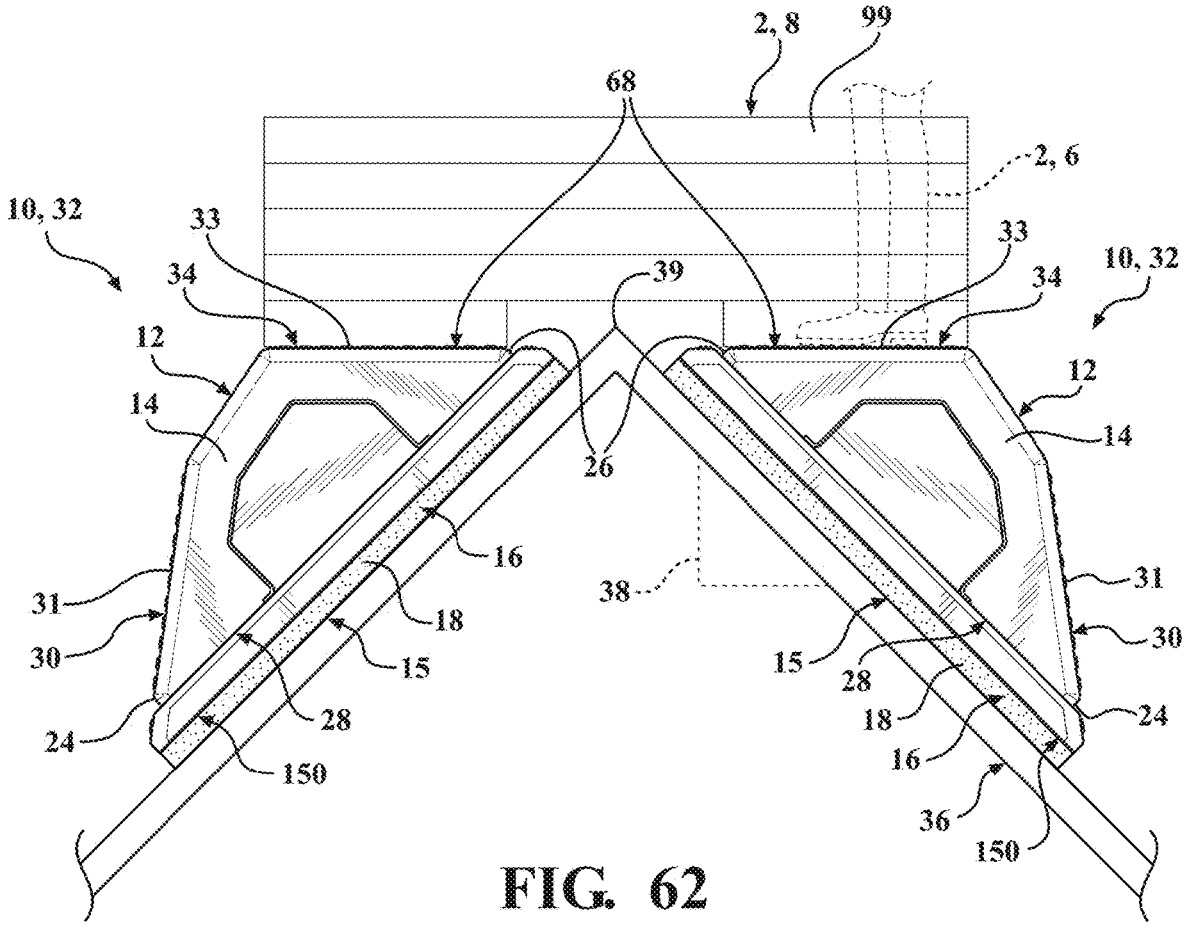
FIG. 62 is a schematic side view of two roofing support systems and roof supports (e.g., FIG. 9) in use on a sloped roof with a roof pitch disposed proximate and on opposing sides of the roof peak with the third sides and third working surfaces facing upslope and providing a horizontal or substantially horizontal third working surfaces and a peak platform for support of a roofing worker or roofing load at the roof peak.

As shown in FIG. 62, in one embodiment the lightweight composite roofing support system 10 further includes a two roofing supports 32 that are substantially identical and may include the features in the embodiments described above. The roofing supports 32 may be positioned on opposite sides of the peak 39 of a sloped roof as mirror images of one another with the longitudinally-extending second core edges 26 of the wedges facing one another with their respective longitudinally-extending first roof contact sides 28, longitudinally-extending second sides 30, and longitudinally-extending third sides 34 all facing in the same directions. When placed in the positions shown proximate the peak 39 of a sloped roof 36, the lightweight composite roofing support system 10 comprising a plurality of opposed roofing supports 32 may be very advantageously used to provide a peak platform 68 that may be used by roofing workers 6, or to store the roofing materials 8, as described herein, such as a plurality of bundles of shingles 99, proximate the roof peak 39. A peak platform 68 is very desirable and advantageous location for storage of roofing materials 8 as they can be easily distributed downslope to roofing workers 6 that are progressively applying these materials upslope generally from the eaves to the peak 39 of a sloped roof 36. A peak platform 68 is also very desirable as it provides a stable platform at the roof peak 39 for vendors of roofing materials 8 to use automated equipment to lift the materials to and unload the materials on the roof peak, without the need to manually unload the materials and make makeshift platforms at the roof peak generally using the construction materials themselves and make makeshifts or temporary platforms (e.g., using bundles of shingles), so that the roofing materials are available for distribution downslope during the construction of the sloped roof.

In one embodiment, the pressing engagement of the core member 12, longitudinally-extending base member 150 including longitudinally-extending base bottom side 154, and the attached longitudinally-extending cover layer 16 is sufficient to secure or attach the lightweight composite roofing support system 10 to the sloped roof 36 and prevent the system and a roofing load 2 (once applied) from sliding down the sloped roof 36 without the use of fasteners.

Referring to FIGS. 18-26, in one embodiment, the lightweight composite roofing support system 10 comprises a longitudinally-extending core member 12, longitudinally-extending base member 150, and roofing attachment member 15, such as longitudinally-extending resiliently compressible cover layer 16. The longitudinally-extending resiliently compressible cover layer 16 comprises a plurality of resiliently compressible cover layers 16 of resiliently compressible cover materials 18, which may be the same cover material 18 differing in some aspect, such as a material property or characteristic (e.g., thickness, density, or the like), or different cover materials 18. While described with reference to FIGS. 18-26, this embodiment of cover layers 16 and cover materials 18 may be used in any of the embodiments of lightweight composite roofing support system 10 described herein in FIGS. 1-63B. A plurality of resiliently compressible cover layers 16 and resiliently compressible cover materials 18 may be employed, for example, to provide variable or different material properties at different locations on longitudinally-extending base bottom layer 154. For example, during construction, the surface of sloped roofs 36 may be very abrasive, from the innermost portion comprising a dimensional lumber, plywood and/or OSB roof deck to the outermost portion comprising asphalt or fiberglass shingles, and it may be desirable to employ a different resiliently compressible cover material 18 in the higher wear areas of the cover layer 16, such as the areas proximate the laterally-extending first base end 151 and/or opposed laterally-extending second base end 153, or along all or a portion of the longitudinally-extending first base edge 156 and/or the longitudinally-extending second base edge 158, since the edges associated with these locations may experience more abrasion and wear as the roof supports 32 are moved (e.g. lifted up and down, dragged, tossed, thrown, slid, scraped, etc.) because they frequently are the last point of prior contact and the first point of new contact or impact during a move of the roof supports. Any of the resiliently compressible cover materials 18 described herein may be used to provide a plurality of resiliently compressible cover layers 16 of resiliently compressible cover materials 18. Thus, for example, in one embodiment, it is desirable to place one resiliently compressible cover layer 16 of resiliently compressible cover material 18 with higher wear resistance in the locations that are subject to higher wear (e.g., high wear areas), and another resiliently compressible cover layer 16 of resiliently compressible cover material 18 at other locations that are subject to lower wear (e.g., low wear areas). In one embodiment, for example, the cover layer 16 comprises a plurality of resiliently compressible cover layers 16 comprising a first resiliently compressible cover layer 16' comprising a first resiliently compressible cover material disposed in a central portion of the first roof contact side and second resiliently compressible cover layers 16" comprising second resiliently compressible cover materials 18" disposed proximate the first base end 151 and the opposed laterally-extending second base end 153 that are different from the first resiliently compressible cover material 18'. The difference in the first and second cover layers 16', 16" and first and second cover materials 18', 18" may be any measurable difference in the cover materials, including the density, the thickness, the wear resistance, the coefficient of sliding friction on the roof deck material, the cell type (e.g., closed-cell, and open-cell), the cell size or porosity, a physical property (e.g., elastic modulus, tensile strength, compressive strength, compression set, indentation force deflection (IFD), flex fatigue, tear resistance, or the like). In one embodiment, the first resiliently compressible cover layer 16' comprising the first resiliently compressible cover material 18' has a first thickness and comprises polyurethane (PU) and the second resiliently compressible cover layers 16" and second resiliently compressible cover materials 18" have a second thickness (t2) that is less than or equal to the first thickness and comprises polyurethane (PU), poly(ethylene-vinyl)acetate (EVA), natural rubber, or synthetic rubber, or a combination thereof.

Referring to FIGS. 27-46, in one embodiment, the lightweight composite roofing support system 10 comprises a longitudinally-extending base member 150 as described herein and a roof attachment member 15 comprising a plurality of spaced apart, laterally-extending rails 190 disposed on the longitudinally-extending base bottom side 154 of the base member. The laterally-extending rails 190 may extend laterally to any suitable extent or length, including outwardly beyond the longitudinally-extending first base edge 156 and longitudinally-extending second base edge 158. In one embodiment, the laterally-extending rails 190 extend laterally from the longitudinally-extending first base edge 156 to the longitudinally-extending second base edge 158. In one embodiment, the laterally-extending rails 190 have the same length and cross-sectional shape. In one embodiment, the laterally-extending rails 190 comprise a rectangular cross-sectional shape.

In one embodiment, the lightweight composite roofing support system 10 comprising longitudinally-extending base member 150 that comprises laterally-extending rails 190 is configured for use on a metal sloped roof 36 that comprises a plurality of longitudinally spaced apart (along the peak 39) upwardly protruding and laterally-extending standing (e.g., standing proud of the other portions of the metal roof panel) seams and the laterally-extending rails 190 are spaced apart along the longitudinally-extending base bottom side 154 by a distance (dS) that enables the rails to straddle a seam or a plurality of seams with the rails having a rail height (hR) that is greater than the height of the seam(s) so that the longitudinally-extending base bottom side 154 is elevated by the rails above the seam(s) by an amount sufficient to ensure that any height variations in the standing seams will be accommodate and avoid interaction with the longitudinally-extending base bottom side 154. In one embodiment, the rail height (hR) is 0.5 to 2 inches greater than the standing seam height, more particularly 0.75 to 1.5 inches greater than the standing seam height. For example, in one embodiment, where the range of the height of the standing seams ranges from 1-3 inches, the rail height (hR) may range from 1.5 to 5 inches, and more particularly 1.75 to 4.5 inches.

The laterally-extending rails 190 may be disposed on the longitudinally-extending base bottom side 154 in any suitable position or location to provide a spacing distance (dS) that enables the rails to straddle a seam or a plurality of seams with the rails having a rail height (hR). In one embodiment, the longitudinally-extending base member 150 comprises a first base end 151 and an opposed laterally-extending second base end 153, and the laterally-extending rails 190 comprise two laterally-extending rails, namely, a first laterally-extending rail 191 and a second laterally-extending rail 193. The first laterally-extending rail 191 is disposed inwardly of the first base end 151 and the second laterally-extending rail 193 is disposed inwardly of the laterally-extending second base end 153 as shown in FIGS. 27-36. In another embodiment, the longitudinally-extending base member 150 comprises a first base end 151 and an opposed laterally-extending second base end 153, and the laterally-extending rails 190 comprise two laterally-extending rails, namely, a first laterally-extending rail 191 and a second laterally-extending rail 193. The first laterally-extending rail 191 is disposed proximate the first base end 151 and the second laterally-extending rail 193 is disposed proximate the second base end 153 as shown in FIGS. 37-46.

In the embodiments of FIGS. 27-46, the first laterally-extending rail 191 comprises a rectangular cross-sectional shape defined by a first rail outer side 194 that extends vertically by the rail height (hR) from the longitudinally-extending base bottom side 154 to a first rail bottom side 195, the first rail bottom side 195, and an opposed first rail inner side 196 that also extends vertically by the rail height (hR) from the longitudinally-extending base bottom side 154 to the first rail bottom side 195. The first laterally-extending rail 191 comprises at least one first magnet recess 201 formed in the first rail bottom side 195, and in certain embodiments comprises a plurality of first magnet recesses 201. At least one first permanent magnet 200 is disposed in the first magnet recess 201, and in embodiments where a plurality of first magnet recesses 201 are employed, a corresponding plurality of first magnets 200 are disposed in the first magnet recesses 201. The first permanent magnet or magnets 200 may have any suitable size and shape, including various closed curve and polygonal shapes, such as circular, elliptical, triangular, and rectangular shapes. In one embodiment, the first permanent magnet or magnets 200 may comprise cylindrical disks or pucks having a diameter of 2-5 inches and a thickness of 0.5 to 1.5 inches and the first magnet recesses 201 are cylindrical with a diameter that is slightly greater than to slightly less than the diameter of the first permanent magnets 200 and will provide, respectively, touching contact or an interference fit of the magnets in the recesses. The first permanent magnets 200 may also be attached within the first magnet recesses 201 by a separate attachment, such as a peripheral and/or bottom side glue joint or a fastener. The first rail bottom side 195 has a first width (wR) sufficient to accommodate the sizes and shapes of the first magnet recesses 201 and first permanent magnets 200, which in one embodiment may range from 4-10 inches, more particularly 4-8 inches. A resiliently compressible first rail cover layer 161 comprising a first rail cover material 181 is disposed on and covers the first rail bottom side 195 and the first permanent magnet or magnets 200 and may have the same size and shape as the first rail bottom side 195. The second laterally-extending rail 193 comprises a rectangular cross-sectional shape defined by a second rail outer side 199 that extends vertically by the rail height (hR) from the longitudinally-extending base bottom side 154 to a second rail bottom side 198, the second rail bottom side 198, and an opposed second rail inner side 197 that extends vertically by the rail height (hR) from the longitudinally-extending base bottom side 154 to the second rail bottom side 198. The second laterally-extending rail 193 comprises at least one second magnet recess 203 formed in the second rail bottom side 198, and in certain embodiments comprises a plurality of second magnet recesses 203. At least one second permanent magnet 202 is disposed in the second magnet recess 203, and in embodiments where a plurality of second magnet recesses 203 are employed, a corresponding plurality of second permanent magnets 202 are disposed in the second magnet recesses 203. A second rail cover layer 162 comprising a second rail cover material 182 is disposed on the second rail bottom side 198 and covers the second permanent magnet 202. The second permanent magnet or magnets 202 may have any suitable size and shape, including those described herein, which may the same as or different than those of the first permanent magnets 200, and in one embodiment are the same size and shape as those of the first permanent magnets. The second permanent magnets 202 may also be attached within the second magnet recesses 203 by a separate attachment, such as a peripheral and/or bottom side glue joint or a fastener. The second rail bottom side 198 has a second width (wR2) sufficient to accommodate the sizes and shapes of the second magnet recesses 203 and second permanent magnets 202, which in one embodiment may range from 4-10 inches, more particularly 4-8 inches, and in one embodiment may be the same as the first width (wR1). A resiliently compressible second rail cover layer 162 comprising a second rail cover material 182 is disposed on and covers the second rail bottom side 198 and the second permanent magnet or magnets 202 and may have the same size and shape as rail bottom side 198. The first rail cover layer 161 and second rail cover layer 162 may have the same size and shape and thickness and the first rail cover material 181 and second rail cover material 182 may comprise the same material or different materials. In one embodiment, the first rail cover layer 161 and second rail cover layer 162 may have a thickness range of 0.01-0.75 inches, more particularly 0.1-0.5 inches, and even more particularly 0.1-0.25 inches. The first rail cover material 181 and second rail cover material 182 may be the same material or different materials and may comprise any suitable material that provides a high degree of adhesion to a metal roof surface, including those described herein for cover material 18. In one embodiment, the first rail cover material 181 and second rail cover material 182 comprise a natural or synthetic rubber or rubber foam, a silicone or silicone foam, with high degree of tackiness for adhesion to the smooth surface of the metal roof. The combination of the tackiness and adhesion of the first rail cover material 181 and second rail cover material 182 and the magnet attraction force of the first permanent magnet or magnets 200 and the second magnet or magnets 202 is sufficient to secure and adhere the roof support 32 to the surface of a metal sloped roof 36 as a roofing load 2 as described herein is applied.

The first permanent magnets 200 and second permanent magnets 202 may comprise any suitable permanent magnet material 205, particularly any suitable ferromagnetic or ferrimagnetic materials. Suitable permanent magnetic materials include magnetic alloys of iron, cobalt and/or nickel; ALNICO magnets made by casting or sintering a combination of aluminum, nickel and cobalt with iron and small amounts of other elements added to enhance the properties of the magnet; ceramic, or ferrite, magnets made of a sintered composite of powdered iron oxide and barium/strontium carbonate ceramic; and rare-earth magnets, including various samarium-cobalt and neodymium-iron-boron (NIB) magnets.

The laterally-extending rails 190 comprise a rail material 192. The rail material 192 may comprise any material suitable for forming rails, including wood, metal, or polymer, particularly a substantially rigid engineering thermoset or thermoplastic polymer. In one embodiment, the rail material 192 is the same material as the base material 149 and may comprise any of the materials disclosed herein for use as the base material 149 or the core material 14. In one embodiment, the laterally-extending rails 190 are formed integrally with the longitudinally-extending base member 150 and thus comprise the same material as the base material 149. In one embodiment, the laterally-extending rails 190 are formed separately from the longitudinally-extending base member 150 and may be attached to the longitudinally-extending base member 150 using any suitable rail attachment device, including a plurality of threaded fasteners, such as threaded screws or bolts. In one embodiment, the laterally-extending rails 190 are formed integrally with the longitudinally-extending base member 150 comprising base material 149, and the base material comprises a substantially rigid engineering thermoset or thermoplastic polymer foam, and the first rail cover material 181 and second rail cover material 182 comprise a resiliently compressible polymer foam.

Referring to FIGS. 47-55, in one embodiment, the lightweight composite roofing support system 10 comprises a longitudinally-extending base member 150 comprising base material 149 as described herein, which further comprises an integral longitudinally-extending shelf 210 that also extends outwardly and laterally away from at least one of the second base side 171 or the third base side working surface 177 and comprises a lower surface 216 that is coplanar with and by virtue of being integral with forms a part of the longitudinally-extending base bottom side 154 and that, respectively, extends outwardly away from at least one of the first base edge 156 or second base edge 158. The longitudinally-extending base member 150 comprising the integral longitudinally-extending shelf 210 may be formed from the same base materials 149 described herein and may have the same sizes and same lateral cross-section shapes of the base members described herein apart from the integration of the lateral cross-section 122 shape of the longitudinally-extending shelf 210. The lateral cross-section shape 122 of the longitudinally-extending shelf 210 may be understood from the left and right end views (FIGS. 50 and 51) to be substantially rectangular in embodiments without the integral upwardly-protruding longitudinally-extending rim 212 (as demarcated by the vertical phantom lines), and generally L-shaped with the integral upwardly-protruding longitudinally-extending rim. The longitudinally-extending base member 150 comprising the integral longitudinally-extending shelf 210 may have the same ranges of lengths described herein. The integral longitudinally-extending shelf 210 may have any suitable width (wS), which in one embodiment ranges from 6 to 20 inches, more particularly 8 to 18 inches, and more particularly 10 to 18 inches, and yet more particularly (12 to 16 inches). The integral longitudinally-extending shelf 210 may have any suitable shelf thickness (tS), which in one embodiment ranges from 0.5 to 2.0 inches, more particularly 0.75 to 1.75 inches, and more particularly 0.75 to 1.50 inches. It is desirable to make the longitudinally-extending shelf 210 as thin and strong as possible while maintaining flexural and tensile strength sufficient to support the desired shelf loads 98 and avoid failure of the shelf in bending due to application of these loads. In this regard, in one embodiment, the longitudinally-extending base member 150 comprising the integral longitudinally-extending shelf 210 may be molded with a variable density base material 149 which is a lower density in the upper portions (dU) of base member away from the shelf and higher density (dL) in the integral longitudinally-extending shelf 210 and portions of the longitudinally-extending base member 150 proximate the shelf as illustrated schematically in FIGS. 50 and 51 as demarcated by optional interface 116. Variable density of the core material 14 within the core member 12 or base material 149 within the longitudinally-extending base member 150 may be employed in any of the embodiments of core member 12 and/or longitudinally-extending base member 150 described herein, and the density may be infinitely variable or discretely variable throughout all or any portion of the core member 12 cross-section 22 or base member cross-section, and be lower in the upper portions and higher in the lower portions, or vice versa, and may also be varied longitudinally, laterally, or both, within core member 12 and longitudinally-extending base member 150. The longitudinally-extending shelf 210 is configured to hold roofing material 8 as described herein, including various tools and equipment, particularly roofing tools and equipment, and particularly a bundle or bundles of shingles 99 for use by a roofing worker 6 or user that is disposed on and using the lightweight composite roofing support system 10 that includes the integral longitudinally-extending shelf 210. The integral longitudinally-extending shelf 210 may be very advantageously used to provide a portable platform that may be used to store the roofing materials 8 as described herein, such as a bundle or bundles of shingles 99, in a plurality of locations on the sloped roof 36 as the roofing materials are being installed and may be easily moved upslope or downslope or side-to-side from the eaves to the roof peak 39 of a sloped roof 36 to facilitate installation. This is a very desirable and advantageous location for storage of roofing materials 8 as they can also be easily distributed upslope or downslope or side-to-side to roofing workers 6 that are also installing materials on the sloped roof 36. In one embodiment, the integral longitudinally-extending shelf 210 further comprises an integral upwardly-protruding longitudinally-extending rim 212 on a distal edge or end 214 of the shelf to assist in retaining items that are placed on the shelf.

Referring again to FIGS. 47-55, the lightweight composite roofing support system 10 comprises a longitudinally-extending base member 150 as described herein and the longitudinally-extending roof attachment member 15, such as cover layer 16 comprising cover material 18, will be sized to also cover all or substantially all of the longitudinally-extending base bottom side 154, including the portion associated with the lower surface 216 of the longitudinally-extending shelf 210. Representative ranges of the width (w1') of the first roof contact side 28 comprising the longitudinally-extending shelf 210 and associated cover layer 16 may be obtained by adding their representative ranges as described herein without the shelf (w1) to the representative ranges of the width (wS) of the shelf described herein, for example, (18 to 48 inches)+(6 to 20) inches=w1'=(24 to 68 inches), more particularly (20 to 40) inches+(8 to 18) inches=w1'=(28 to 58 inches), even more particularly (20 to 30 inches)+(10 to 18 inches)=w1'=(30 to 48 inches), and yet more particularly (22 to 28 inches)+(12 to 16 inches)=w1'=(32 to 44 inches).

In the embodiment of FIGS. 47-55, the cover layer 16 and cover material 18 may comprise those described in any of the embodiments of lightweight composite roofing support system 10 described herein. The cover layer 16 may be disposed on the longitudinally-extending base bottom side 154 in any suitable manner using any suitable attachment as described herein.

Figure 56:
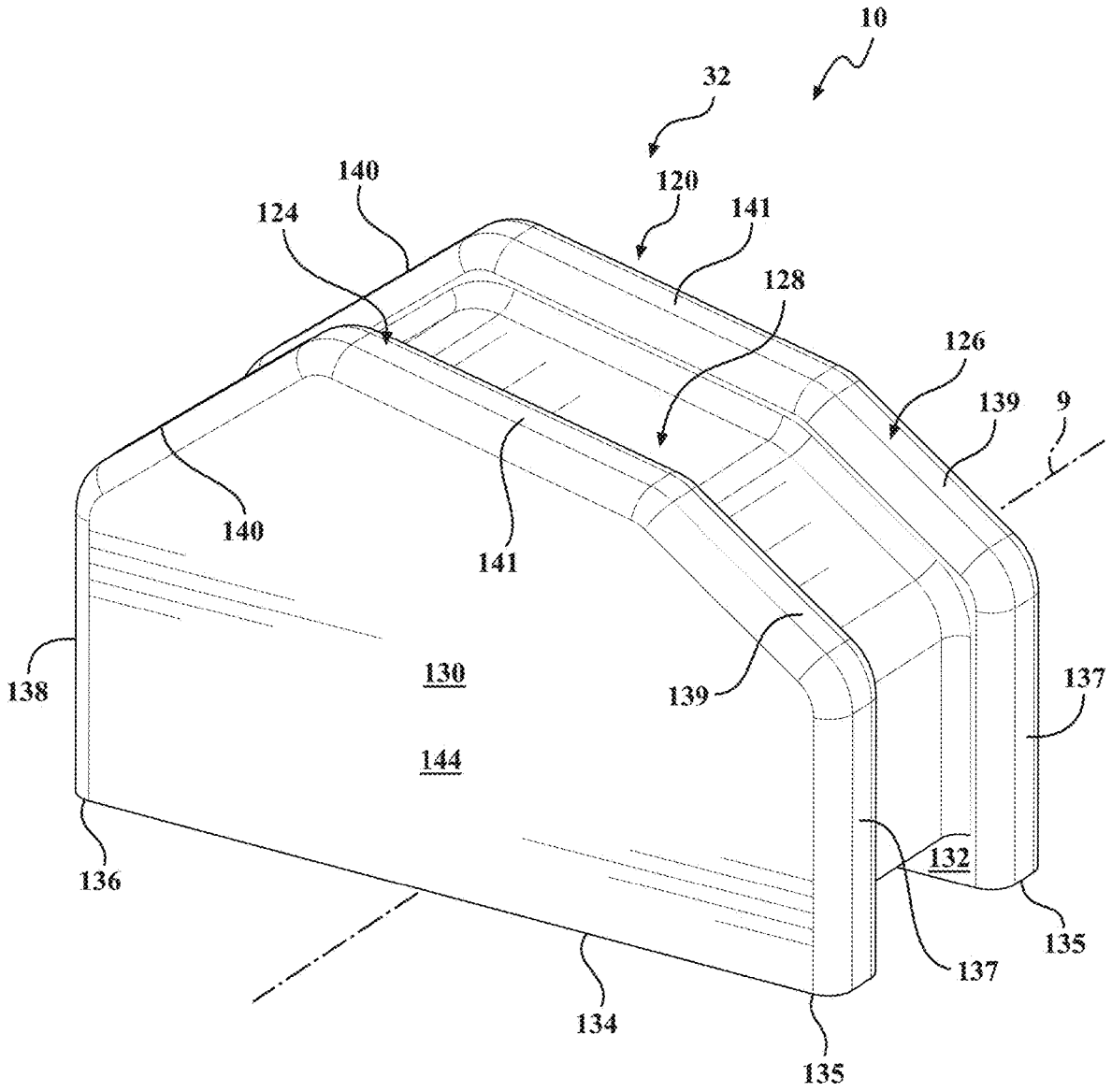
FIG. 56 is a perspective view of an embodiment of a lightweight roofing support system connector for use with the embodiments of the roofing support system and roof supports as described herein.
Figure 57:
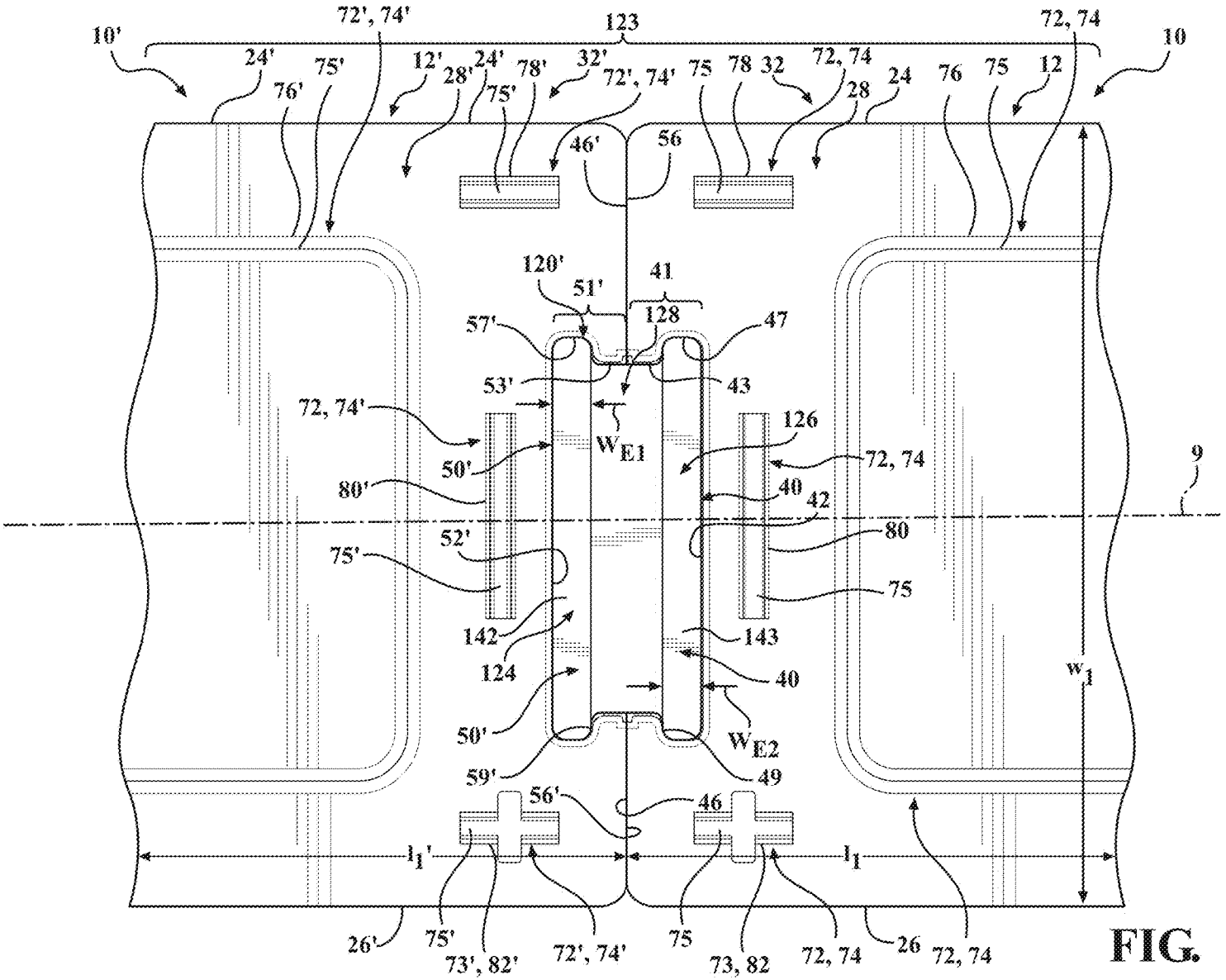
FIG. 57 is a bottom view of an embodiment of a roofing support system connector of FIG. 56 connecting two roof supports to form an extended or extendable roofing support system and roof support as described herein.

Referring to FIGS. 56 and 57, the lightweight composite roofing support system 10 and roof support 32 may comprise a lightweight composite roofing support system connector 120 or longitudinally-extending roofing support connector 120. The lightweight composite roofing support system connector 120 is configured to connect the first core end 46 of one roofing support 32 to the second core end 56 of another roofing support 32. Using a plurality of longitudinally-extending roofing support connectors 120 and roofing supports 32, the length of lightweight composite roofing support system 10 comprising core member 12, longitudinally-extending base member 150, and roof attachment member 15 may be extended to any desired length, including a length that extends entirely from side-to-side across the length of any sloped roof 36. Thus, the longitudinally-extending roofing support connectors 120 and roof supports 32 can provide an extended roof platform 123 that extends entirely from side-to-side across any sloped roof 36, allowing roofing workers to freely move, walk, stand, crouch, kneel, sit, or lie on, or otherwise use the extended roof platform and to distribute or store roofing tools or roofing materials across all or any portion of the length of any sloped roof, as well as to store or stage roofing materials across all or any portion of the length of any sloped roof. For example, the extended roof platform 123 also allows very advantageous and easier distribution of roofing materials 8 from a central peak platform 68 across the sloped roof 36 near the roof peak 39 where they can be distributed downslope to areas where the materials are being applied to the roof deck.

Referring to FIGS. 1-57, the longitudinally-extending roofing support connector 120 comprises a laterally-extending first connector end 124 and an opposed laterally-extending second connector end 126 joined together by a longitudinally-extending intermediate portion 128. The first connector end 124 is configured for selective engagement/disengagement or insertion/removal within the second slot 51' of the second core member 12' and second roof support 32' and the laterally-extending second connector end 126 is configured for selective engagement/disengagement or insertion/removal within the first slot 41 of the first core member 12 and first roof support 32, wherein upon engagement, the longitudinally-extending roofing support connector 120 is configured to connect the first roof support 32 and the second roof support 32'. FIG. 57 illustrates the first core member 12 and the second core member 12' with their base members 150 and the roof attachment member 15, such as resiliently compressible cover layers 16, selectively detached or removed for purpose of illustrating the connection or joint formed by the longitudinally-extending roofing support connector 120. In normal use, the base members 150 that extend over first slot opening 40 and second slot opening 50' would be removed to reveal the first slot opening 40 and second slot opening 50' and enable insertion of the longitudinally-extending roofing support connector 120 with the laterally-extending second connector end 126 inserted into the first slot 41 and the first connector end 124 inserted into the second slot 51'. Upon insertion of the longitudinally-extending roofing support connector 120, the base members 150 and the roof attachment members 15, such as resiliently compressible cover layers 16, would be selectively attached or replaced and the base members 150 extend over first slot opening 40 and second slot opening 50' and retain the longitudinally-extending roofing support connector 120 in place. The portions of the base members 150 that extend over first slot opening 40 and second slot opening 50' act as a retainer and prevent the connector from coming back out of the first slot 41 through the first slot opening 40 and/or the second slot 51' through second slot opening 50' during use.

The laterally-extending first connector end 124 and an opposed laterally-extending second connector end 126 may have any suitable lateral cross-section shapes or sizes. In one embodiment, the first end lateral cross-section 130 shape of the first connector end 124 comprises an irregular hexagon and the shape of the second slot 51' also comprises a mating irregular hexagon cross-section shape, and second end lateral cross-section 132 shape of the laterally-extending second connector end 126 comprises an irregular hexagon that is a mirror image of the first connector end 124 and the shape of the first slot 41 also comprises a mating irregular hexagon cross-section shape that is a mirror image of the second slot 51'. The size, particularly the first end width (wE1), of the first connector end 124 should be the same as, or slightly greater than, the width (d2) of the second slot 51' to provide, respectively, touching contact or an interference fit between them in order to promote retention of the first connector end 124 within the second slot 51'. The size, particularly the second end width (wE2), of the laterally-extending second connector end 126 should be the same as, or slightly greater than, the width (d1) of the first slot 41 to provide, respectively, touching contact or an interference fit between them in order to promote retention of the laterally-extending second connector end 126 within the first slot 41. In one embodiment, the first connector end 124 has the same first end lateral cross-section 130 shape as the opening shape of first recess 45, namely, an irregular hexagon cross-section shape comprising a lateral edge 134 having a second side edge end 135 and an opposed third side edge end 136, a second side vertical edge 137 extending from the second side edge end 135 upwardly toward second side 30, a third side vertical edge 138 extending from the third side edge end 136 upwardly toward third side 34, a tapered second side edge 139 configured to extend upwardly parallel to second side 30, a tapered third side edge 140 configured to extend upwardly parallel to the third side 34, a tapered fourth side edge 141 configured to extend parallel to fourth side 35 between second side edge 139 and third side edge 140.

The laterally-extending second connector end 126 may comprise any suitable second end lateral cross-section 132 shape configured for disposition and engagement as described. In one embodiment, the laterally-extending second connector end 126 has the same second end lateral cross-section 132 shape as the opening of the second recess 55, namely, an irregular hexagon shape and comprises a mirror image of the first end lateral cross-section 130 shape of the first connector end 124 and may be described as having the same elements as the first connector end 124.

The first connector end 124 also comprises a first base 142. In one embodiment, the first base 142 comprises a flat planar base and is configured in the inserted or installed condition and position to be coplanar with the first roof contact side 28'. The laterally-extending second connector end 126 also comprises a second base 143. In one embodiment, the second base 143 comprises a flat planar base and is configured in the engaged, inserted or installed condition and position to be coplanar with the first roof contact side 28.

The lightweight composite roofing support system connector 120 also comprises the longitudinally-extending intermediate portion 128. The longitudinally-extending intermediate portion 128 may have any suitable intermediate portion cross-section shape, which in one embodiment is the same as first end lateral cross-section 130 shape and second end lateral cross-section 132 shape with a reduced size as shown in FIGS. 56 and 57.

The lightweight composite roofing support system connector 120 is formed from and comprises connector material 144. Connector material 144 may comprise any of the core materials 14 described herein and may be selected to be the same material as core material 14 or different than core material 14. Since the cross-section area or size of the longitudinally-extending intermediate portion 128 is less than the lateral cross-section 22 of the core members 12, 12', in one embodiment the longitudinally-extending roofing support connector 120 will comprise connector material 144 that has one or more of a higher density, compressive strength, compression set, tensile strength, or flexural strength than the core material 14 to ensure consistent strength of the extended platform 123 along its length, and more particularly that the strength is at least as high in the longitudinally-extending roofing support connector 120 at the interface between roof supports 32 and 32' at first core end 46 and second core end 51' as it is in the intermediate portions of the supports.

Referring to FIGS. 1-17, 56, and 59, in one embodiment, the lightweight composite roofing support system connector 120 is configured for use with a first roof support 32 and the second roof support 32' (the first and second roof supports 32, 32' being identical or having the same essential feature and differing, if at all, only in length (e.g., (l1, l1') with the (') used only to differentiate between them), each comprising: a longitudinally-extending core member 12, 12' comprising a longitudinally-extending first roof contact side 28, 28' comprising a longitudinally-extending first core edge 24, 24' and an opposed longitudinally-extending second core edge 26, 26', a longitudinally-extending second side 30, 30' comprising a second side working surface 31, 31' having a second width (w2 w2') and a second length (l2, l2') that is greater than the second width, the second side 30, 30' tapering toward the first core edge 24, 24' at a first predetermined acute angle ($\alpha$) from the first roof contact side 28, 28', and a longitudinally-extending third side 34, 34' comprising a third side working surface 33, 33' having a third width and a third length that is greater than the third width, the third side 34, 34' tapering toward the second core edge 26, 26' at a second predetermined acute angle ($\beta$, $\beta'$) from the first contact side 28, 28' that is different than the first predetermined acute angle ($\alpha$, $\alpha'$), a laterally-extending first core end 46, 46' comprising an integral first recess 45, 45' defining a first handle or grip 48, 48', and an opposed laterally-extending second core end 56, 56' comprising an integral second recess 55, 55' defining a second handle or grip 58, 58', the core member 12, 12' comprising a core material 14, 14' and a wedge-shaped lateral cross-section 22, 22' shape. The first roof support 32 and the second roof support 32' also each comprise a cover layer 16, 16' comprising a compressible cover material 18, 18', the cover layer 16, 16' disposed on and covering the first roof contact side 28, 28', wherein the first recess 45, 45' defines a first slot 41, 41' that opens into the longitudinally-extending first roof contact side 28, 28' proximate the first core end 46, 46' and the second recess 55, 55' defines a second slot 51, 51' that opens into the first roof contact side 28, 28' proximate the second core end 56, 56', the first connector end 124 is configured for mating engagement within the second slot 51' of the second roof support 12', the laterally-extending second connector end 126 configured for mating engagement within the first slot 41, respectively, of the first roof support 32. FIG. 57 illustrates an installed or inserted position and condition of the longitudinally-extending roofing support connector 120 within the first roof support 32 and the second roof support 32'. In one embodiment, the first connector end 124 comprises an irregular hexagonal first end lateral cross-section 130 shape and laterally-extending second connector end 126 comprises an irregular hexagonal second end lateral cross-section 132 shape, and the first slot 41 comprises a mating irregular hexagonal first slot lateral cross-section shape illustrated by the shape of recess 45 and the second slot 51' comprises a mating irregular hexagonal second slot lateral cross-section shape illustrated by the shape of recess 55' opening. In one embodiment, irregular hexagonal first end lateral cross-section 130 shape and irregular hexagonal second end lateral cross-section 132 shape are mirror images of one another.

In other embodiments, the longitudinally-extending roofing support connector 120 may have another first end lateral cross-section 130 shape and another second end lateral cross-section 132 shape. For example, referring to the embodiment of a core member 12 comprising a triangular double-wedge lateral cross-section 22, more particularly a rounded or blunted scalene triangular double-wedge lateral cross-section, as described herein and illustrated in FIG. 60, a suitable longitudinally-extending roofing support connector 120 would have the irregular pentagon cross-section shape of the periphery of the handle or grip 58, and could be described using the same elements as set for herein for longitudinally-extending roofing support connector 120, except that there would be no tapered fourth side edge 141 configured to extend parallel to fourth side 35 between second side edge 139 and third side edge 140, rather, second side edge 139 and third side edge 140 would taper to and intersect one another. This lightweight composite roofing support system connector 120 also comprises the longitudinally-extending intermediate portion 128. The longitudinally-extending intermediate portion 128 may have any suitable intermediate portion cross-section shape, which in one embodiment is the same as first end lateral cross-section 130 shape and second end lateral cross-section 132 shape, namely, an irregular pentagon with a size or cross-sectional area smaller than the first end lateral cross-section 130 and the second end lateral cross-section 132.

The terms "a" and "an" herein do not denote a limitation of quantity, but rather denote the presence of at least one of the referenced items, and may include a plurality of the referenced items. The modifier "about" used in connection with a quantity is inclusive of the stated value and has the meaning dictated by the context (e.g., includes the degree of error associated with measurement of the particular quantity). Furthermore, unless otherwise limited all ranges disclosed herein are inclusive and combinable (e.g., ranges of "up to about 25 weight percent (wt. %), more particularly about 5 wt. % to about 20 wt. % and even more particularly about 10 wt. % to about 15 wt. %" are inclusive of the endpoints and all intermediate values of the ranges, e.g., "about 5 wt. % to about 25 wt. %, about 5 wt. % to about 15 wt. %", etc.). The use of "about" in conjunction with a listing of items is applied to all of the listed items, and in conjunction with a range to both endpoints of the range. Finally, unless defined otherwise, technical and scientific terms used herein have the same meaning as is commonly understood by one of skill in the art to which this invention belongs. The suffix "(s)" as used herein is intended to include both the singular and the plural of the term that it modifies, thereby including one or more of that term (e.g., the metal(s) includes one or more metals). Reference throughout the specification to "one embodiment", "another embodiment", "an embodiment", and so forth, means that a particular element (e.g., feature, structure, and/or characteristic) described in connection with the embodiment is included in at least one embodiment described herein, and may or may not be present in other embodiments.

It is to be understood that the use of "comprising" in conjunction with the components or elements described herein specifically discloses and includes the embodiments that "consist essentially of" the named components (i.e., contain the named components and no other components that significantly adversely affect the basic and novel features disclosed), and embodiments that "consist of" the named components (i.e., contain only the named components).

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description but is only limited by the scope of the appended claims.

What is claimed is:

1. A lightweight composite roofing support system, comprising:

a longitudinally-extending core member comprising a dual wedge-shaped lateral cross-section comprising a first wedge and an opposed second wedge and a common longitudinally-extending first roof contact side comprising a longitudinally-extending first edge and an opposed longitudinally-extending second edge and having a first width and a longitudinally extending first length that is greater than the first width, the first wedge having a first acute wedge angle ($\alpha$), the second wedge having a second acute wedge angle ($\beta$) that is different than the first acute wedge angle ($\alpha$), the first wedge and second wedge having an obtuse included angle ($\gamma$) between them opposite the first roof contact side, a laterally-extending first end comprising an integral first recess defining a first handle or grip, and an opposed laterally-extending second end comprising an integral second recess defining a second handle or grip, the core member comprising a core material, and the dual wedge-shaped cross section of the core material extending longitudinally between the first handle or grip and the second handle or grip, the first roof contact side having a generally planar shape comprising a base attachment structure disposed on a central portion thereof configured for selective attachment to and detachment from a mating core attachment structure of a base member.

2. The roofing support system of claim 1, wherein the base attachment structure comprises a plurality of core recesses or core protrusions, or a combination thereof.

3. The roofing support system of claim 1, wherein the dual wedge-shaped lateral cross-section comprises a triangular, scalene trapezoidal, irregular quadrilateral, or truncated triangular shape.

4. The roofing support system of claim 1, wherein the first wedge comprises a longitudinally-extending second side comprising a second side working surface, and the second wedge comprises a longitudinally-extending third side comprising a third side working surface, and at least one of the second side working surface and third side working surface comprise a non-skid surface.

5. The roofing support system of claim 1, wherein the core material comprises a substantially rigid engineering thermoset or thermoplastic polymer.

6. A lightweight composite roofing support system, comprising:

a longitudinally-extending base member comprising a base material and comprising a longitudinally-extending first core contact side and an opposed longitudinally-extending base bottom side comprising a longitudinally-extending first base edge and an opposed longitudinally-extending second base edge, a base thickness ($t_B$), a longitudinally-extending second tapered portion tapering from the first core contact side toward the base bottom side and first base edge at a first acute base angle ($\alpha'$) and having a second tapered portion width ($W_{TP2}$), and an opposed longitudinally-extending third tapered portion tapering from the first core contact side toward the base bottom side and second base edge at a second acute base angle (β') and having a third tapered portion width ($W_{TP3}$), the first core contact side comprising a core attachment structure that is configured for selective attachment to and detachment from a mating base attachment structure of a core member, wherein the second tapered portion width ($W_{TP2}$) and the third tapered portion width ($W_{TP3}$) are a function of the base thickness ($t_B$); and a roof attachment member disposed on the base bottom side that is configured for contact with and adhesion to a sloped roof surface.

7. The roofing support system of claim 6, wherein the core attachment structure comprises a plurality of base protrusions or base recesses, or a combination thereof.

8. The roofing support system of claim 7, wherein the plurality of base protrusions or base recesses, or a combination thereof, comprises a plurality of load-bearing base protrusions or load-bearing base recesses and a plurality of retention base protrusions or retention base recesses, or a combination thereof.

9. The roofing support system of claim 8, wherein the plurality of load-bearing base protrusions or load-bearing base recesses, or a combination thereof, are disposed in a central portion of the first core contact side and the plurality of retention base protrusions or retention base recesses, or a combination thereof, are disposed peripherally about the plurality of load-bearing base protrusions or load-bearing base recesses, or a combination thereof.

10. The roofing support system of claim 6, wherein the second tapered portion comprises a second base side non-skid surface and the third tapered portion comprises a third base side non-skid surface.

11. The roofing support system of claim 6, wherein the roof attachment member comprises a cover layer comprising a resiliently compressible cover material, the cover layer disposed on and covering the base bottom side.

12. The roofing support system of claim 11, wherein the base material comprises a substantially rigid engineering thermoset or thermoplastic polymer and the cover material comprises a resiliently compressible polymer foam.

13. The roofing support system of claim 6, wherein the base member comprises a plurality of spaced apart, laterally-extending rails disposed on the base bottom side, each rail comprising a magnet recess formed in a rail bottom surface thereof, a permanent magnet disposed in the magnet recess, and a rail cover layer comprising a rail cover material disposed on and covering the rail bottom surfaces and the magnets.

14. The roofing support system of claim 13, wherein the base member comprises a first base end and an opposed second base end and the laterally-extending rails comprise a first laterally-extending rail and a second laterally-extending rail, and wherein the first laterally-extending rail is disposed proximate the first base end and the second laterally-extending rail is disposed proximate the second base end, or the first laterally-extending rail is disposed inwardly of the first base end and a second laterally-extending rail is disposed inwardly of the second base end.

15. The roofing support system of claim 13, wherein the base material comprises a substantially rigid engineering thermoset or thermoplastic polymer and the rail cover material comprises a resiliently compressible polymer foam.

16. The roofing support system of claim 6, wherein the base thickness ($t_B$) comprises a range of 1-5 inches.

17. The roofing support system of claim 16, wherein a maximum second tapered portion width ($W_{TP2}$) comprises $W_{TP2}=t_B/\sin\alpha'$ and a maximum third tapered portion width (TP3) comprises $W_{TP3}=t_B/\sin\beta'$.

18. A lightweight composite roofing support system, comprising:

a longitudinally-extending core member comprising a dual wedge-shaped lateral cross-section comprising a first wedge and an opposed second wedge and a common longitudinally-extending first roof contact side comprising a longitudinally-extending first edge and an opposed longitudinally-extending second edge and having a first width and a longitudinally extending first length that is greater than the first width, the first wedge having a first acute wedge angle (α), the second wedge having a second acute wedge angle (β) that is different than the first acute wedge angle (α), the first wedge and second wedge having an obtuse included angle (γ) between them opposite the first roof contact side, a laterally-extending first end comprising an integral first recess defining a first handle or grip, and an opposed laterally-extending second end comprising an integral second recess defining a second handle or grip, the core member comprising a core material and the dual wedge-shaped cross section of the core material extending longitudinally between the first handle or grip and the second handle or grip, the core member comprising a core material and a wedge-shaped lateral cross-section, the first roof contact side comprising a base attachment structure;

a longitudinally-extending base member comprising a base material and comprising a longitudinally-extending first core contact side and an opposed longitudinally-extending base bottom side comprising a longitudinally-extending first base edge and an opposed longitudinally-extending second base edge, the first core contact side comprising a core attachment structure that is configured for selective attachment to and detachment from the base attachment structure of the core member; and a roof attachment member disposed on the base bottom side that is configured for contact with and adhesion to a sloped roof surface.

19. The roofing support system of claim 18, wherein the wedge-shaped lateral cross-section comprises a triangular, scalene trapezoid, irregular quadrilateral, or truncated triangular shape.

20. The roofing support system of claim 18, wherein the core attachment structure comprises a plurality of core recesses or core protrusions, or a combination thereof, and the base attachment structure comprises a corresponding plurality of respective base protrusions or base recesses, or a combination thereof, and wherein the core recesses are configured for mating interlocking engagement with the base protrusions and/or the core protrusions are configured for mating interlocking engagement with the base recesses.

21. The roofing support system of claim 20, wherein the core recesses comprise barbed core recesses or core protrusions comprise barbed core protrusions and, respectively, the base protrusions comprise barbed base protrusions or the base recesses comprise barbed base recesses.

22. The roofing support system of claim 18, wherein the first wedge comprises a longitudinally-extending second side comprising a second side working surface, and the second wedge comprises a longitudinally-extending third side comprising a third side working surface, and wherein the longitudinally-extending base member further comprises a longitudinally-extending second tapered portion tapering from the first core contact side toward the base bottom side and first base edge at a first acute base angle (α'), and an opposed longitudinally-extending third tapered portion tapering from the first core contact side toward the base bottom side and second base edge at a second acute base angle (β'), the second tapered portion comprising a co-planar extension of the second side working surface and the third tapered portion comprising a co-planar extension of the third side working surface when the core attachment structure is attached to the base attachment structure of the core member.

23. The roofing support system of claim 22, wherein the second side working surface, second tapered portion, third side working surface, and third tapered portion each comprise a non-skid surface.

24. The roofing support system of claim 18, wherein the roof attachment member comprises a cover layer comprising a resiliently compressible cover material, the cover layer disposed on and covering the base bottom side.

25. The roofing support system of claim 24, wherein the core material and the base material comprise a substantially rigid engineering thermoset or thermoplastic polymer and the cover material comprises a resiliently compressible polymer foam.

26. The roofing support system of claim 18, wherein the roof attachment member comprises a plurality of spaced apart, laterally-extending rails disposed on the base bottom side, each rail comprising a plurality of magnet recesses formed in a rail bottom surface thereof, a plurality of permanent magnets disposed in the magnet recesses, and a plurality of rail cover layers comprising a rail cover material disposed on and covering the rail bottom surfaces and the magnets.

27. The roofing support system of claim 26, wherein the base member comprises a first base end and an opposed second base end and the laterally-extending rails comprise a first laterally-extending rail and a second laterally-extending rail, and wherein the first laterally-extending rail is disposed proximate the first base end and the second laterally-extending rail is disposed proximate the second base end, or the first laterally-extending rail is disposed inwardly of the first base end and the second laterally-extending rail is disposed inwardly of the second base end, and wherein the core material and the base material each comprise a substantially rigid engineering thermoset or thermoplastic polymer and the rail cover material comprises a resiliently compressible polymer foam.

* * * * *